US009834411B2

(12) United States Patent
Cox et al.

(10) Patent No.: US 9,834,411 B2
(45) Date of Patent: Dec. 5, 2017

(54) APPARATUS, SYSTEM, AND METHOD FOR PIPE MODULAR LIFT SYSTEM

(71) Applicant: Precision Surveillance Corporation, East Chicago, IN (US)

(72) Inventors: Christopher Cox, Valperaiso, IN (US); David Maldonado, Homewood, IL (US); Bogdan Gaita, Valparaiso, IN (US)

(73) Assignee: Precision Surveillance Company, East Chicago, IL (US)

( * ) Notice: Subject to any disclaimer, the term of this patent is extended or adjusted under 35 U.S.C. 154(b) by 233 days.

(21) Appl. No.: 14/693,267

(22) Filed: Apr. 22, 2015

(65) Prior Publication Data

US 2016/0251201 A1 Sep. 1, 2016

Related U.S. Application Data

(60) Provisional application No. 62/121,740, filed on Feb. 27, 2015.

(51) Int. Cl.
*B66B 9/02* (2006.01)

(52) U.S. Cl.
CPC ..... *B66B 9/025* (2013.01)

(58) Field of Classification Search
CPC ..... B66B 9/025
See application file for complete search history.

(56) References Cited

U.S. PATENT DOCUMENTS 47,761 A * 5/1865 Willard ..... B66B 9/025 187/271
186,455 A * 1/1877 Bragaldi ..... B66B 9/025 187/267
258,011 A * 5/1882 Bond ..... B66B 9/025 187/271
457,645 A * 8/1891 Hancock ..... B66B 9/025 108/147
529,414 A * 11/1894 Sague ..... B66B 9/025 187/267
828,029 A * 8/1906 Jackson ..... B66B 9/022 187/271
1,563,792 A * 12/1925 Rickard ..... B66B 9/025 187/267
1,566,223 A * 12/1925 Manor ..... B66F 7/14 187/268
1,986,620 A * 1/1935 Borden ..... B66B 9/025 187/267
2,395,735 A * 2/1946 Wallace ..... A47B 9/00 186/51
3,312,017 A * 4/1967 Witherspoon ..... B63G 8/33 114/119
3,768,628 A * 10/1973 Bross ..... B65G 65/44 187/214
3,851,854 A * 12/1974 Roybal ..... B66F 11/04 182/141
4,050,546 A * 9/1977 Wilson, Jr. ..... B66B 9/0823 187/201

(Continued)

*Primary Examiner* — Michael A Riegelman
(74) *Attorney, Agent, or Firm* — Adam K. Sacharoff; Much Shelist, P.C.

(57) ABSTRACT

In one embodiment, there is a unique heavy lifting system capable of transporting vertically heavy loads from grade to any elevation required by the project.

17 Claims, 92 Drawing Sheets

(56) References Cited

U.S. PATENT DOCUMENTS

| | | | | | |
|---|---|---|---|---|---|
| 4,051,923 | A * | 10/1977 | Blanchette | B66B 5/027 | 187/271 |
| 4,097,044 | A * | 6/1978 | Miniere | A63B 69/0002 | 473/451 |
| 4,287,967 | A * | 9/1981 | Perkins | B66B 9/025 | 187/268 |
| 5,750,915 | A * | 5/1998 | Bedegrew | F41F 3/04 | 102/358 |
| 6,253,878 | B1 * | 7/2001 | Wells | B66B 9/025 | 182/141 |
| 6,679,467 | B1 * | 1/2004 | Softness | F16M 11/2071 | 248/278.1 |
| 2011/0155509 | A1 * | 6/2011 | Hsieh | B66B 9/025 | 187/267 |
| 2014/0123576 | A1 * | 5/2014 | Meyer | E04F 15/02452 | 52/126.6 |
| 2014/0182977 | A1 * | 7/2014 | Chen | B66B 9/025 | 187/271 |
| 2015/0360908 | A1 * | 12/2015 | Chen | B66B 9/025 | 187/406 |
| 2016/0300631 | A1 * | 10/2016 | Leister | G21F 5/14 | |

* cited by examiner

SCALE 1 / 128

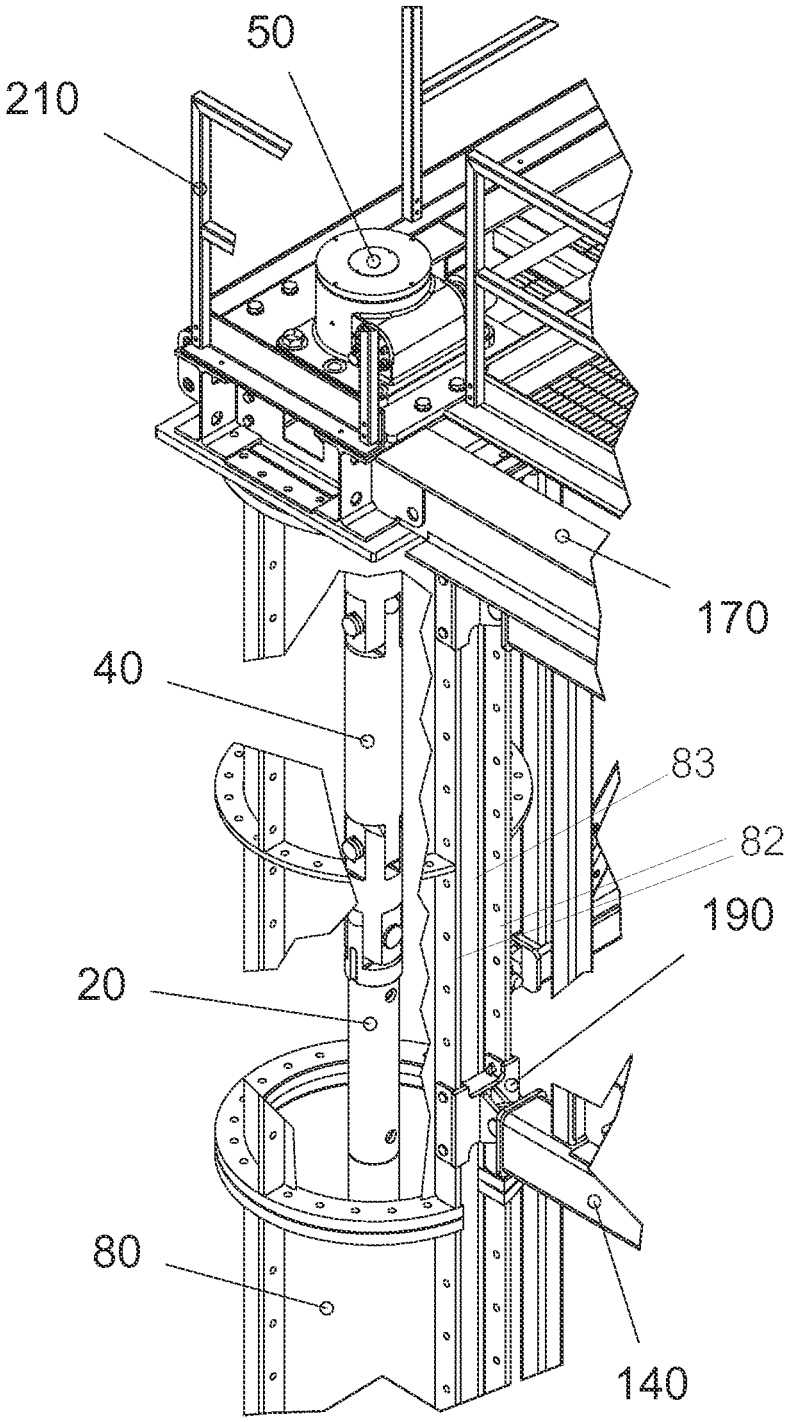
FIG. 1-A
SCALE 1 / 24

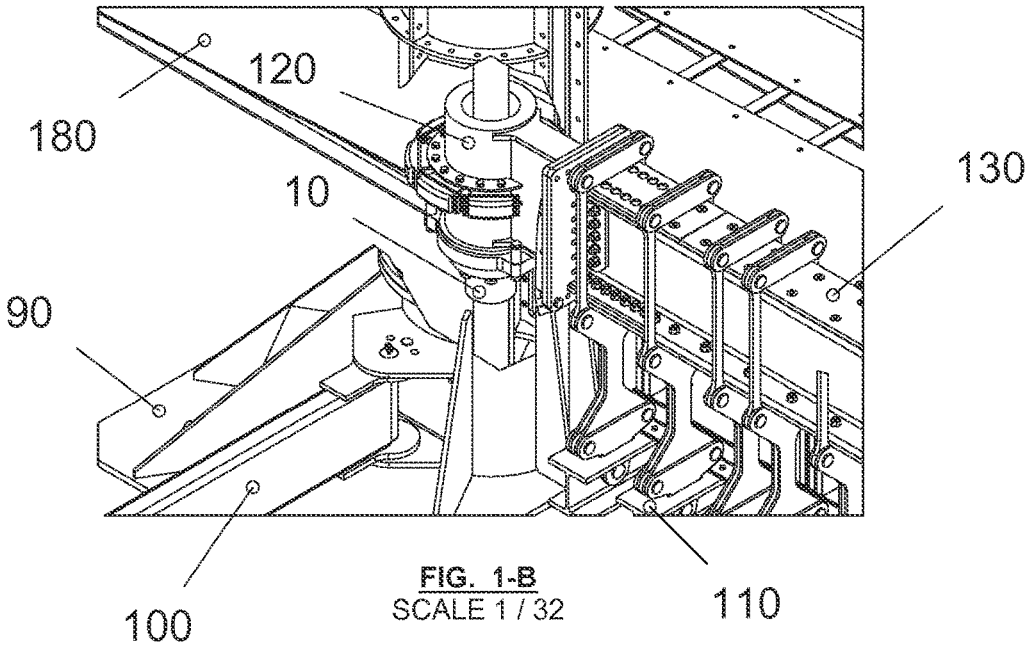
FIG. 1-B
SCALE 1 / 32
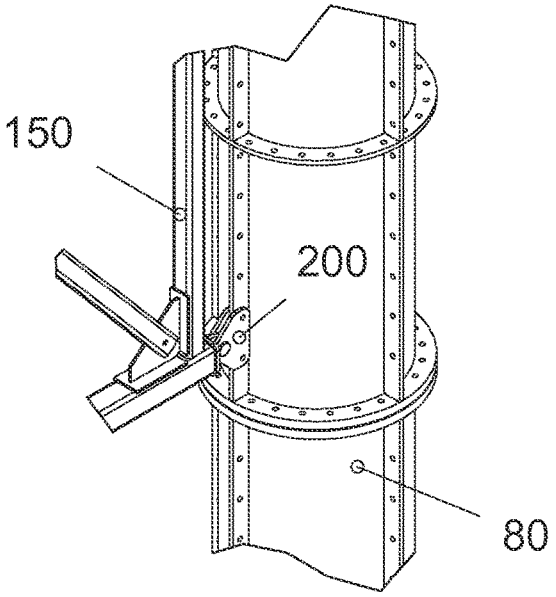
FIG. 1-C
SCALE 1 / 30

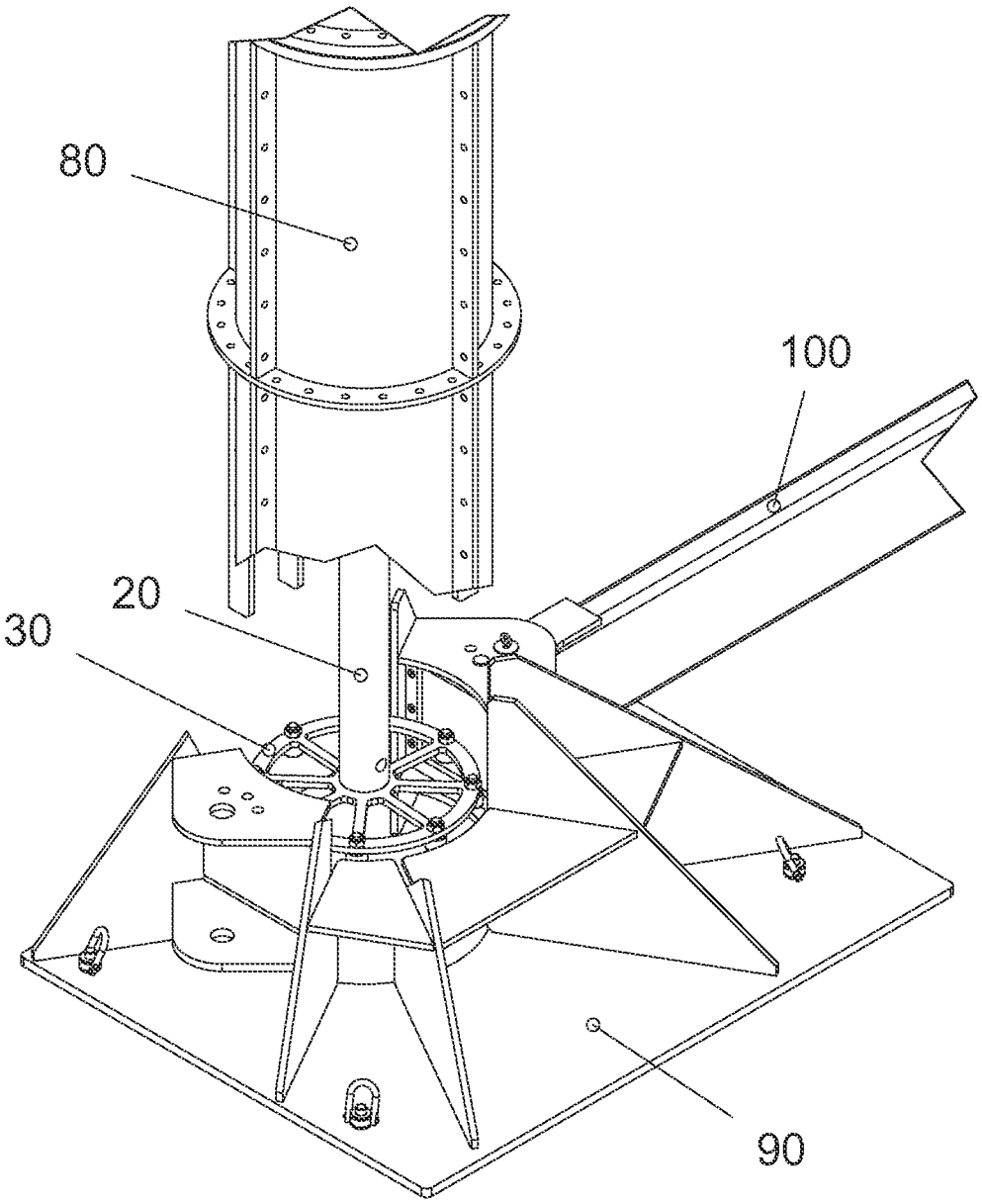
FIG. 1-D
SCALE 1 / 24

SCALE 1 / 128

SCALE 1 / 128

SCALE 1 / 128

SCALE 1 / 64

SCALE 1 / 48

SCALE 1 / 60

SCALE 1 / 30

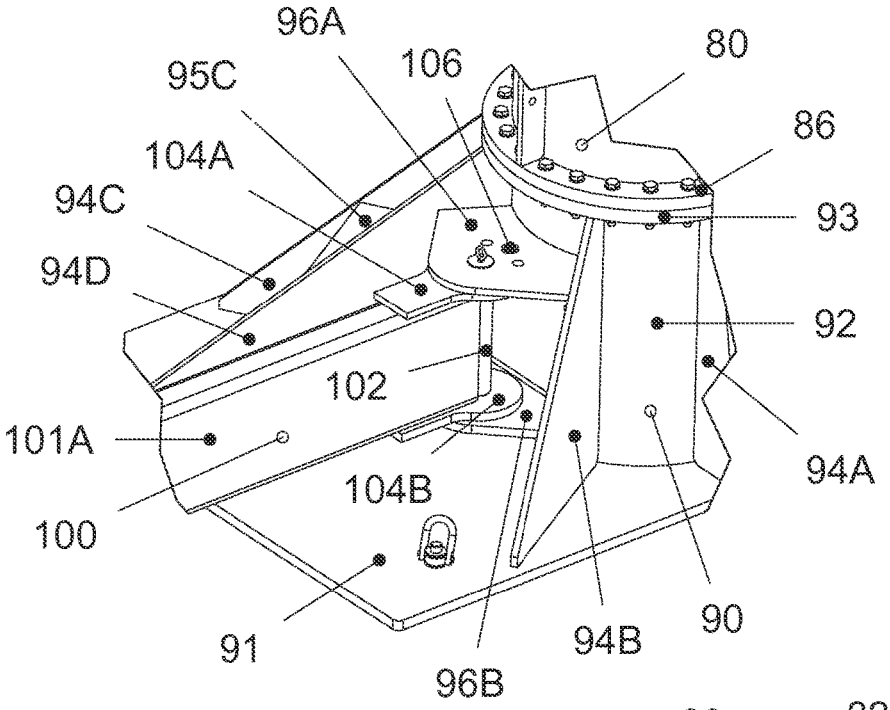
FIG. 6-A
SCALE 1 / 20
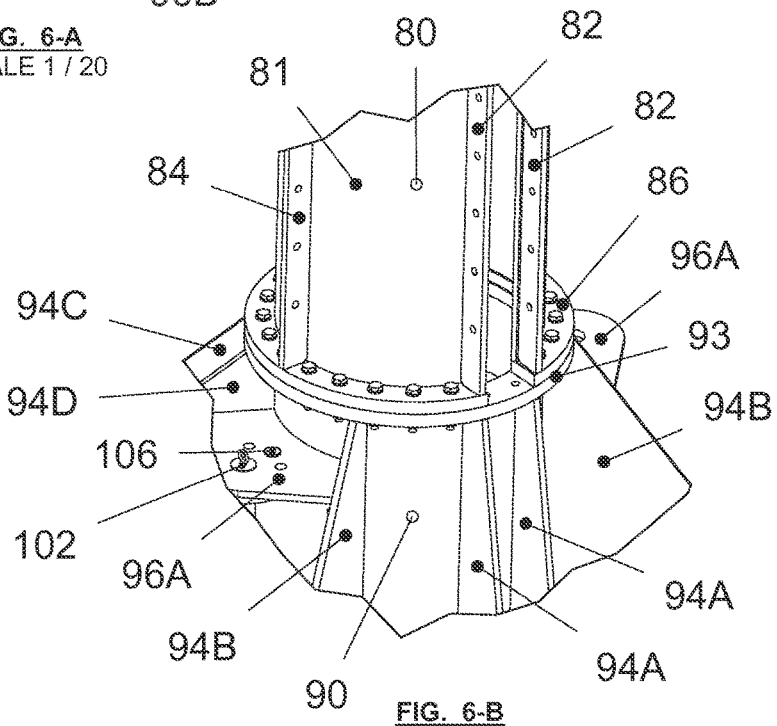
FIG. 6-B
SCALE 1 / 20

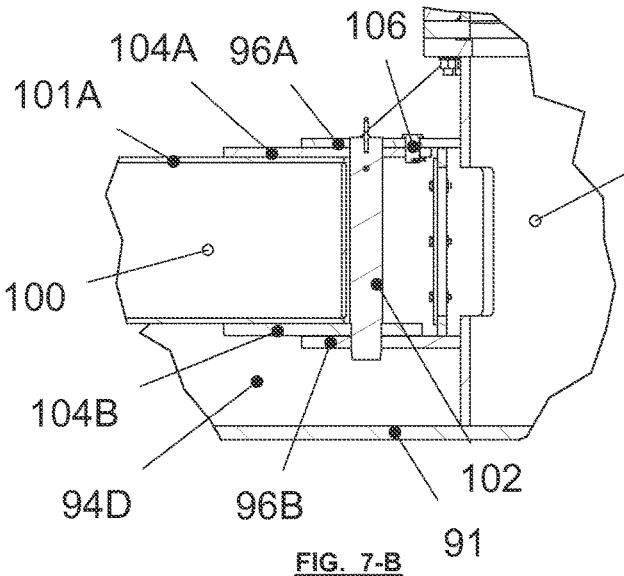
FIG. 7-B
SCALE 1 / 16
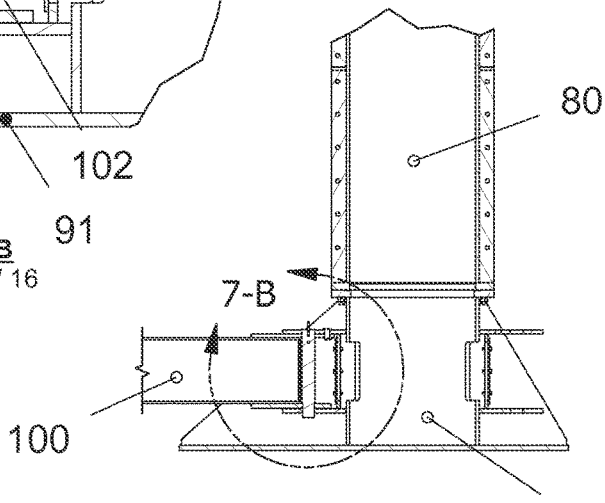
FIG. 7A
SCALE 1 / 40
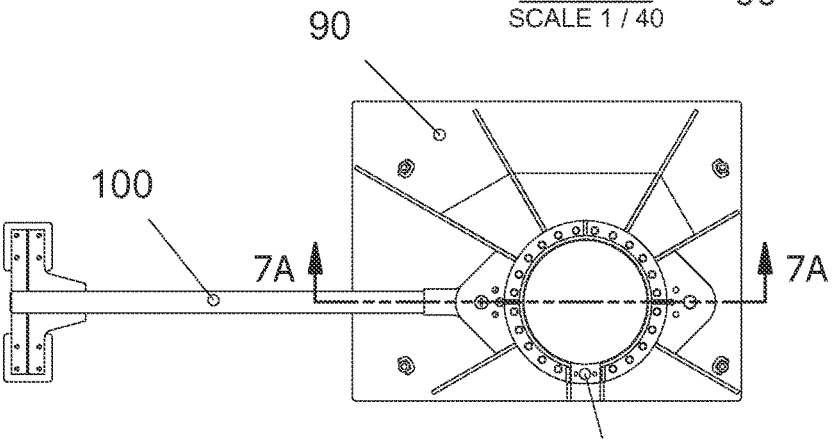
FIG. 7
SCALE 1 / 40

SCALE 1 / 40

SCALE 1 / 40

SCALE 1 / 40

SCALE 1 / 24

SCALE 1 / 24

SCALE 1 / 24

SCALE 1 / 16

SCALE 1 / 32

SCALE 1 / 24

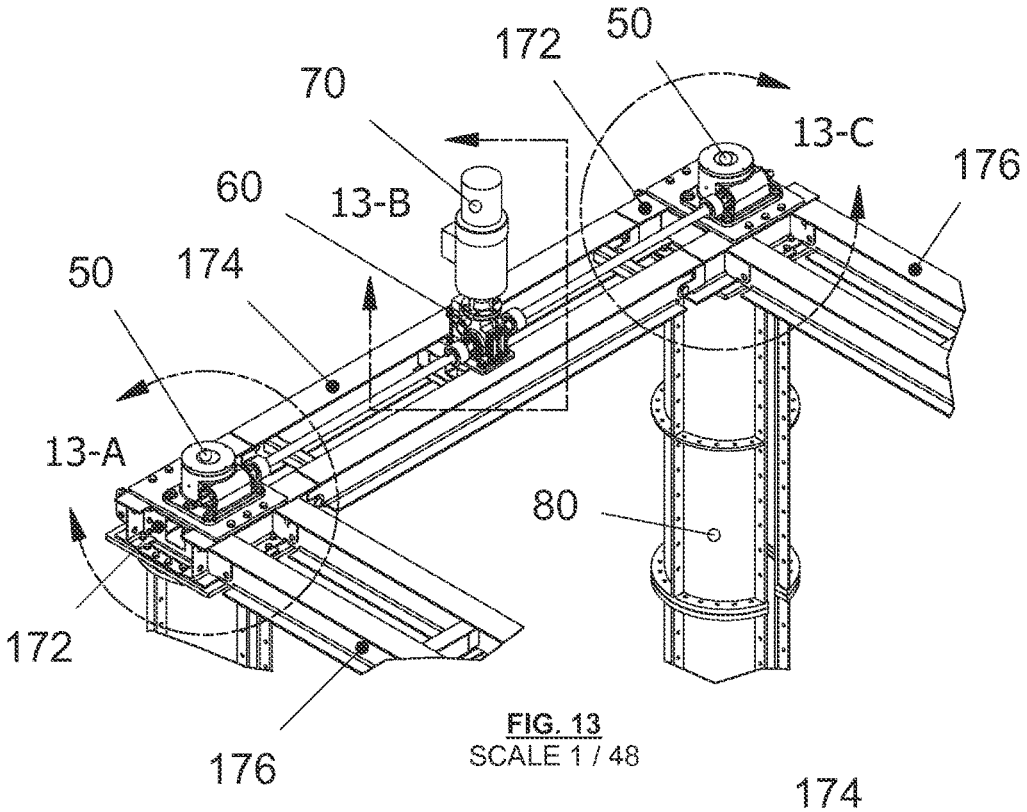
FIG. 13
SCALE 1 / 48
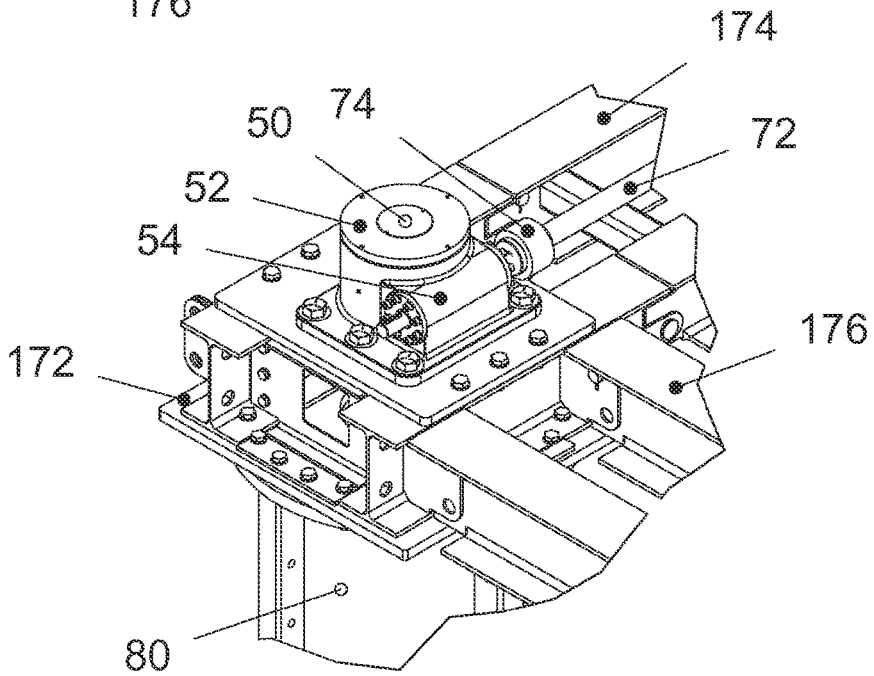
FIG. 13-A
SCALE 1 / 20

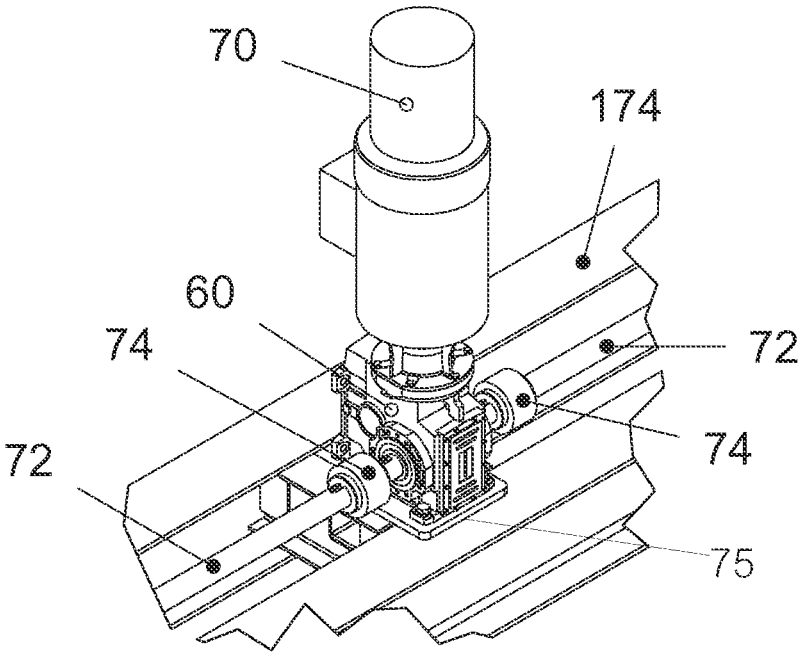
FIG. 13-B
SCALE 1 / 20
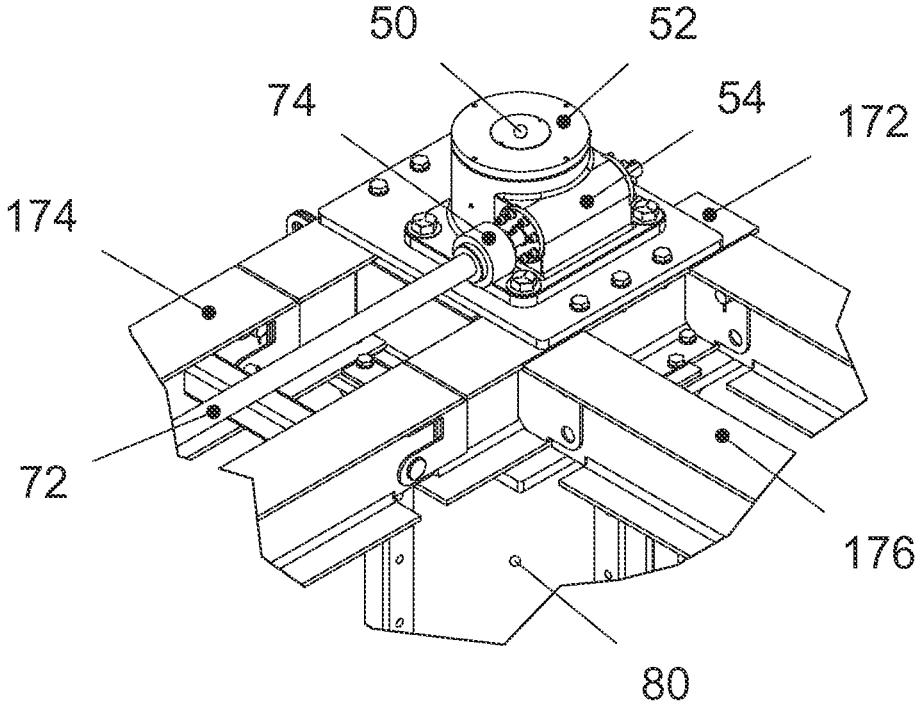
FIG. 13-C
SCALE 1 / 20

SCALE 1 / 40

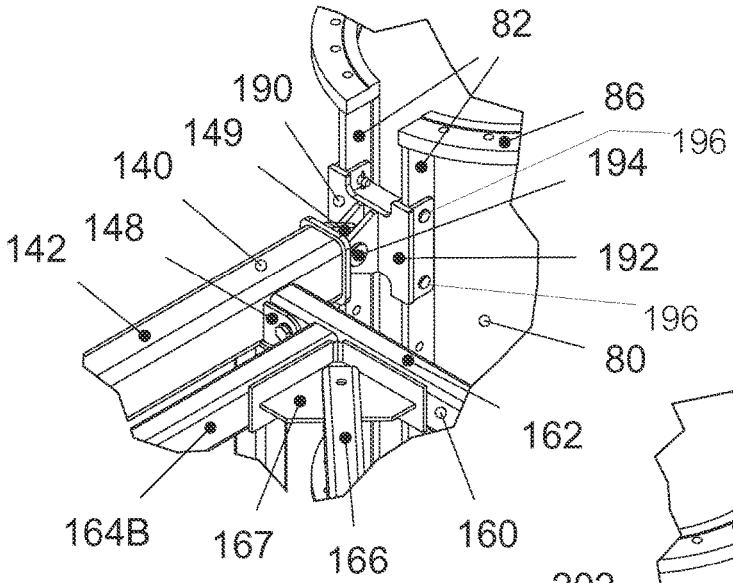
FIG. 14-A
SCALE 1 / 16
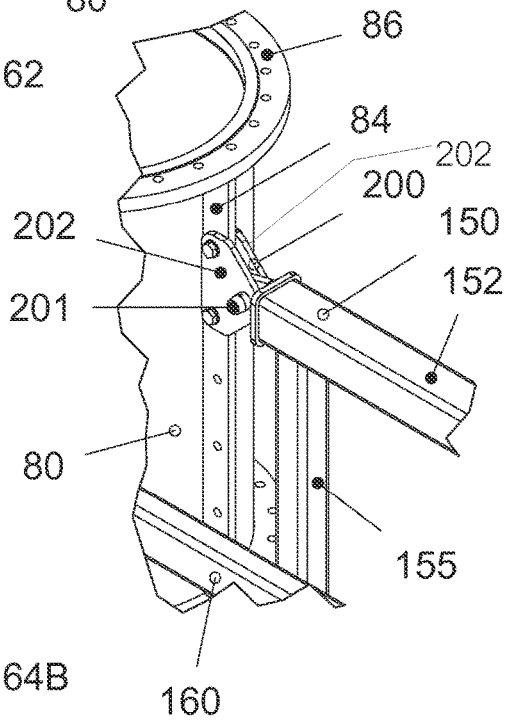
FIG. 14-B
SCALE 1 / 16
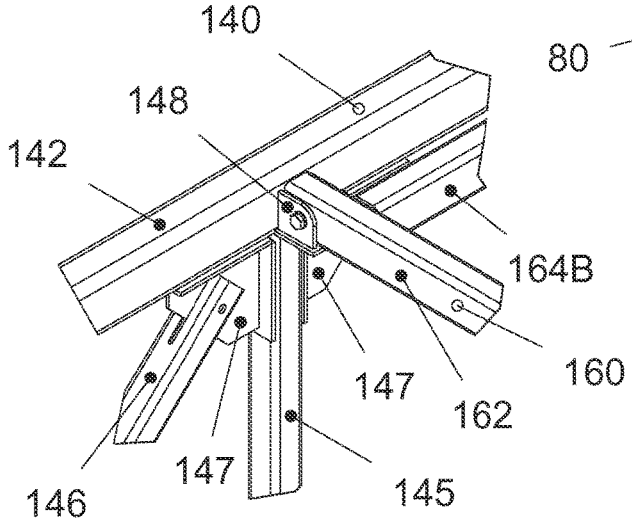
FIG. 14-C
SCALE 1 / 16

SCALE 1 / 20

SCALE 1 / 24

SCALE 1 / 24

SCALE 1 / 12

SCALE 1 / 12

SCALE 1 / 16

SCALE 1 / 32

SCALE 1 / 32

SCALE 1 / 20

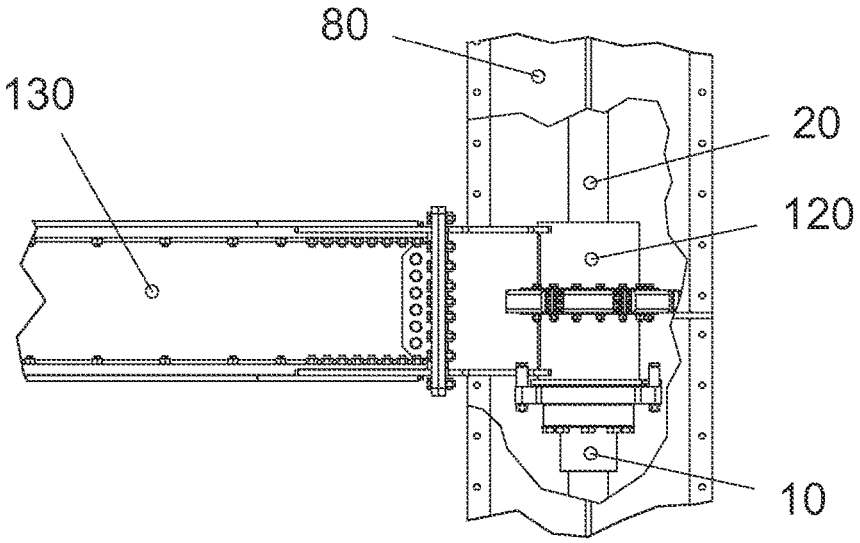
FIG. 20-A
SCALE 1 / 30
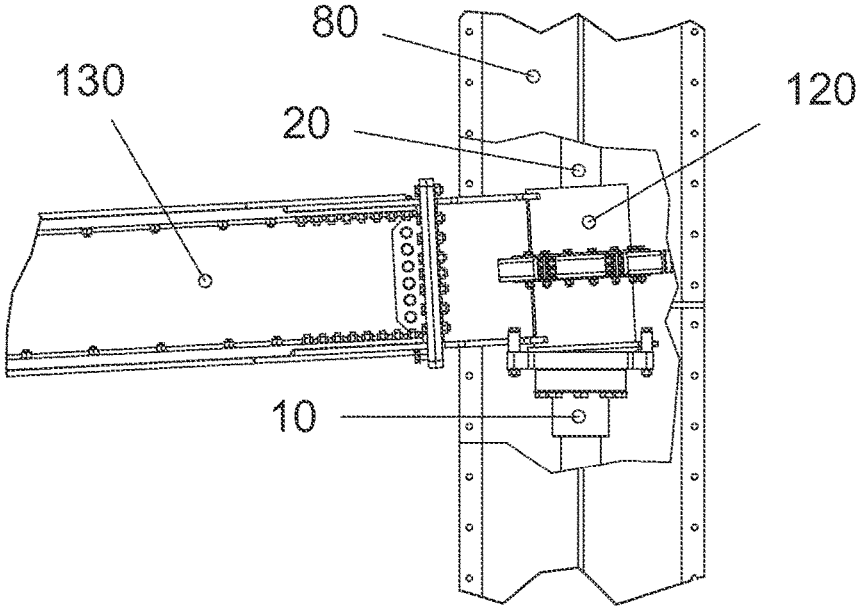
FIG. 20-B
SCALE 1 / 30

SCALE 1 / 30

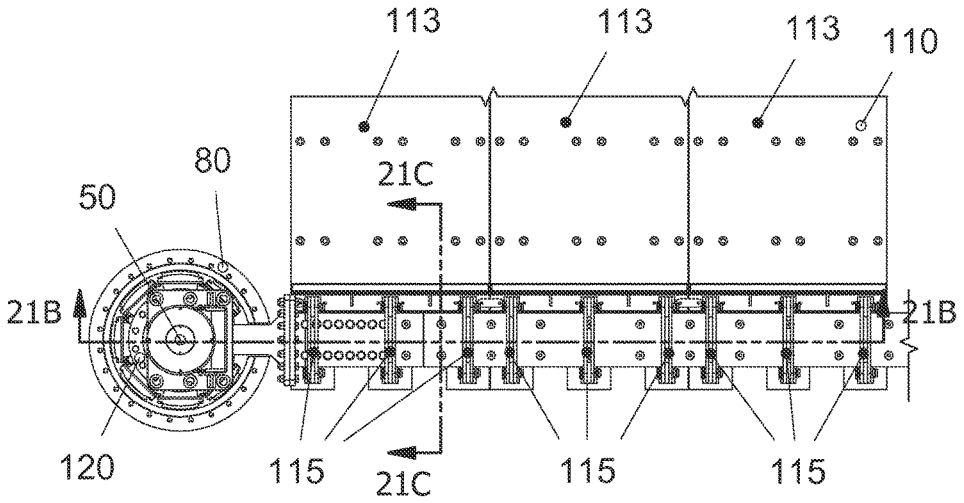
FIG. 21-A
SCALE 1 / 32

SCALE 1 / 32

SCALE 1 / 24

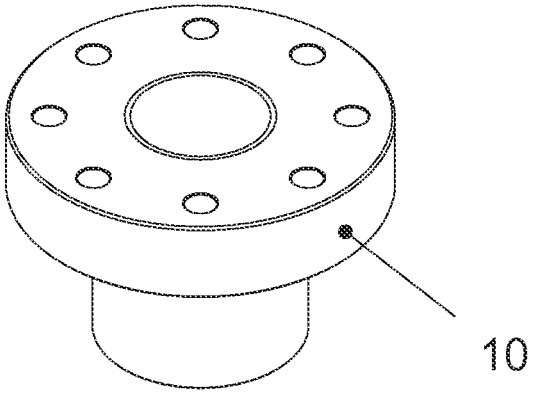
FIG. 22
SCALE 1 / 8
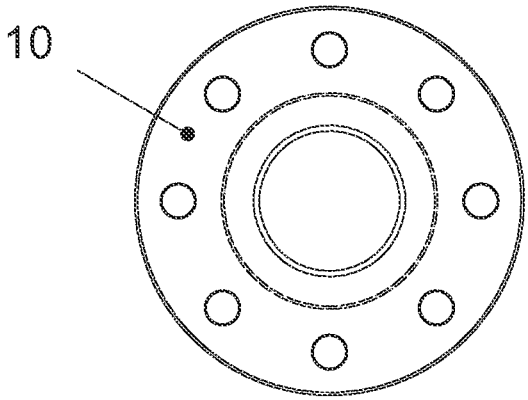
FIG. 22-A
SCALE 1 / 8
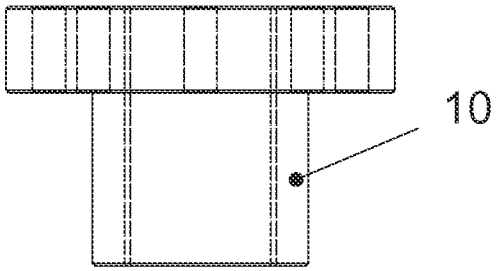
FIG. 22-B
SCALE 1 / 8

SCALE 1 / 6

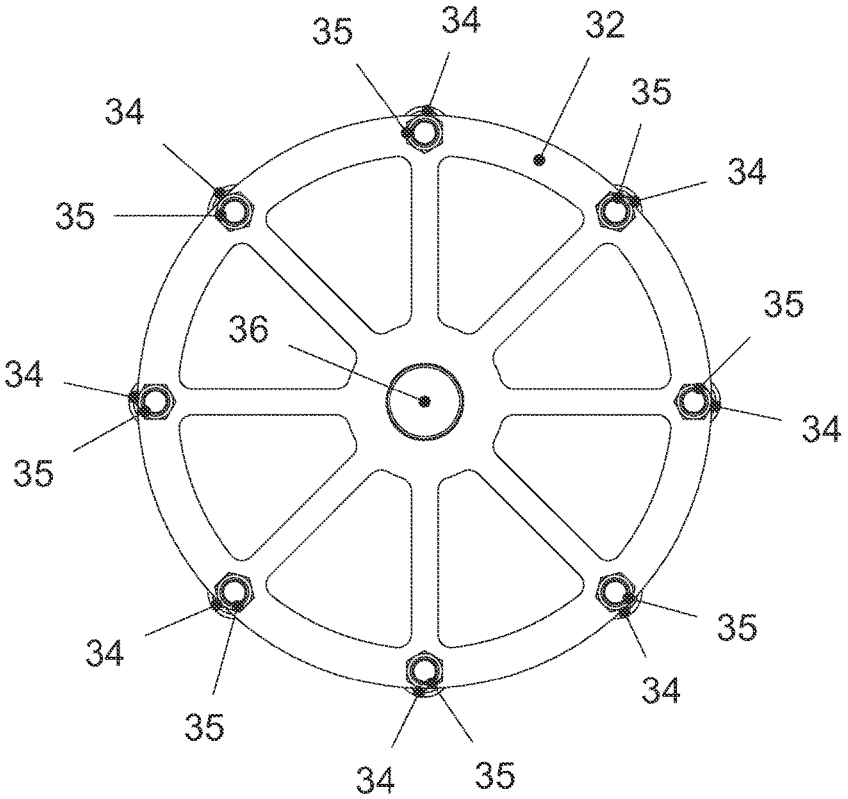
FIG. 23-A
SCALE 1 / 8
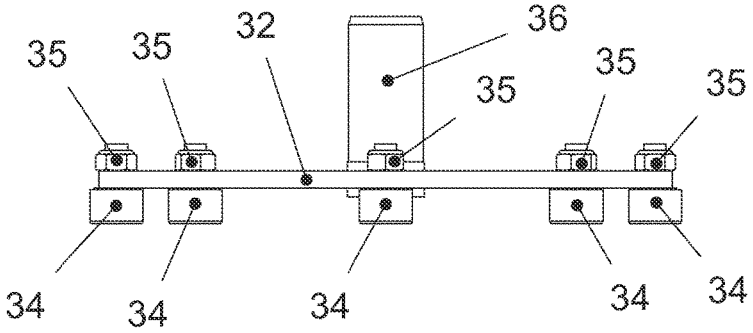
FIG. 23-B
SCALE 1 / 8

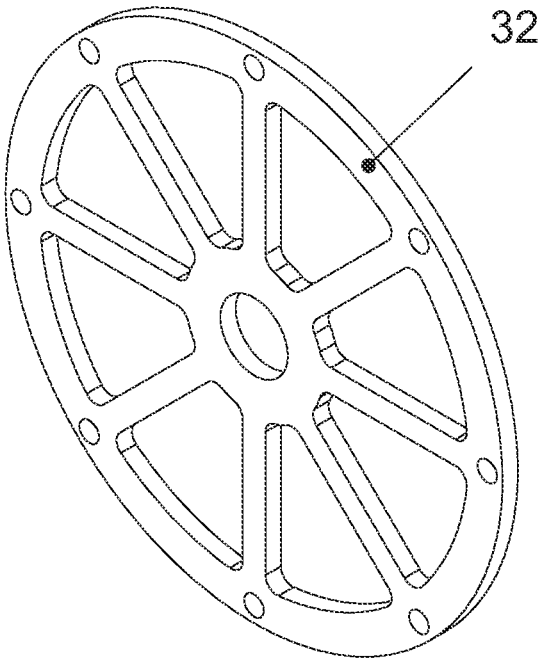
FIG. 23-C
SCALE 1 / 8
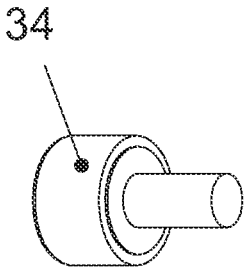
FIG. 23-D
SCALE 1 / 4
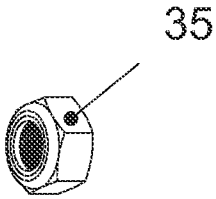
FIG. 23-E
SCALE 1 / 4
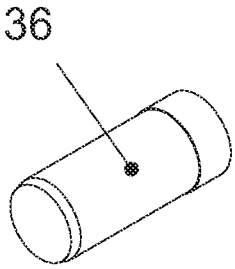
FIG. 23-F
SCALE 1 / 8

SCALE 1 / 12

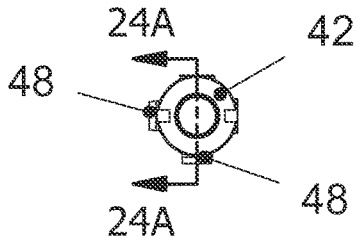
FIG. 24-B
SCALE 1 / 16
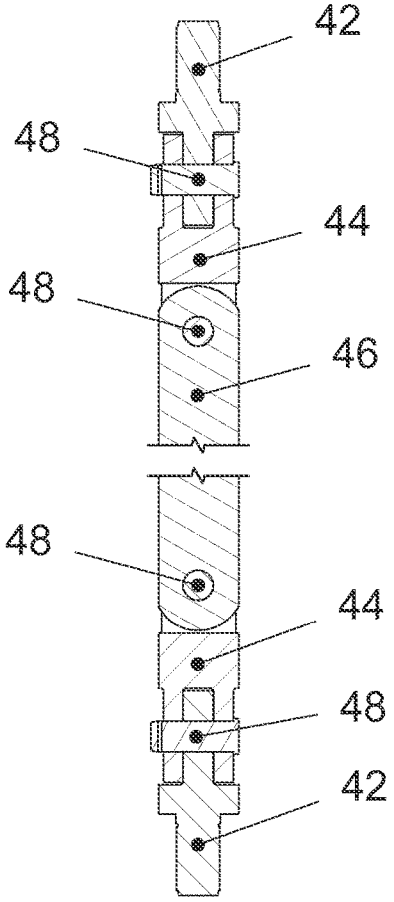
FIG. 24A
SCALE 1 / 16
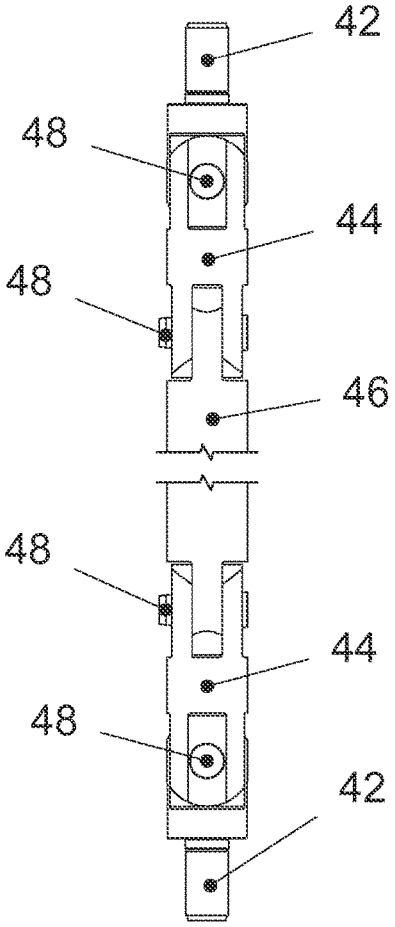
FIG. 24-C
SCALE 1 / 16

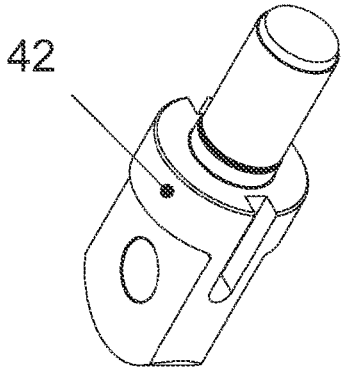
FIG. 24-D
SCALE 1 / 8
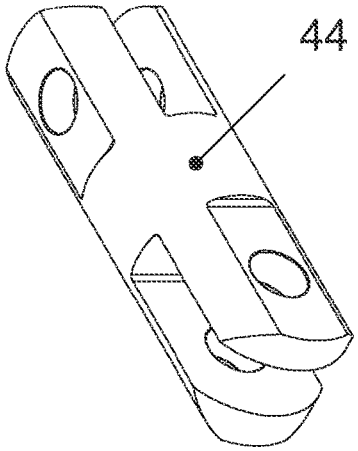
FIG. 24-E
SCALE 1 / 8
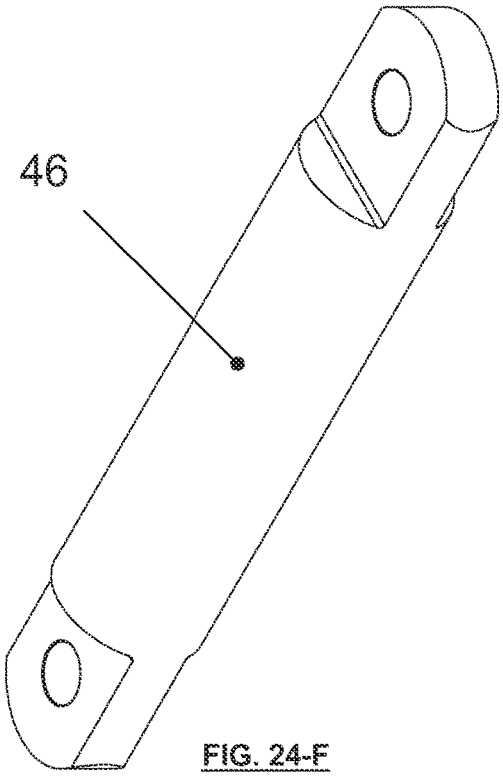
FIG. 24-F
SCALE 1 / 8
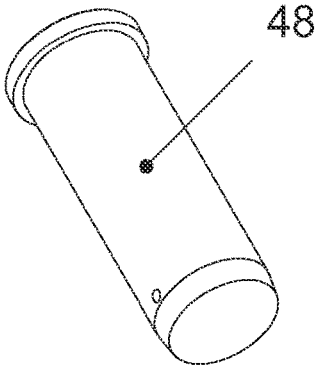
FIG. 24-G
SCALE 1 / 4

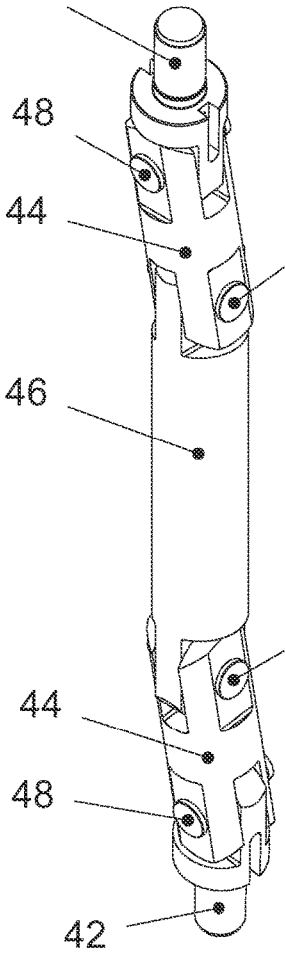
FIG. 25
SCALE 1 / 12
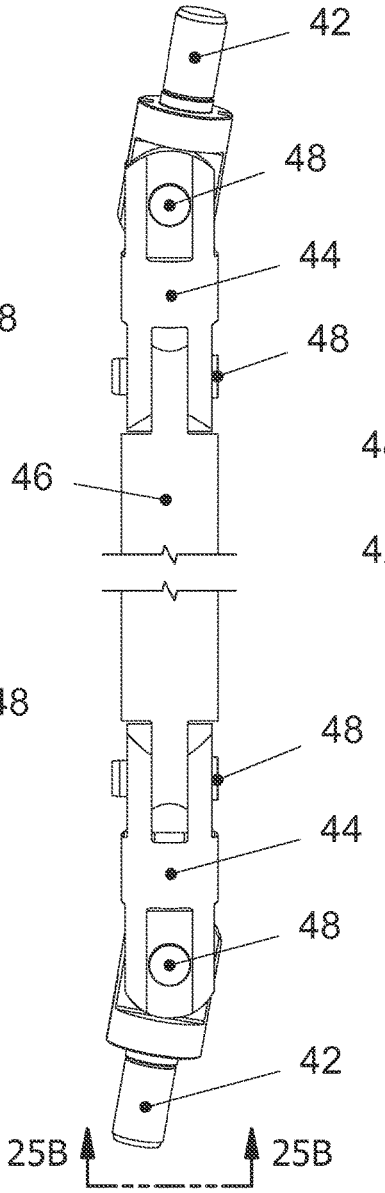
FIG. 25-A
SCALE 1 / 12
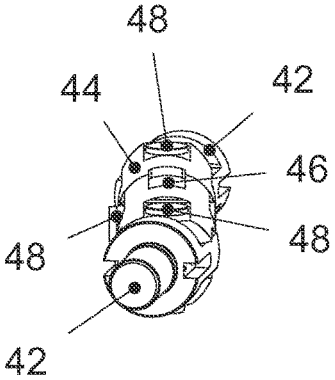
FIG. 25B
SCALE 1 / 12

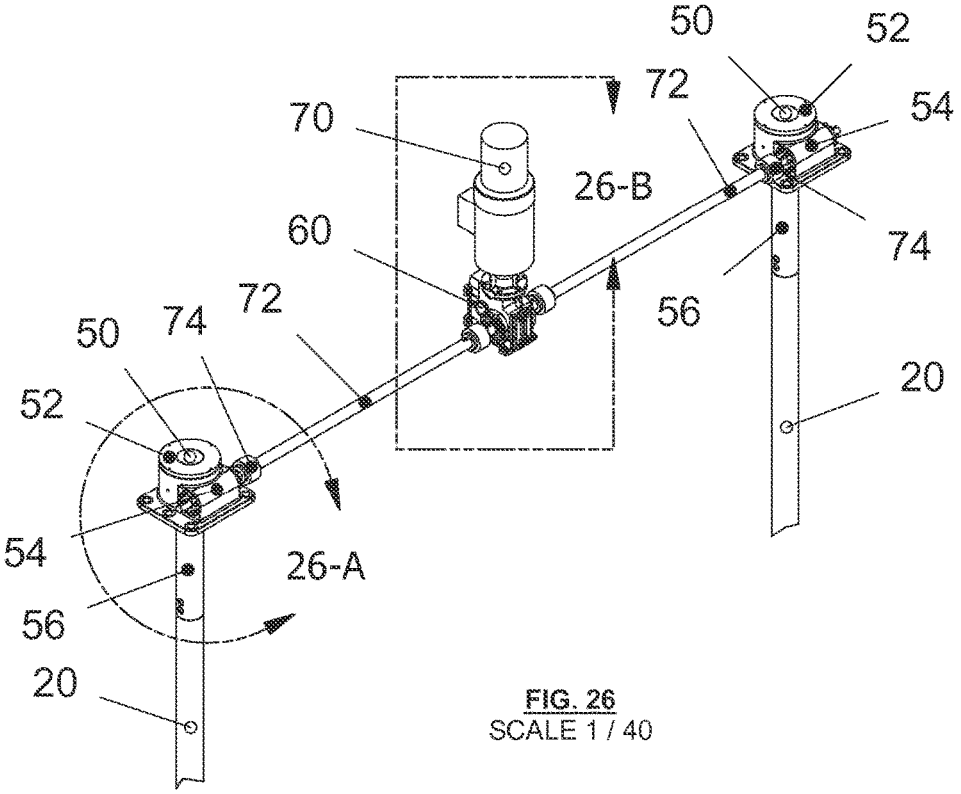
FIG. 26
SCALE 1 / 40
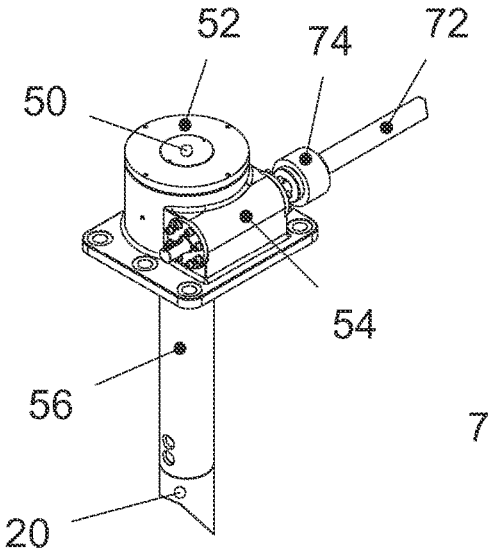
FIG. 26-A
SCALE 1 / 20
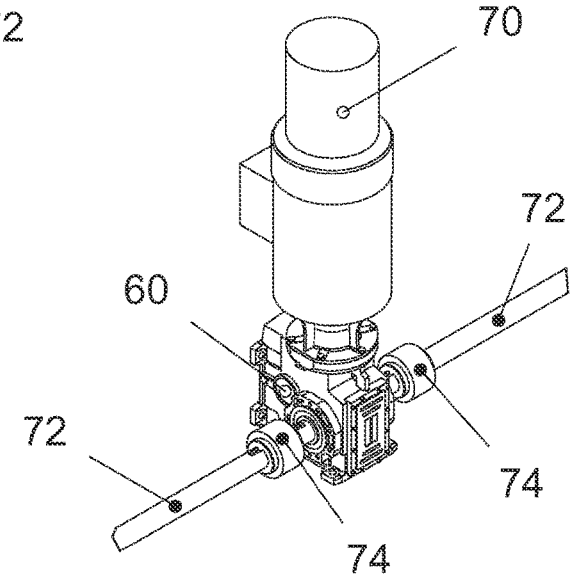
FIG. 26-B
SCALE 1 / 20

SCALE 1 / 16

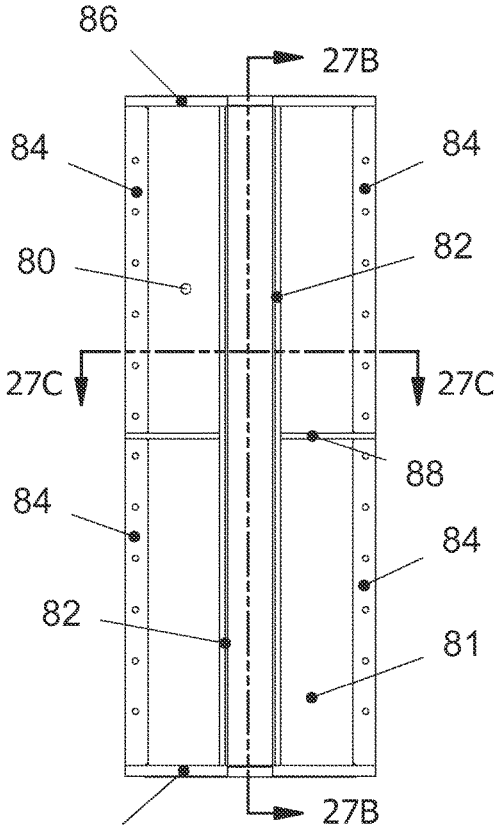
FIG. 27-A
SCALE 1 / 24
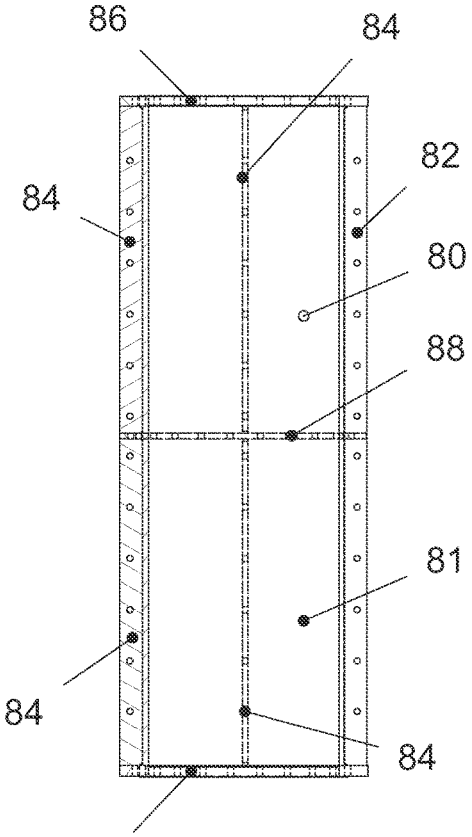
FIG. 27B
SCALE 1 / 24
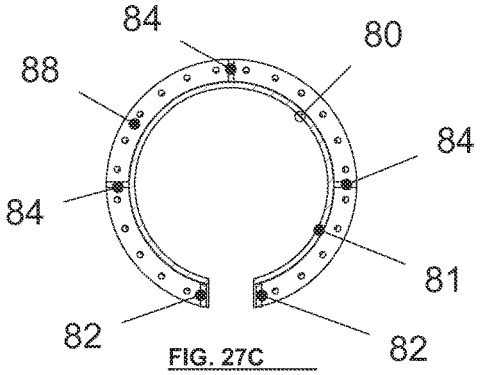
FIG. 27C
SCALE 1 / 24

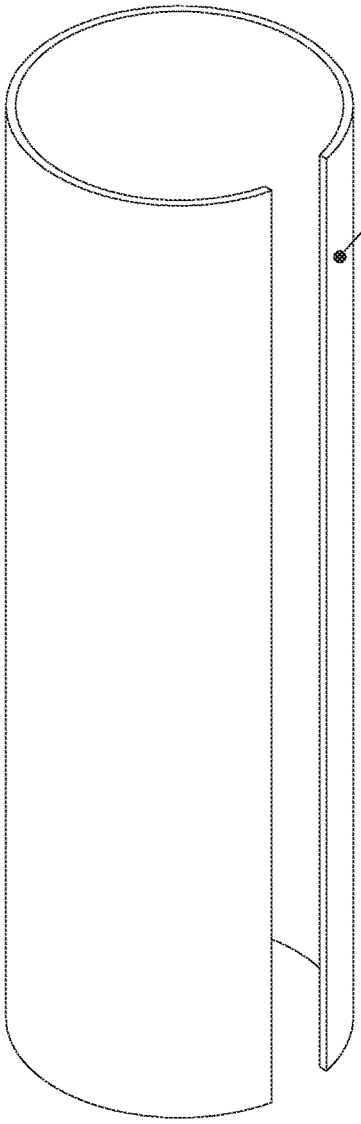
FIG. 27-D
SCALE 1 / 16
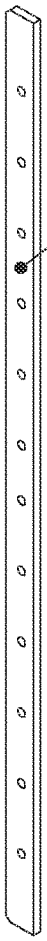
FIG. 27-E
SCALE 1 / 16
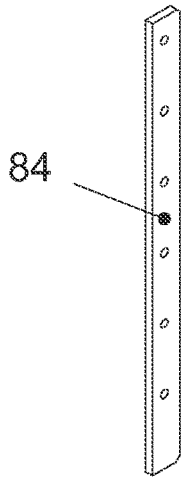
FIG. 27-F
SCALE 1 / 16

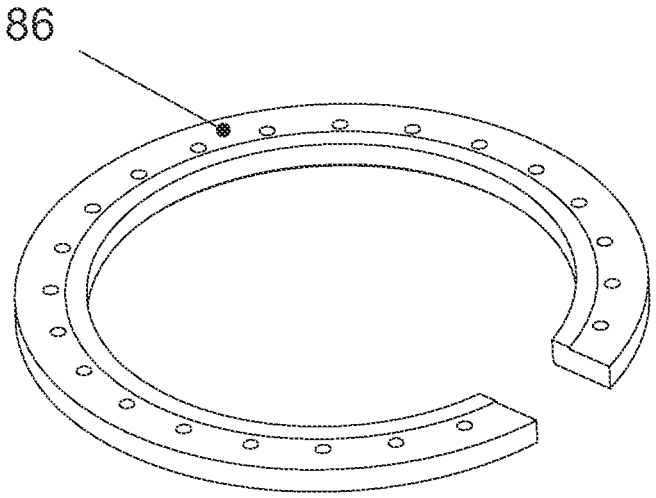
FIG. 27-G
SCALE 1 / 12
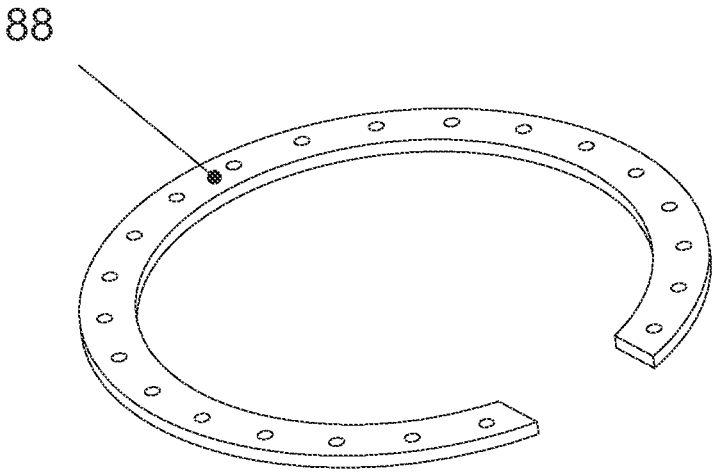
FIG. 27-H
SCALE 1 / 12

SCALE 1 / 20

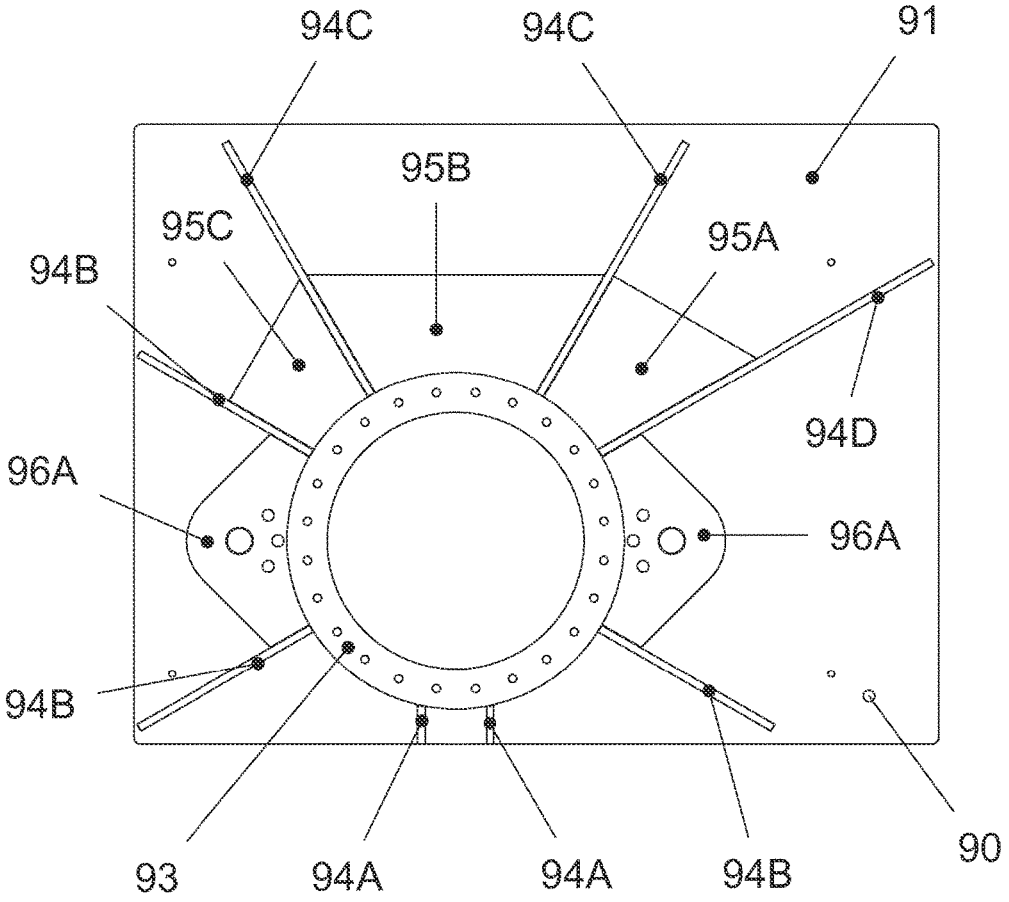
FIG. 28-A
SCALE 1 / 20

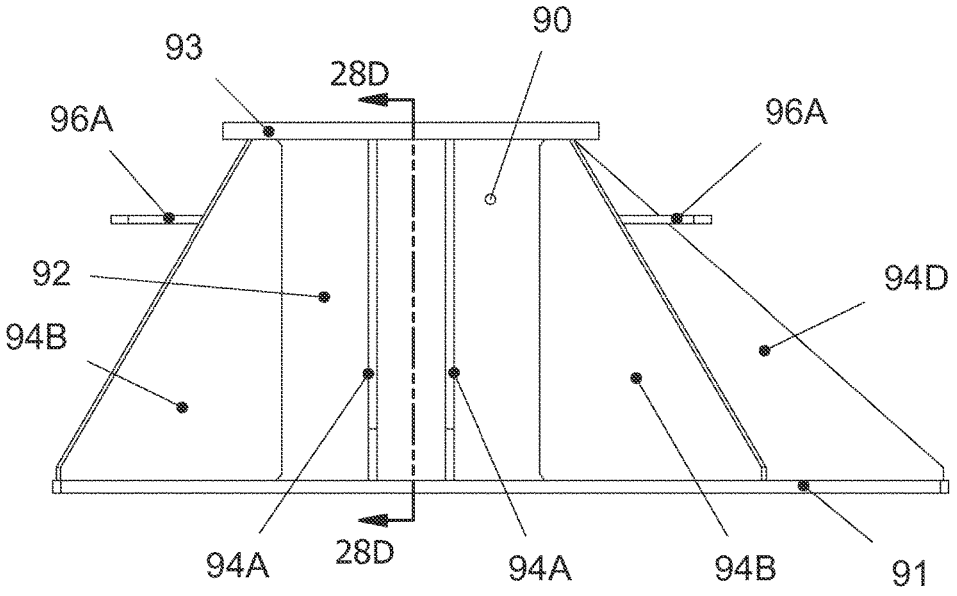
FIG. 28-B
SCALE 1 / 16
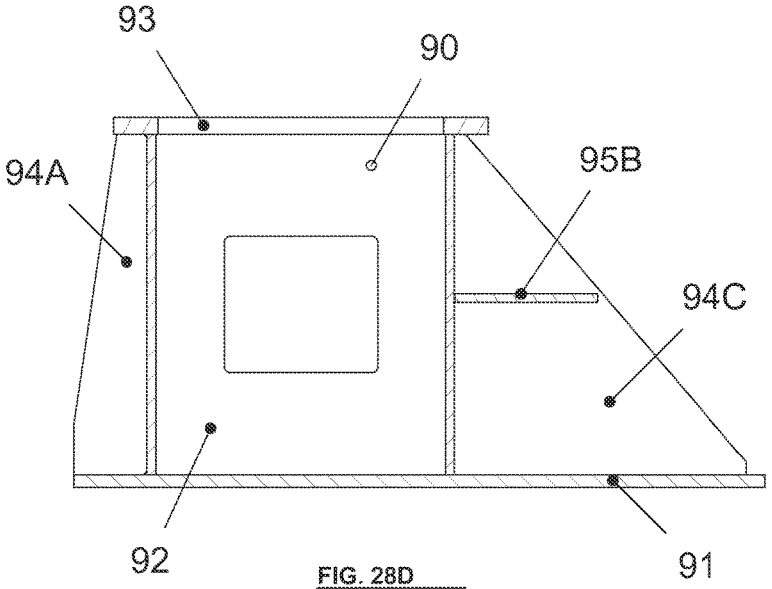
FIG. 28D
SCALE 1 / 16

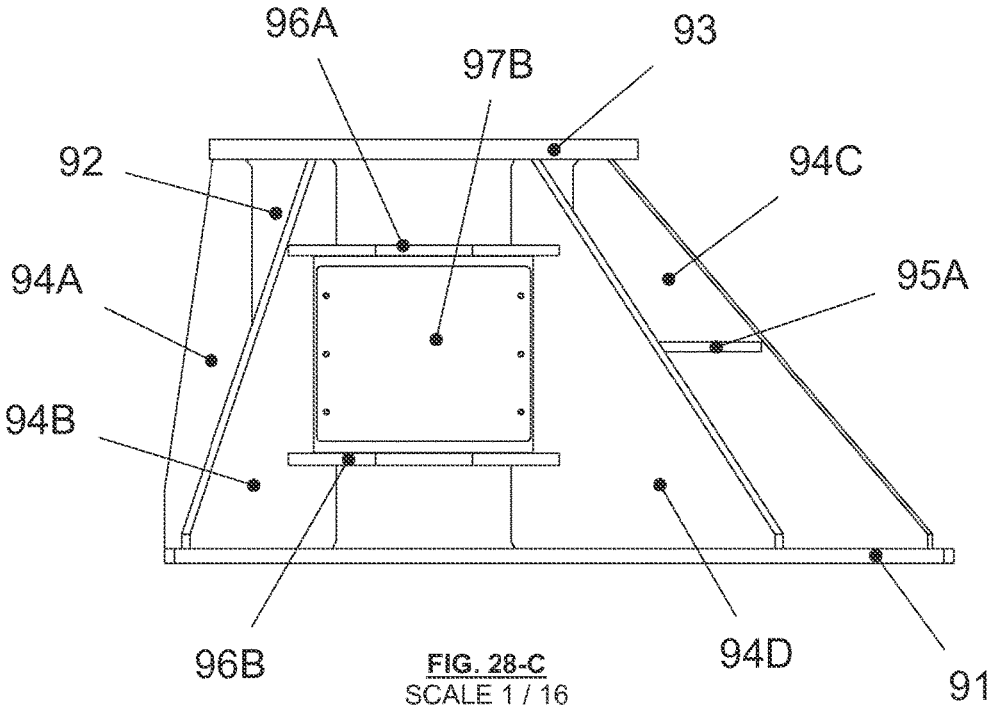
FIG. 28-C
SCALE 1 / 16

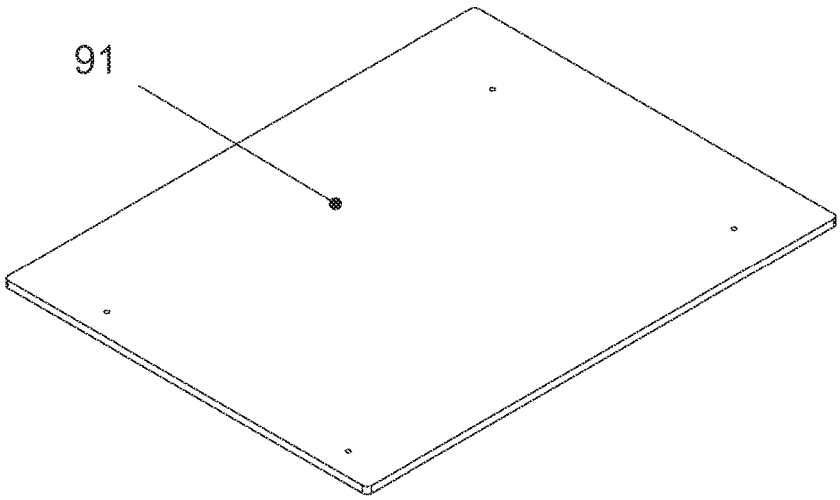
FIG. 28-E
SCALE 1 / 24
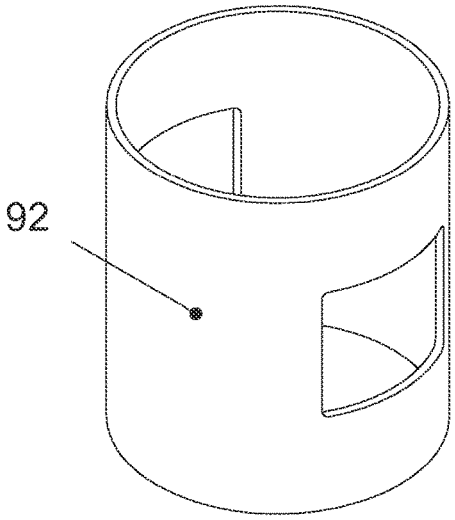
FIG. 28-F
SCALE 1 / 16
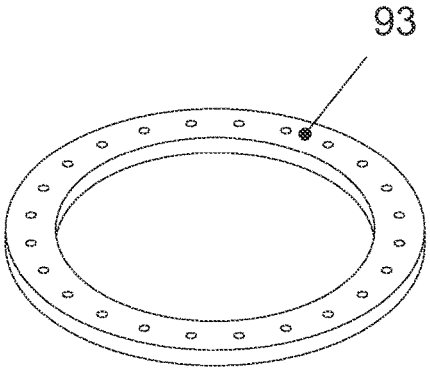
FIG. 28-G
SCALE 1 / 16

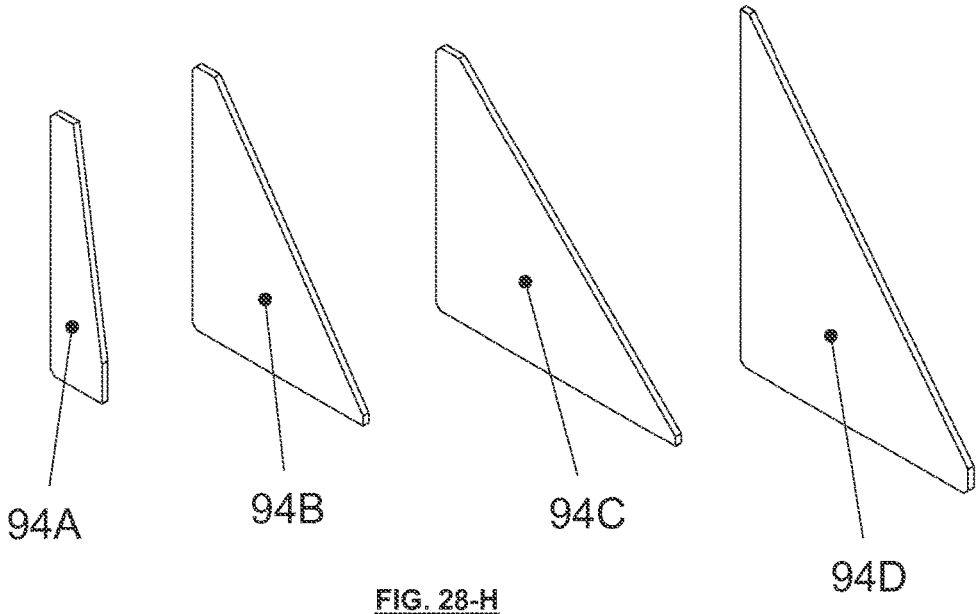
FIG. 28-H
SCALE 1 / 20
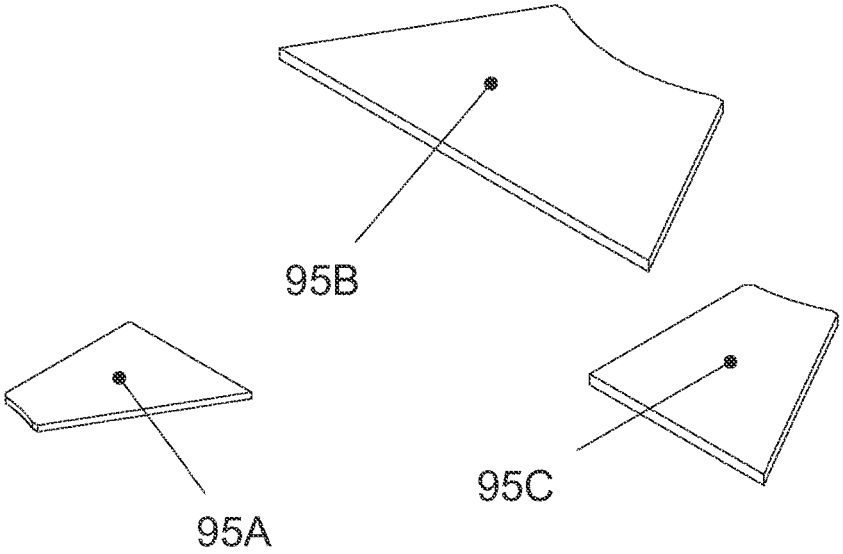
FIG. 28-I
SCALE 1 / 12

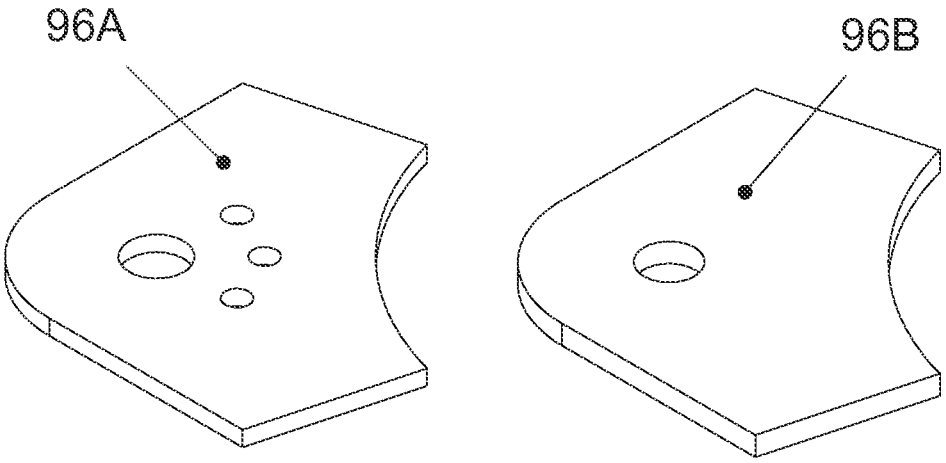
FIG. 28-J
SCALE 1 / 8
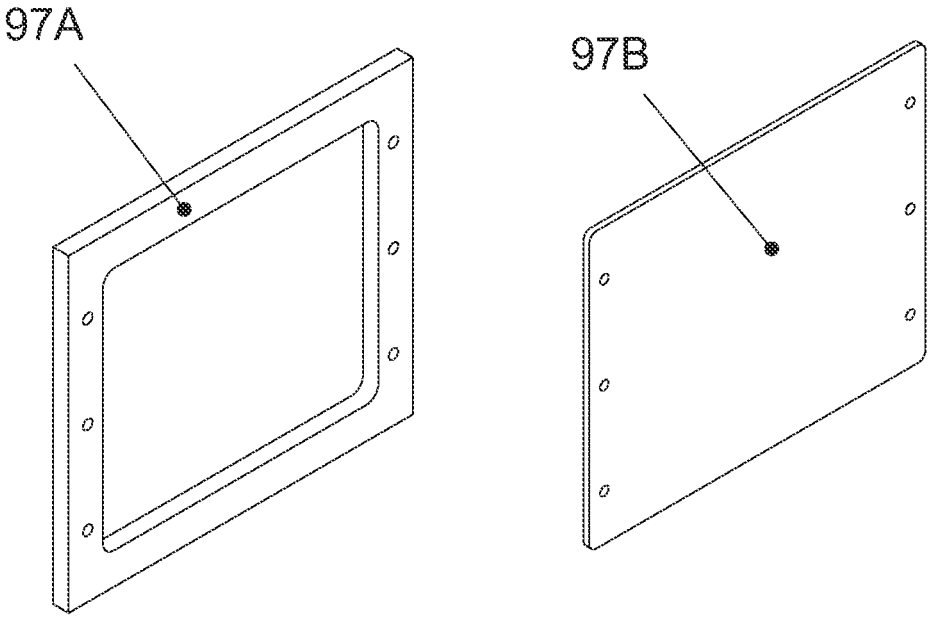
FIG. 28-K
SCALE 1 / 8

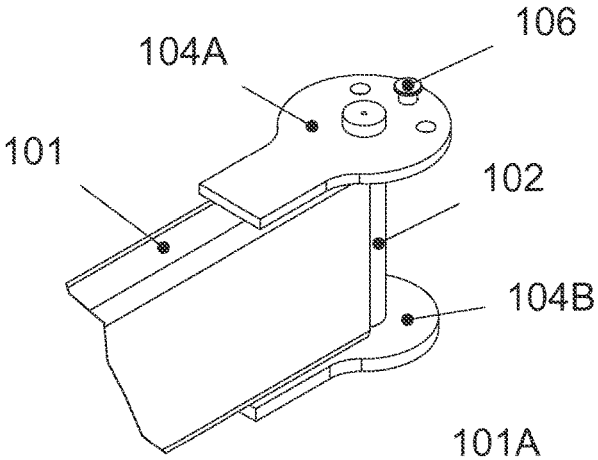
FIG. 29-B
SCALE 1 / 12
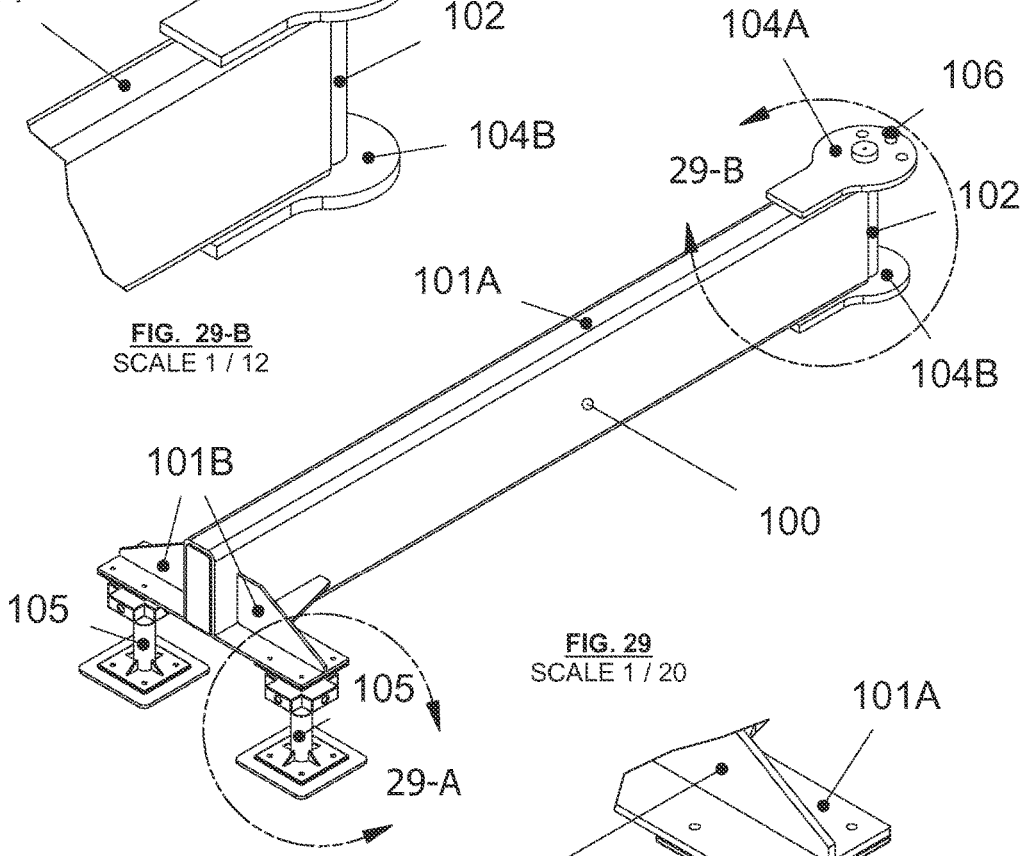
FIG. 29
SCALE 1 / 20
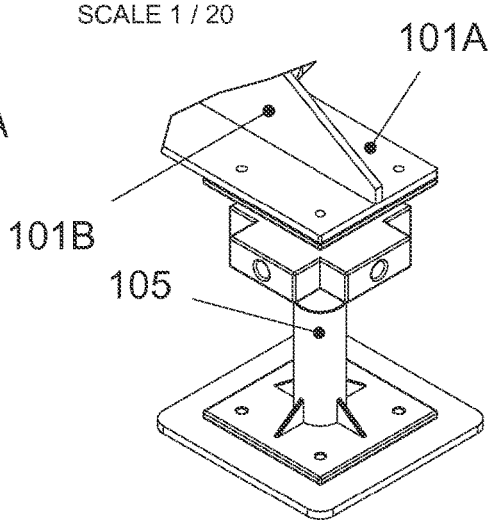
FIG. 29-A
SCALE 1 / 8

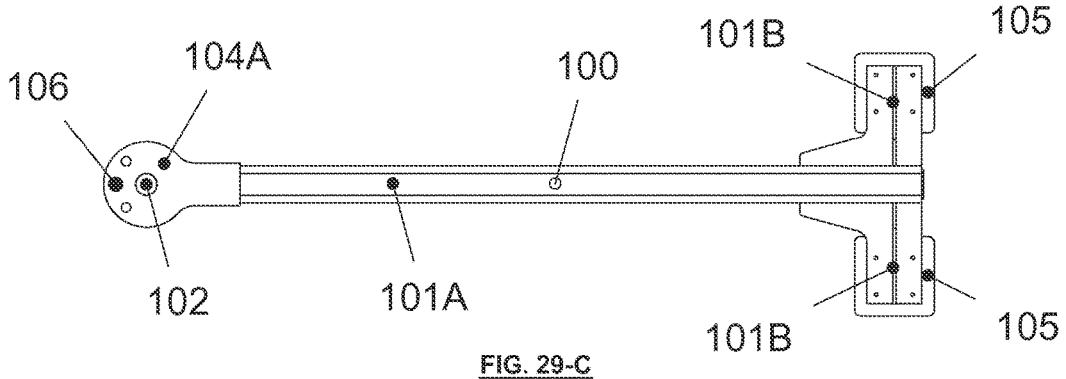
FIG. 29-C
SCALE 1 / 24
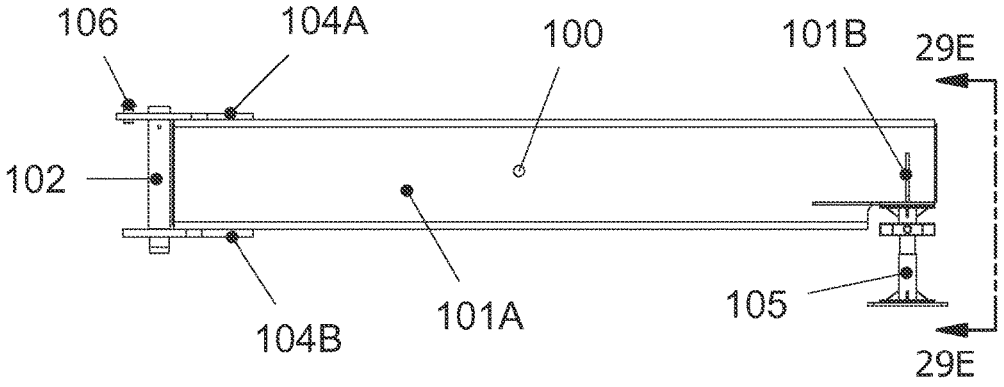
FIG. 29-D
SCALE 1 / 24

SCALE 1 / 8

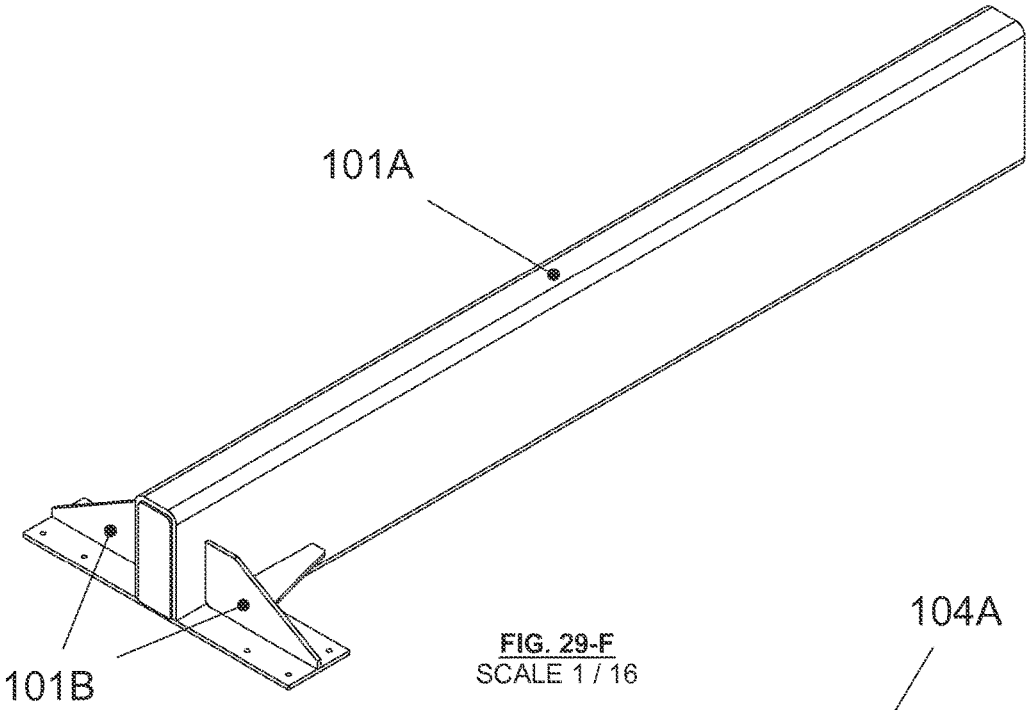
FIG. 29-F
SCALE 1 / 16
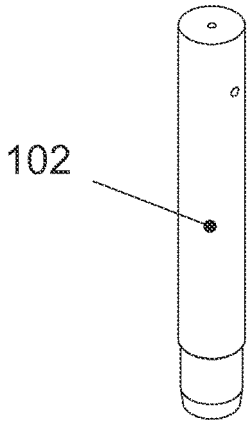
FIG. 29-G
SCALE 1 / 8
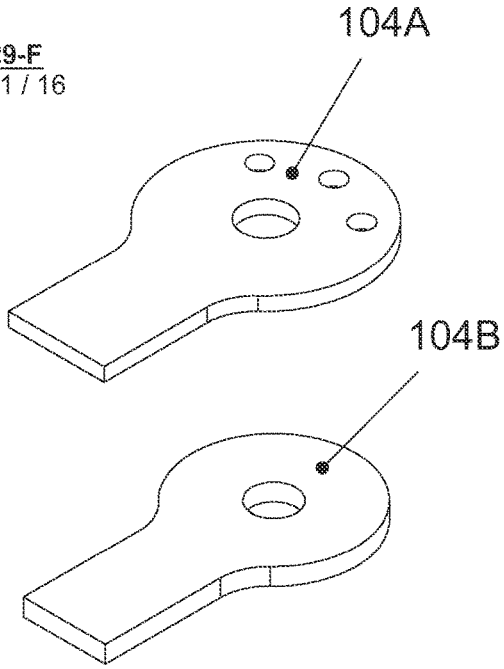
FIG. 29-H
SCALE 1 / 8

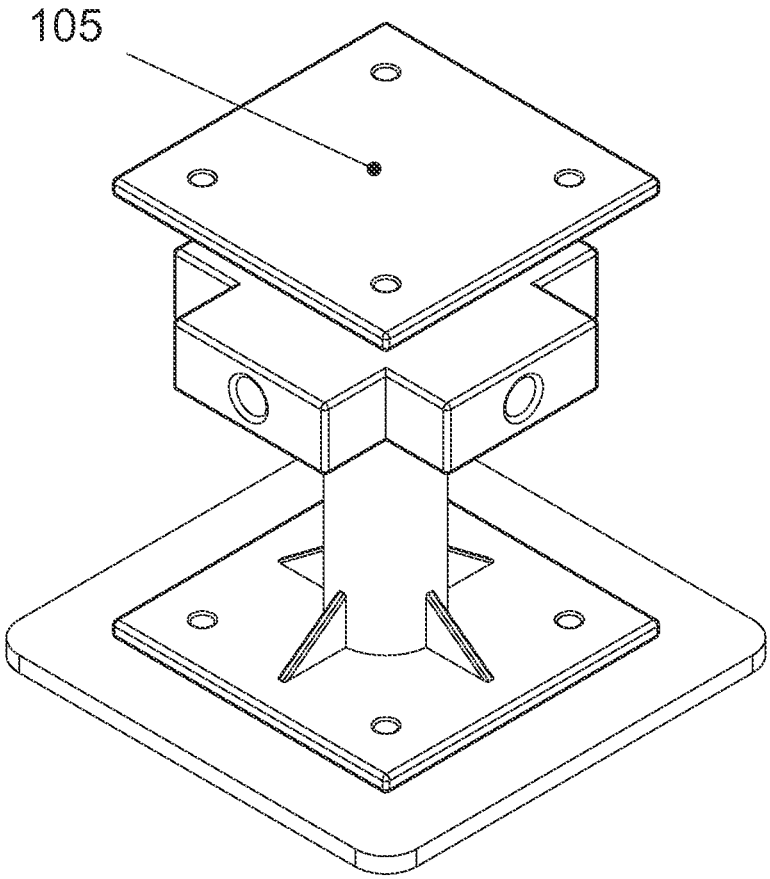
FIG. 29-I
SCALE 1 / 4
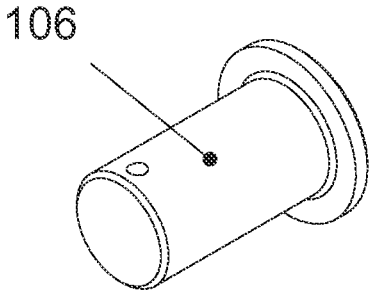
FIG. 29-J
SCALE 1 / 2

SCALE 1 / 32

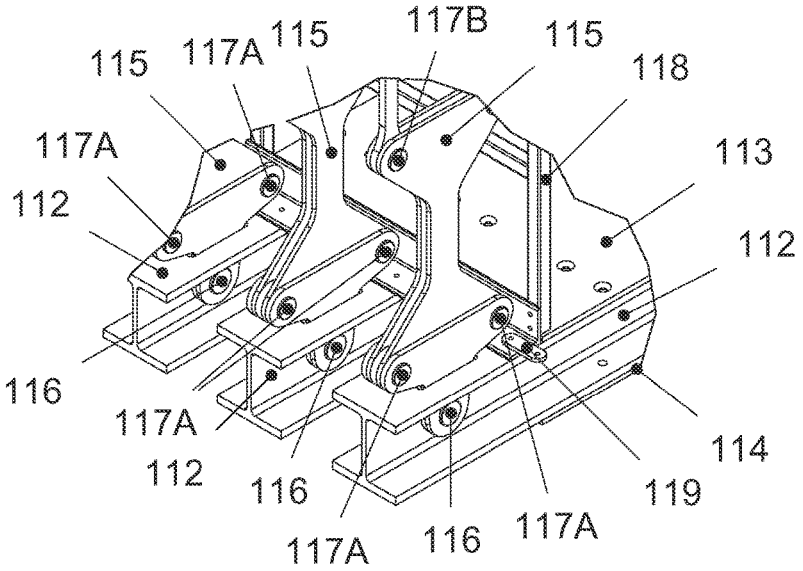
FIG. 30-A
SCALE 1 / 16
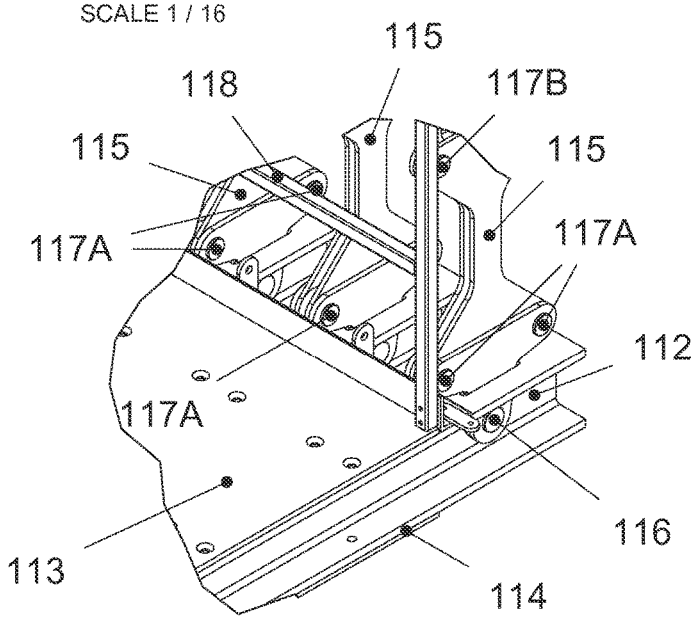
FIG. 30-B
SCALE 1 / 16

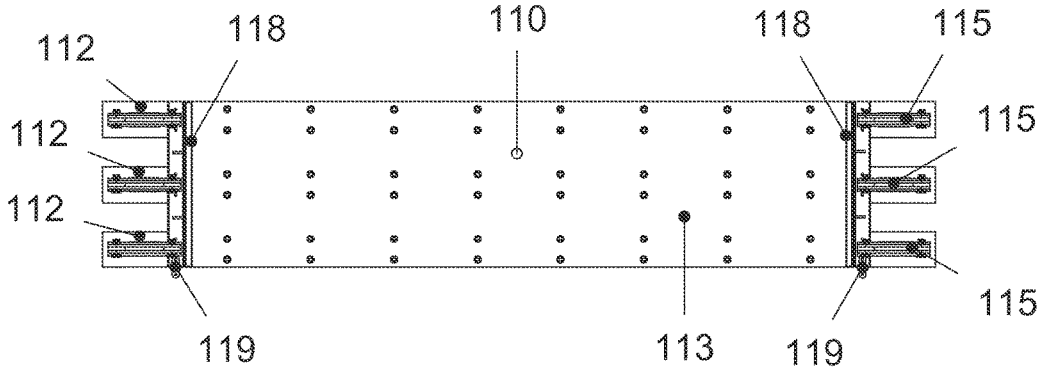
FIG. 30-C
SCALE 1 / 40
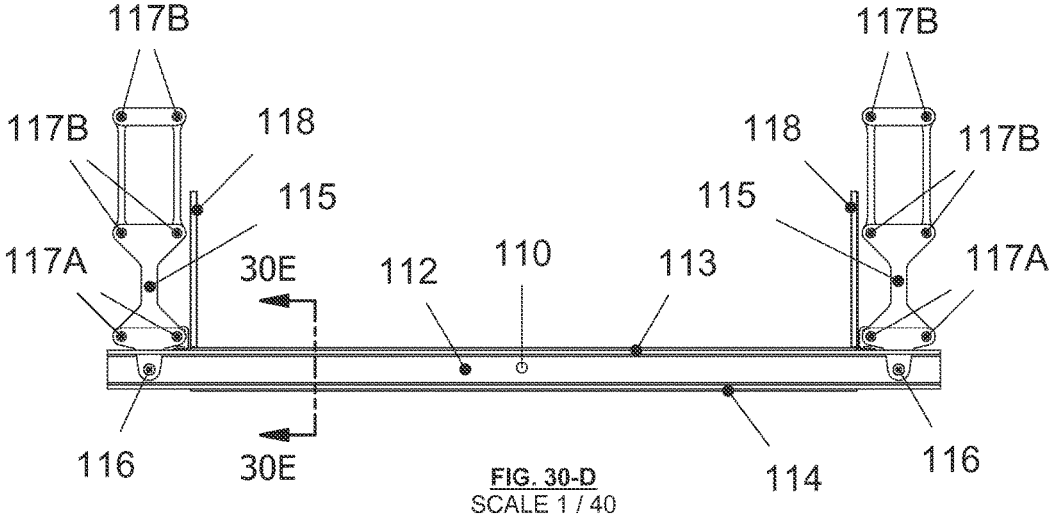
FIG. 30-D
SCALE 1 / 40

SCALE 1 / 8

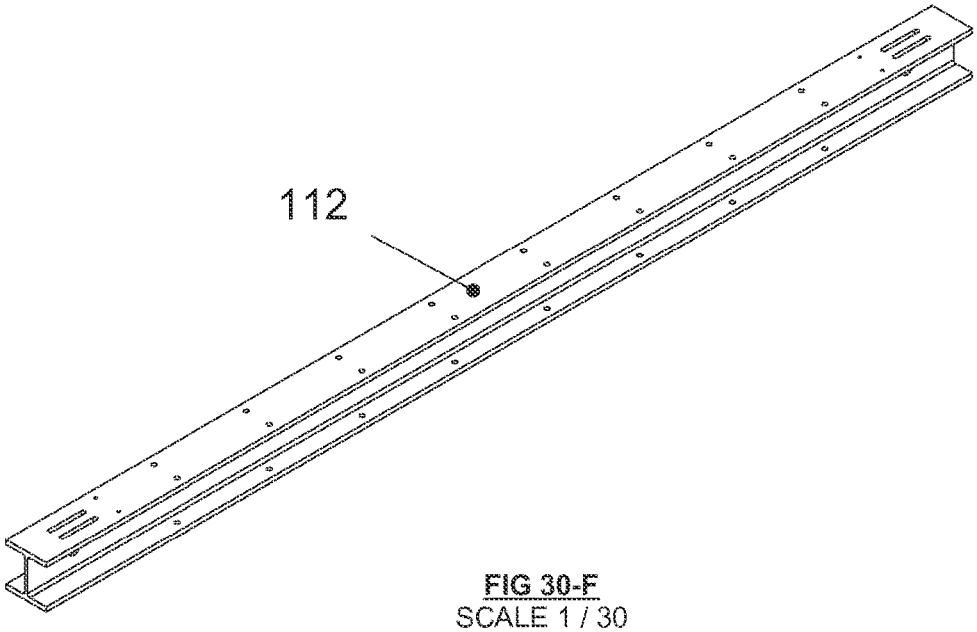
FIG 30-F
SCALE 1 / 30
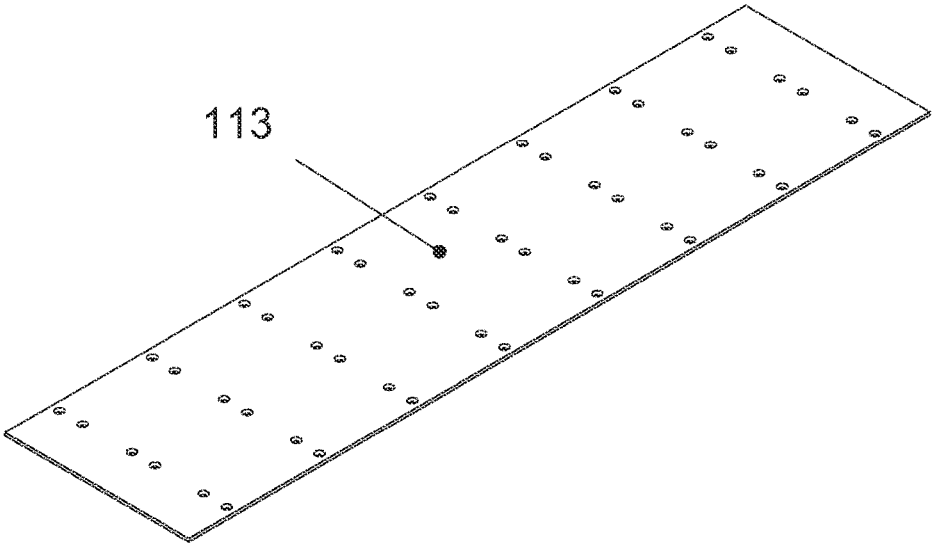
FIG. 30-G
SCALE 1 / 30

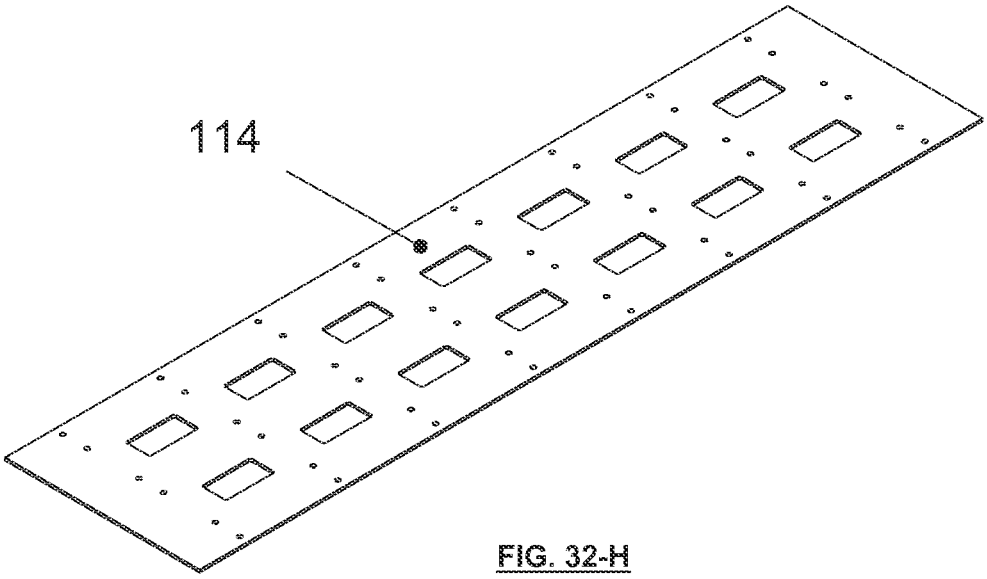
FIG. 32-H
SCALE 1 / 30
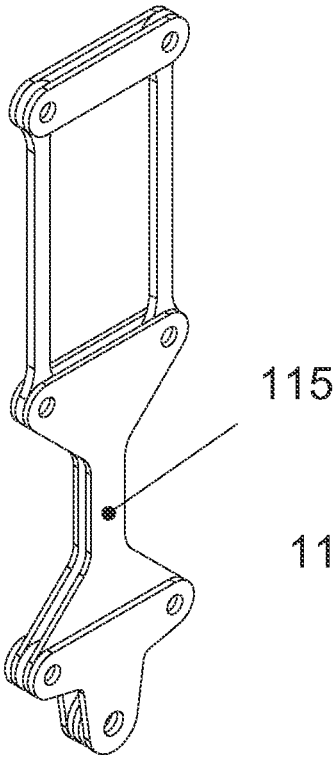
FIG. 30-I
SCALE 1 / 16
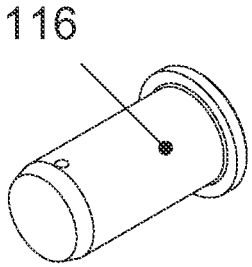
FIG. 30-J
SCALE 1 / 4
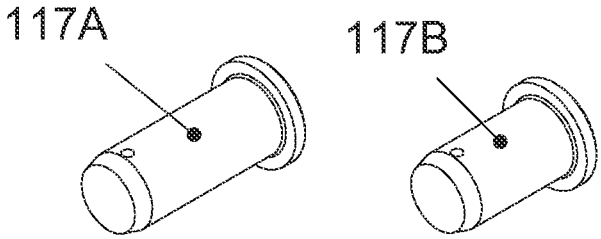
FIG. 30-K
SCALE 1 / 4

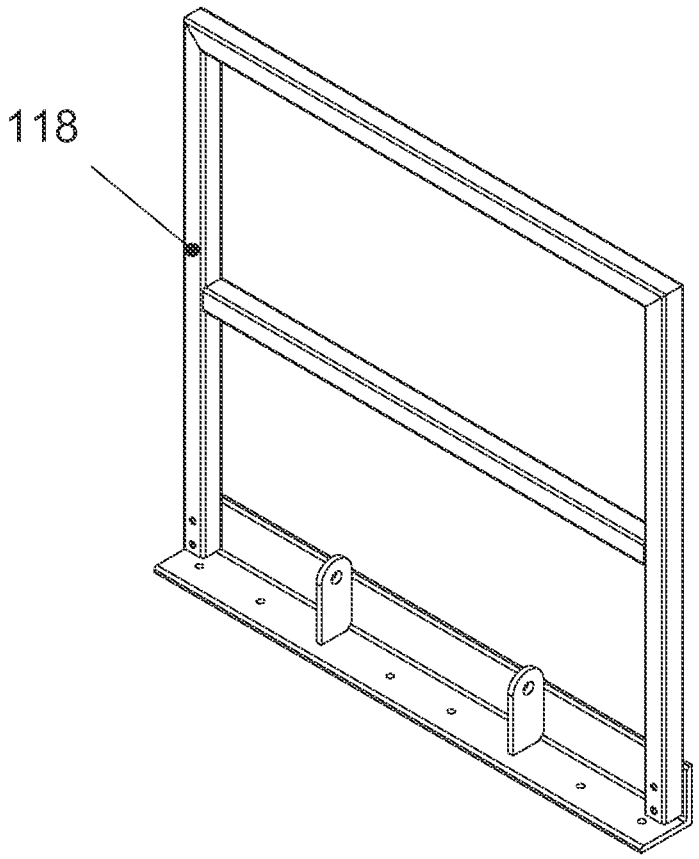
FIG. 30-L
SCALE 1 / 12
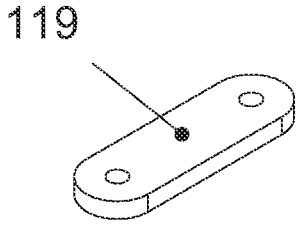
FIG. 30-M
SCALE 1 / 4

SCALE 1 / 8

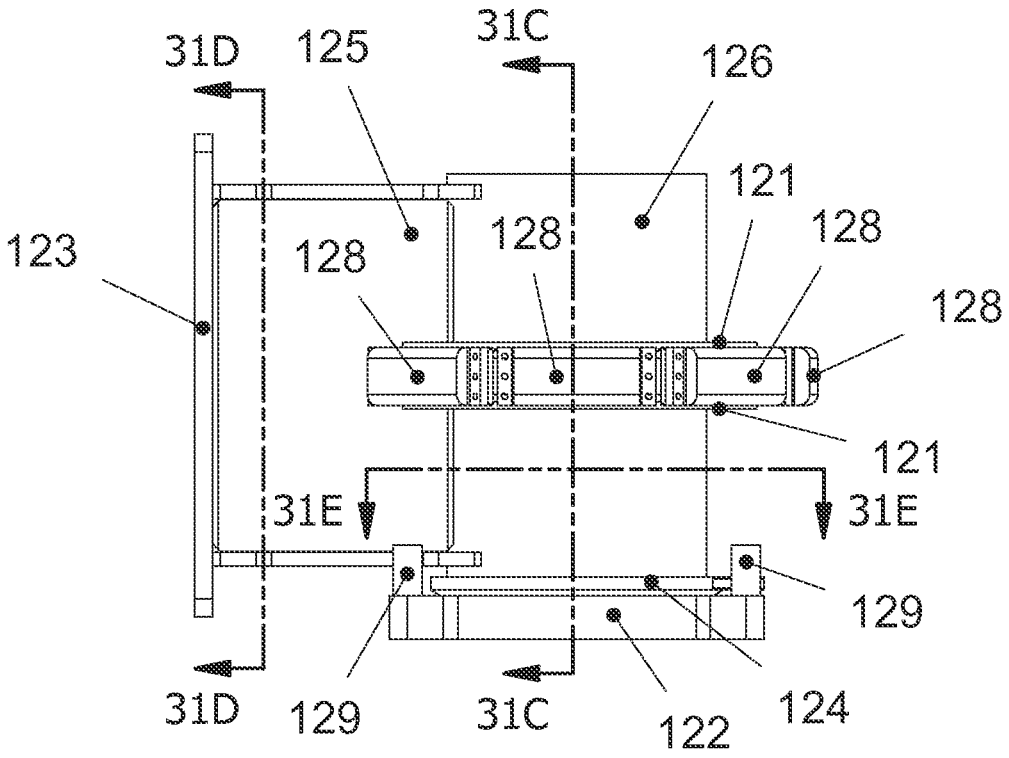
FIG. 31-B
SCALE 1 / 12
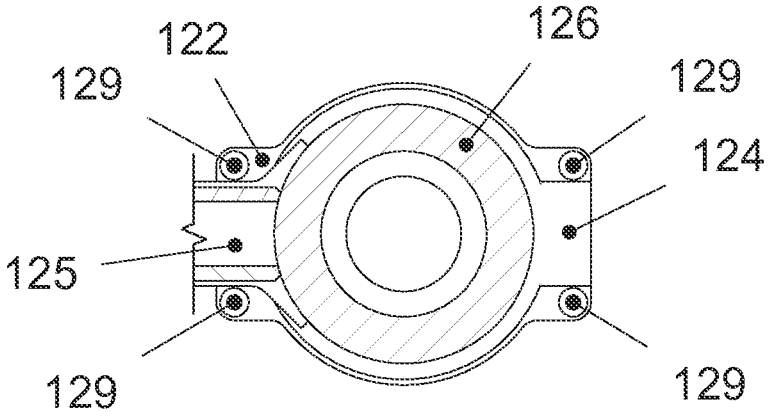
FIG. 31E
SCALE 1 / 12

SCALE 1 / 12

SCALE 1 / 12

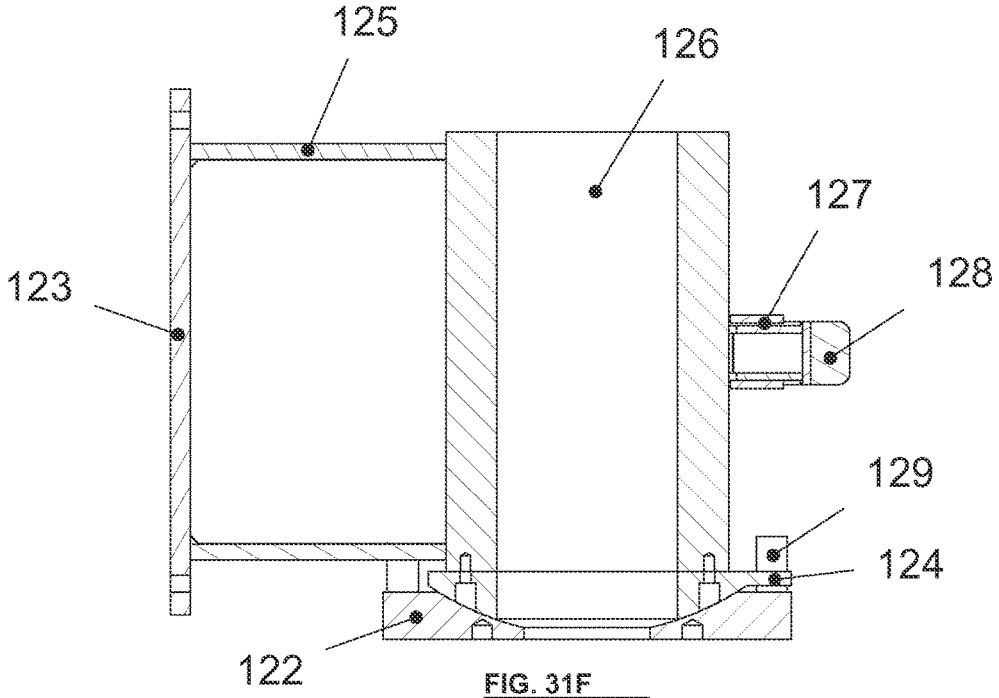
FIG. 31F
SCALE 1 / 10
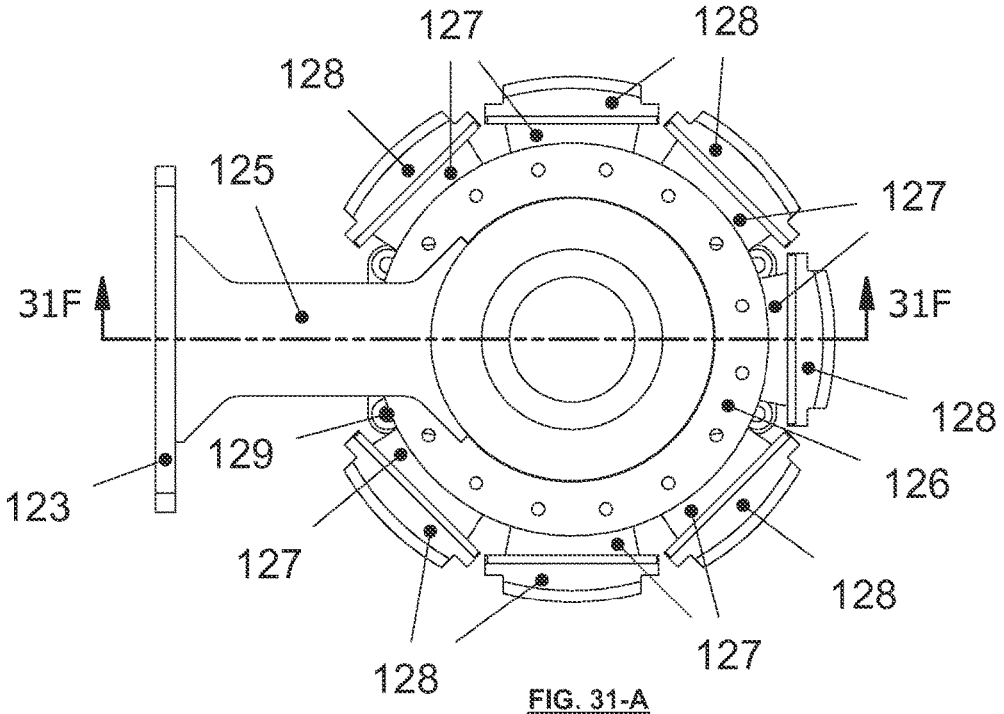
FIG. 31-A
SCALE 1 / 10

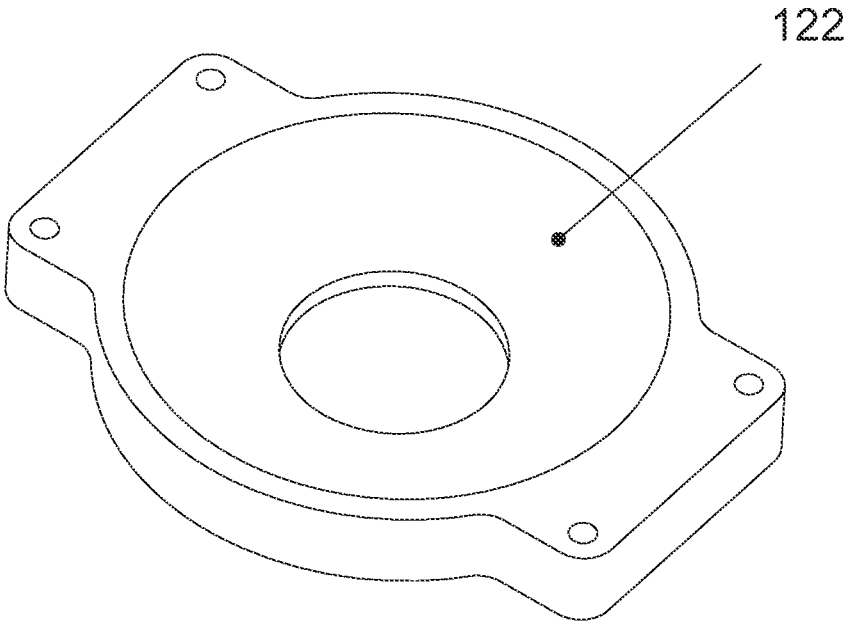
FIG. 31-G
SCALE 1 / 6
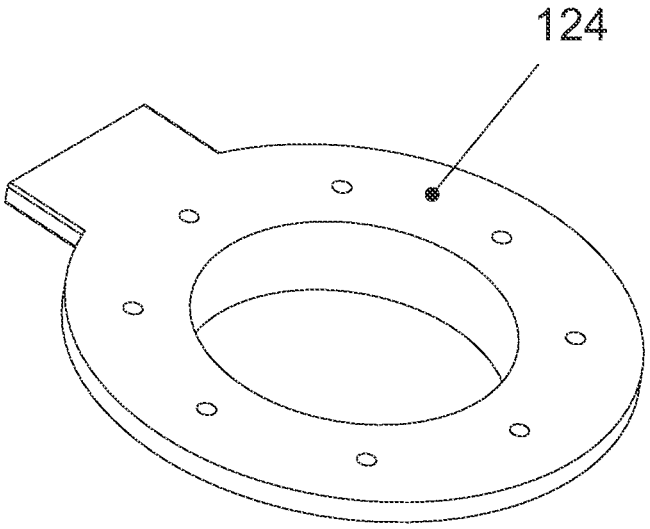
FIGL. 31-H
SCALE 1 / 6

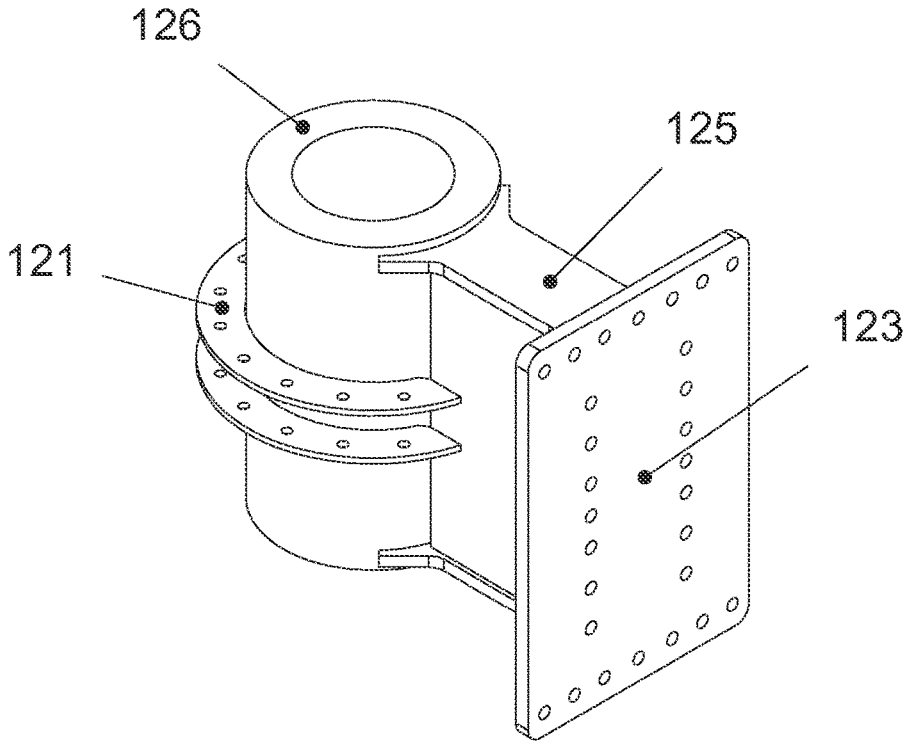
FIG. 31-I
SCALE 1 / 12
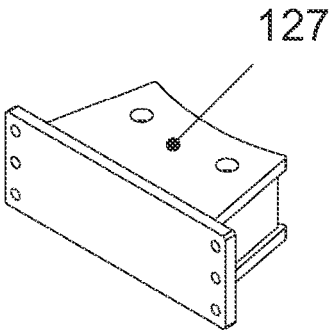
FIG. 31-J
SCALE 1 / 6
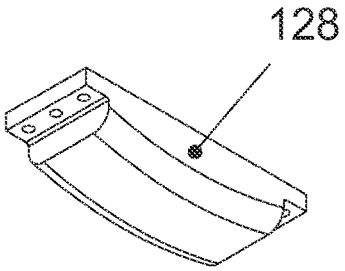
FIG. 31-K
SCALE 1 / 6
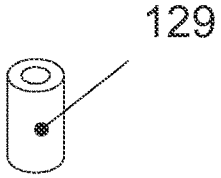
FIG. 31-L
SCALE 1 / 6

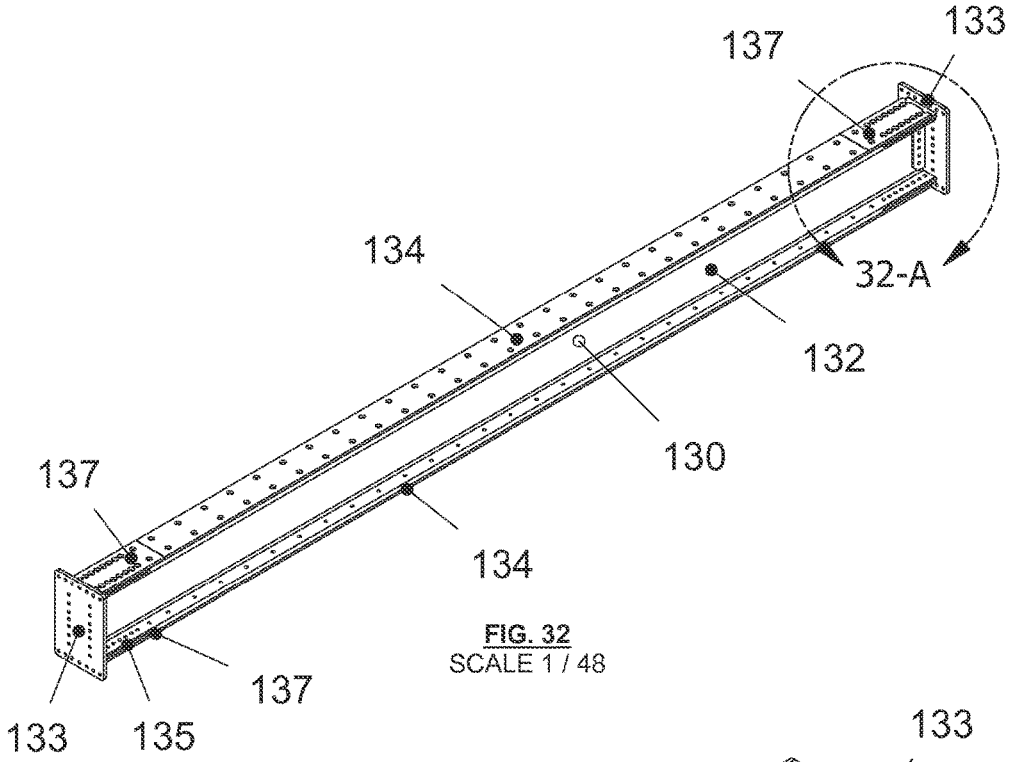
FIG. 32
SCALE 1 / 48
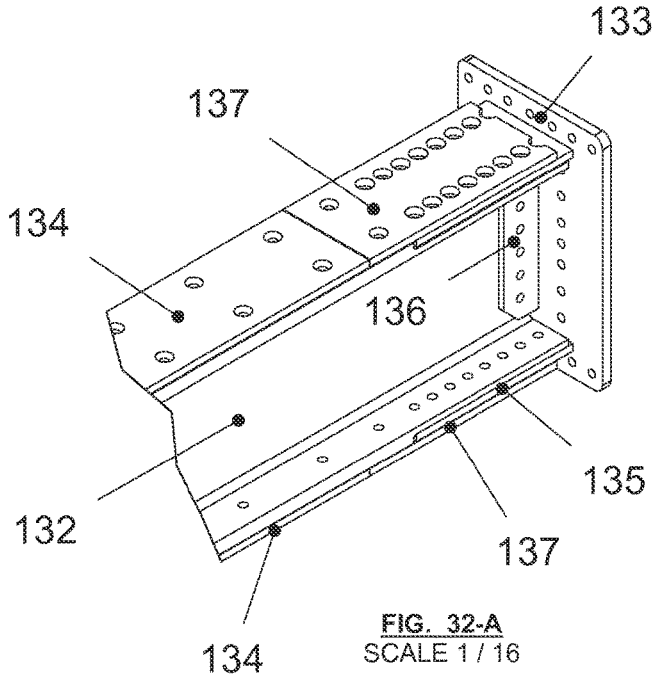
FIG. 32-A
SCALE 1 / 16

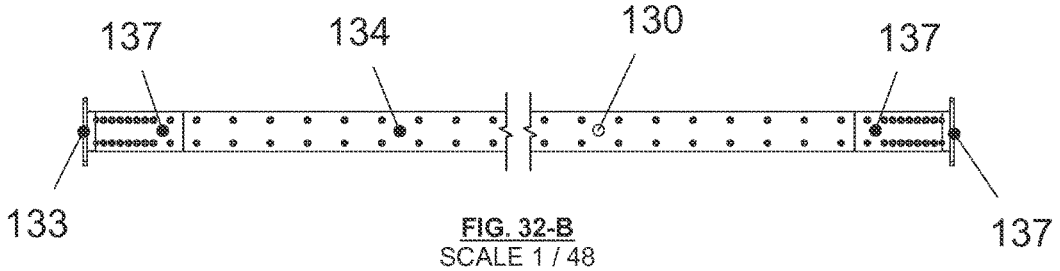
FIG. 32-B
SCALE 1 / 48
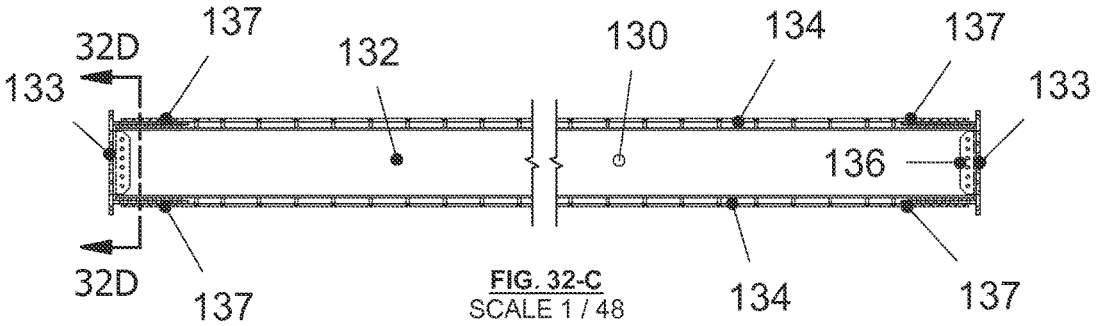
FIG. 32-C
SCALE 1 / 48
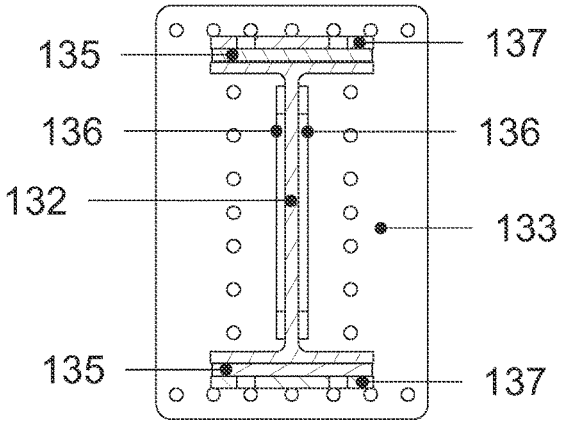
FIG. 32D
SCALE 1 / 12

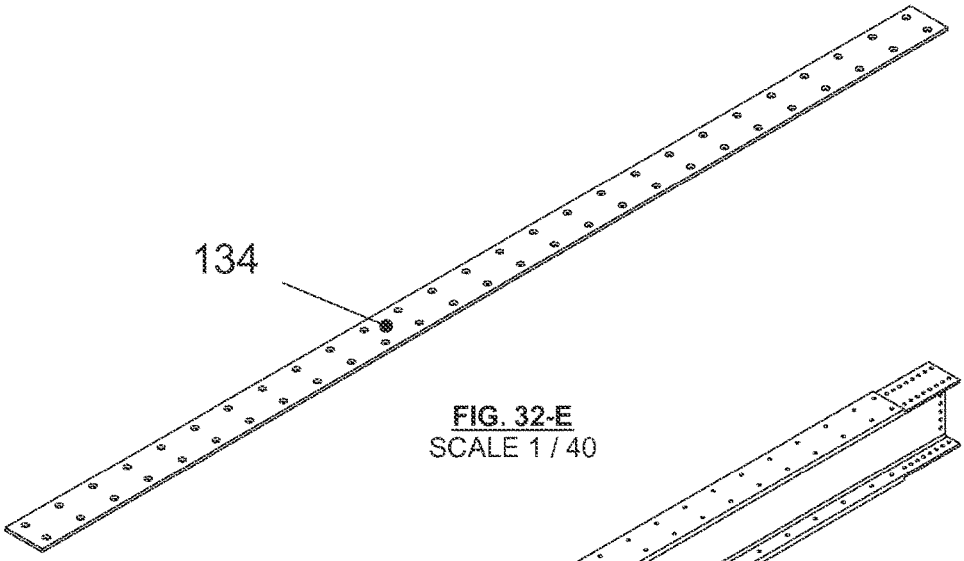
FIG. 32-E
SCALE 1 / 40
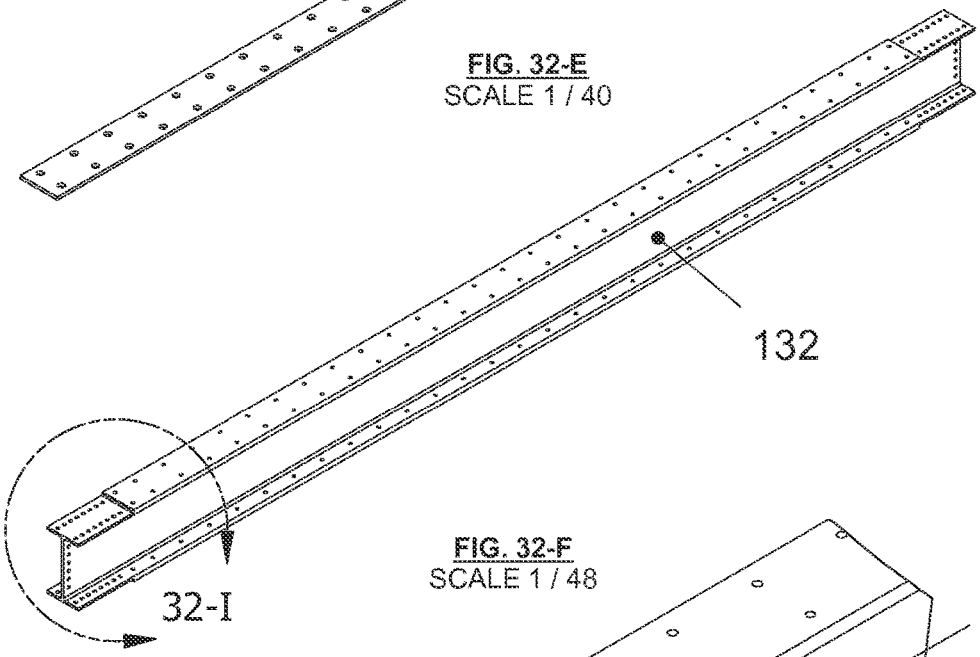
FIG. 32-F
SCALE 1 / 48
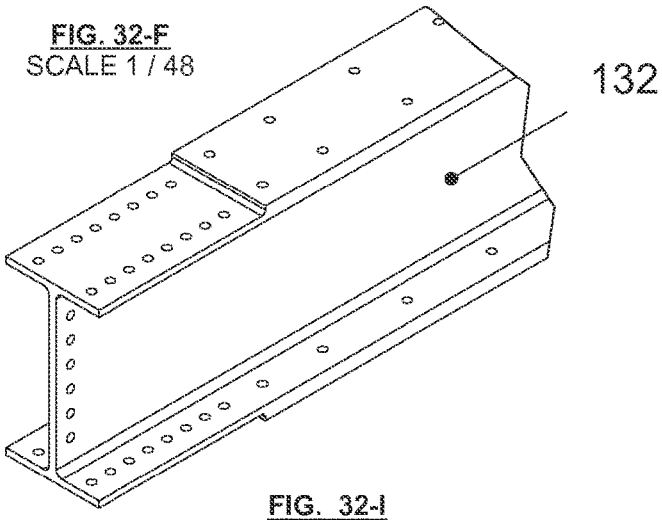
FIG. 32-I
SCALE 1 / 16

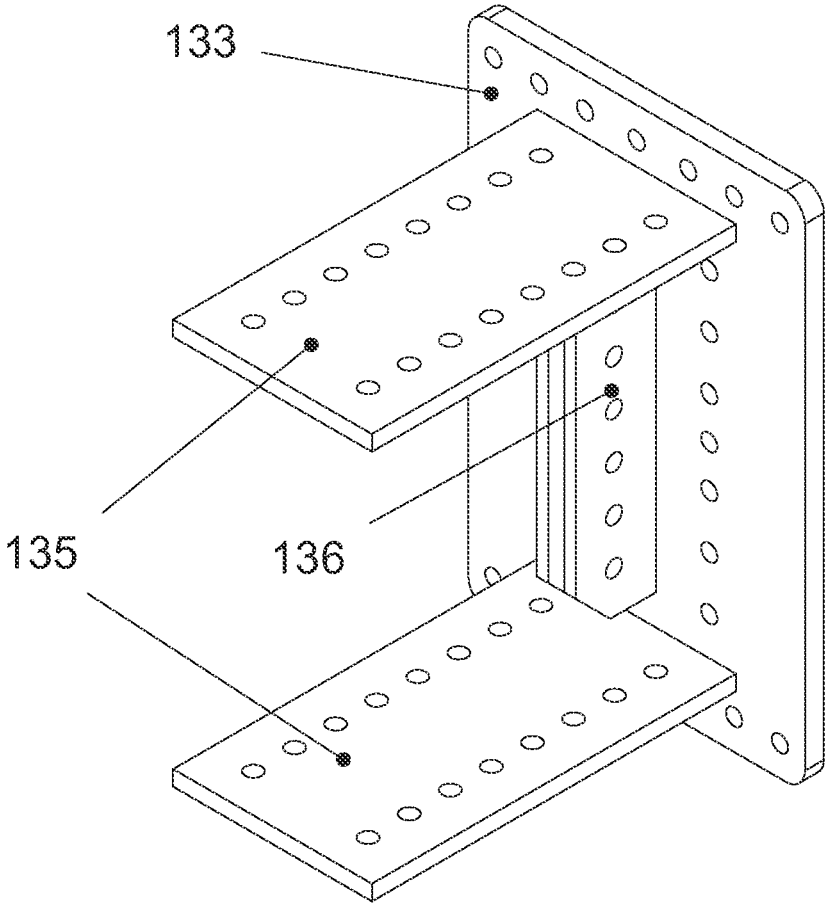
FIG. 32-H
SCALE 1 / 8
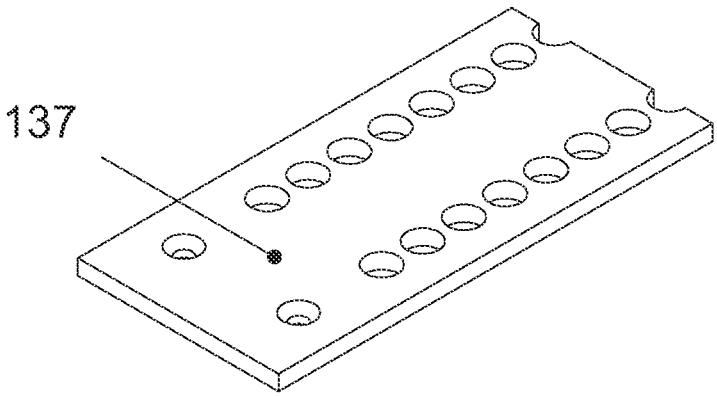
FIG. 32-I
SCALE 1 / 8

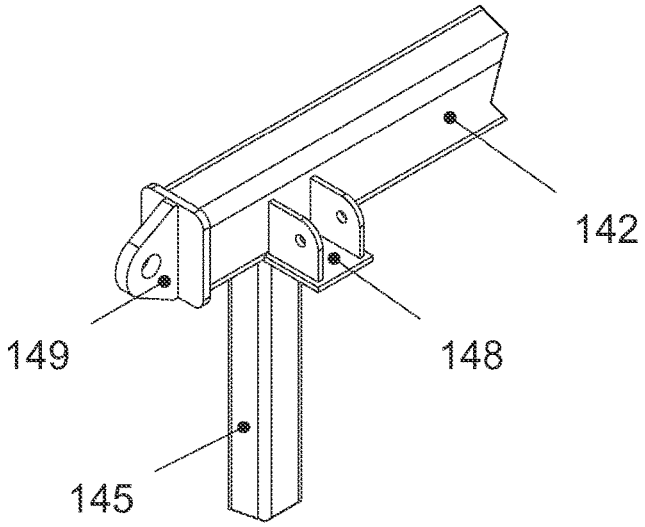
FIG. 33-A
SCALE 1 / 12
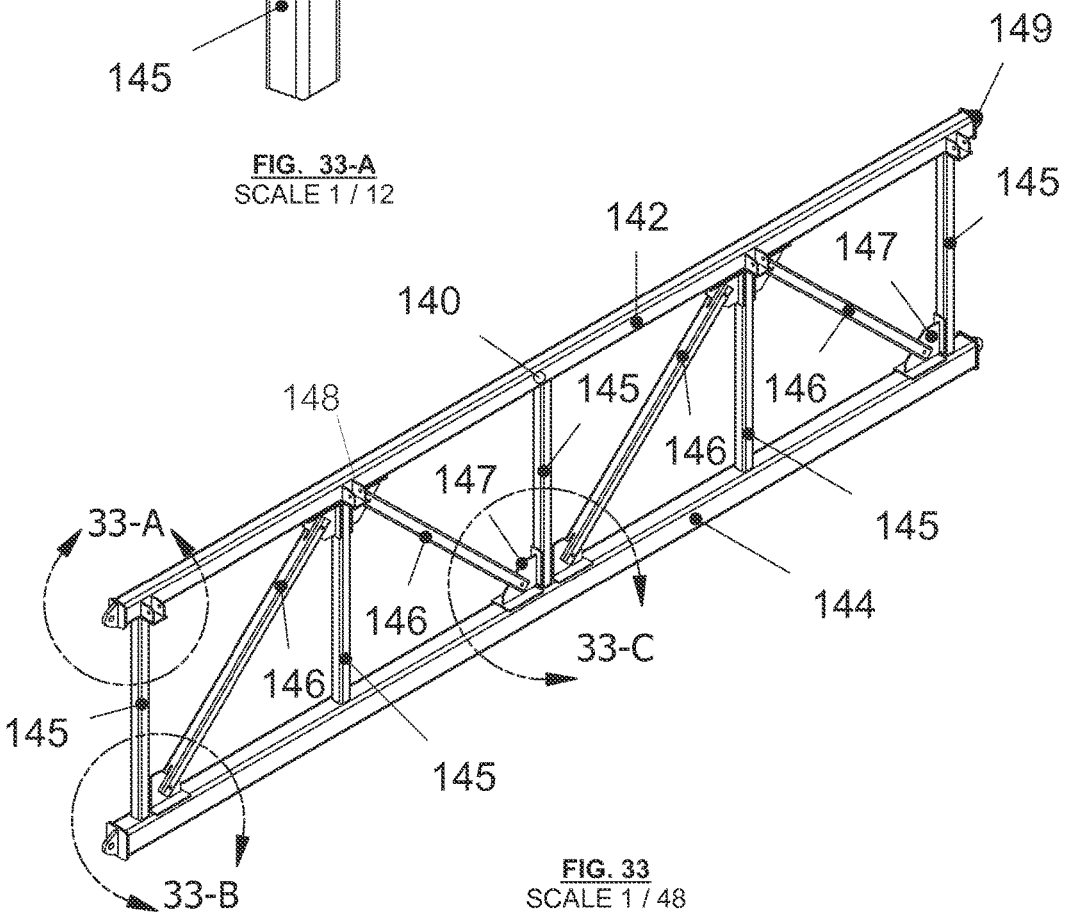
FIG. 33
SCALE 1 / 48

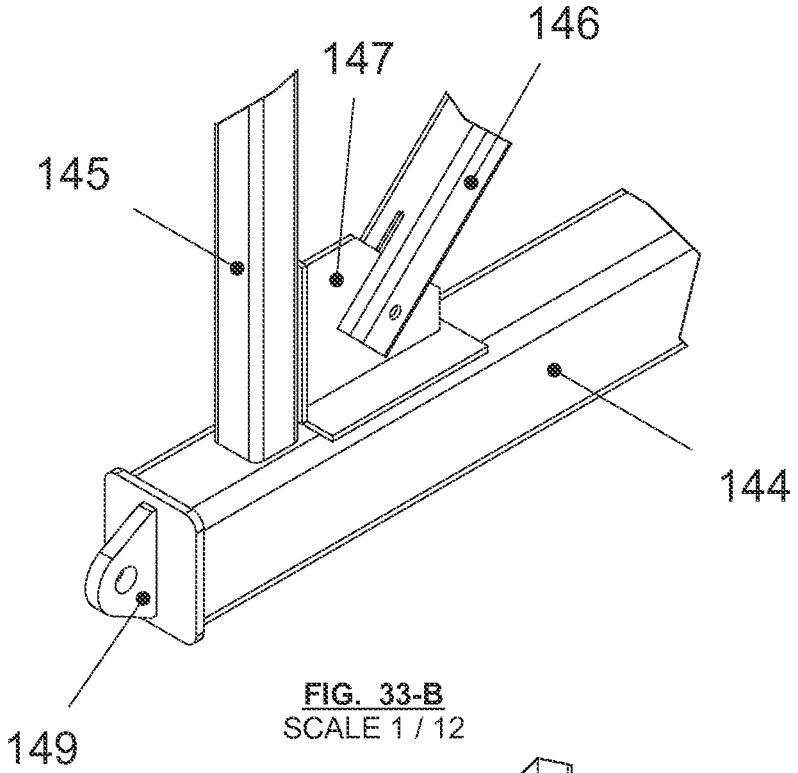
FIG. 33-B
SCALE 1 / 12
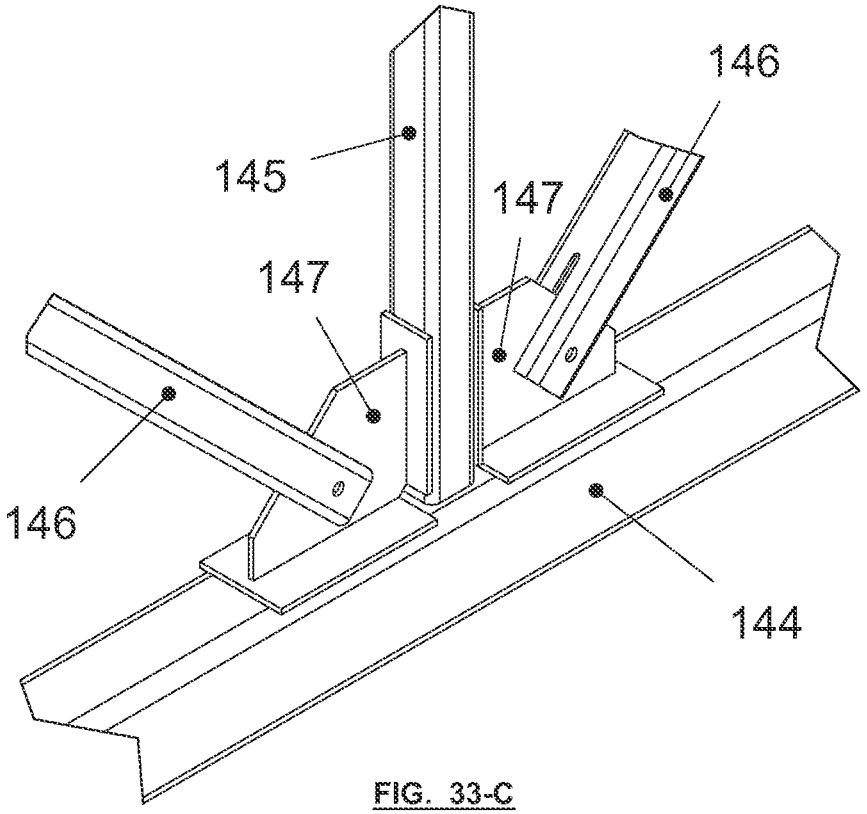
FIG. 33-C
SCALE 1 / 12

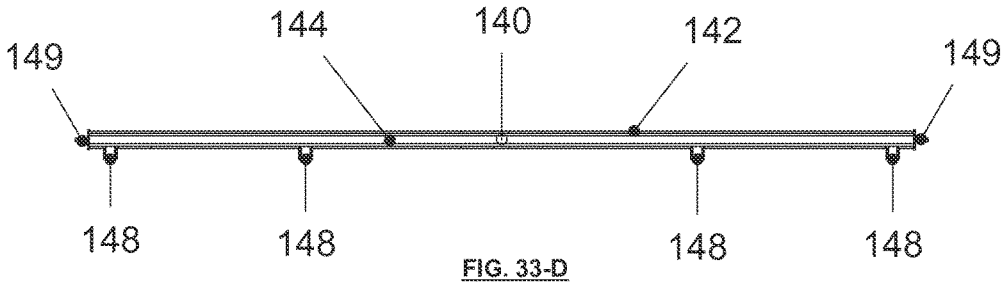
FIG. 33-D
SCALE 1 / 64
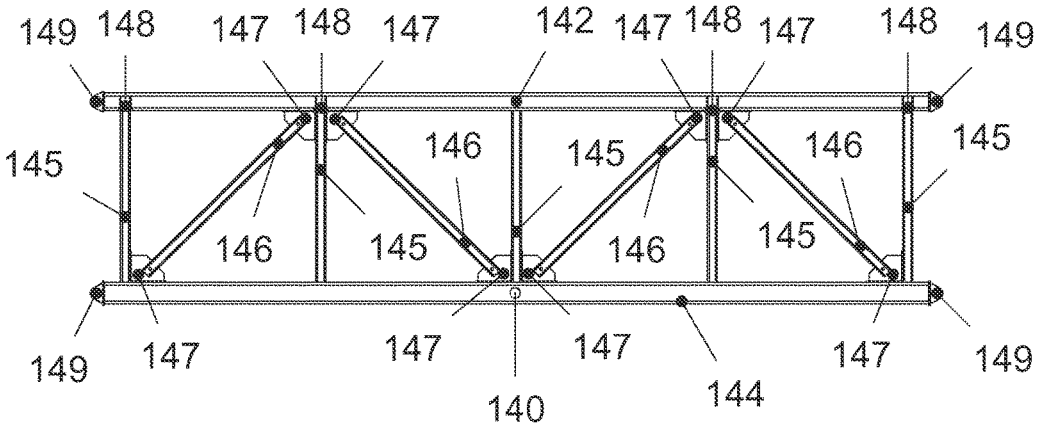
FIG. 33-E
SCALE 1 / 64

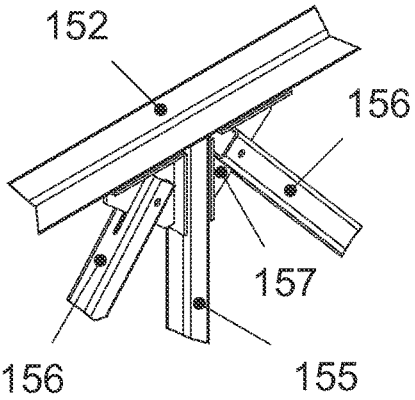
FIG. 34-A
SCALE 1 / 20
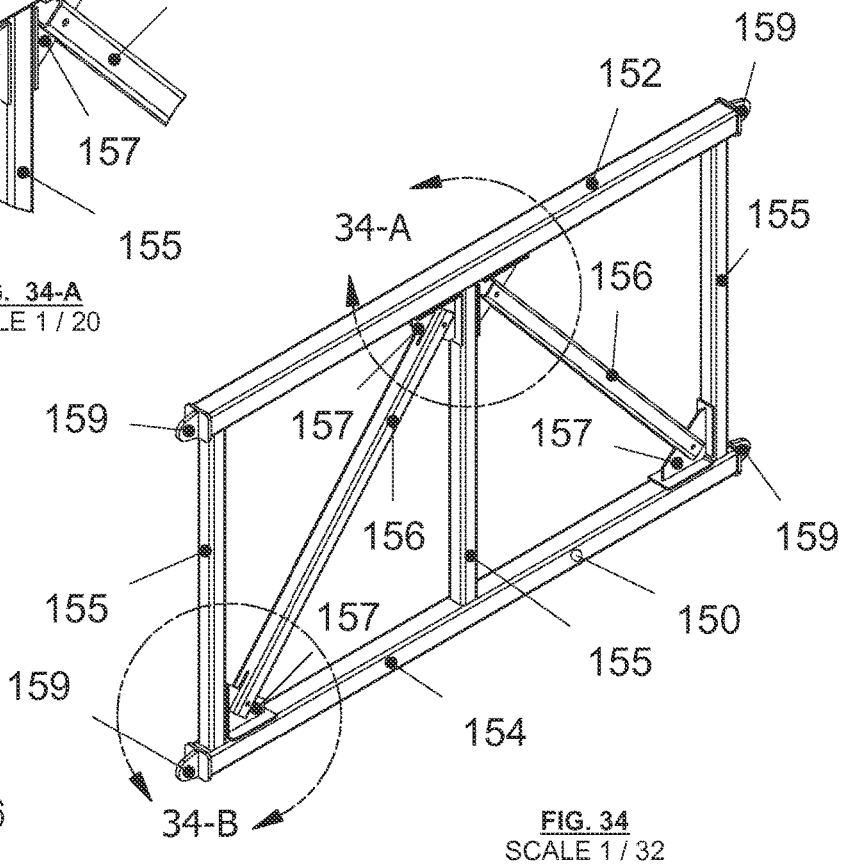
FIG. 34
SCALE 1 / 32
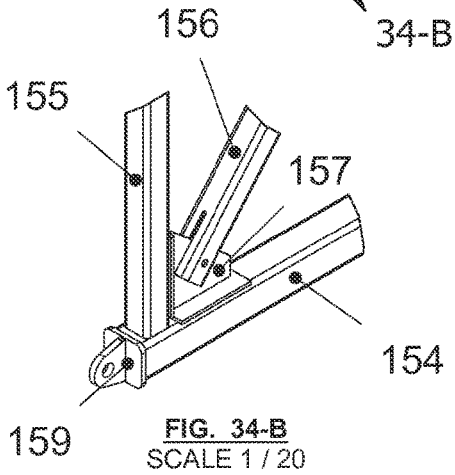
FIG. 34-B
SCALE 1 / 20

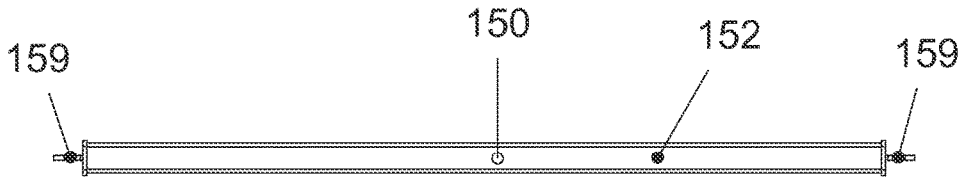
FIG. 34-C
SCALE 1 / 30
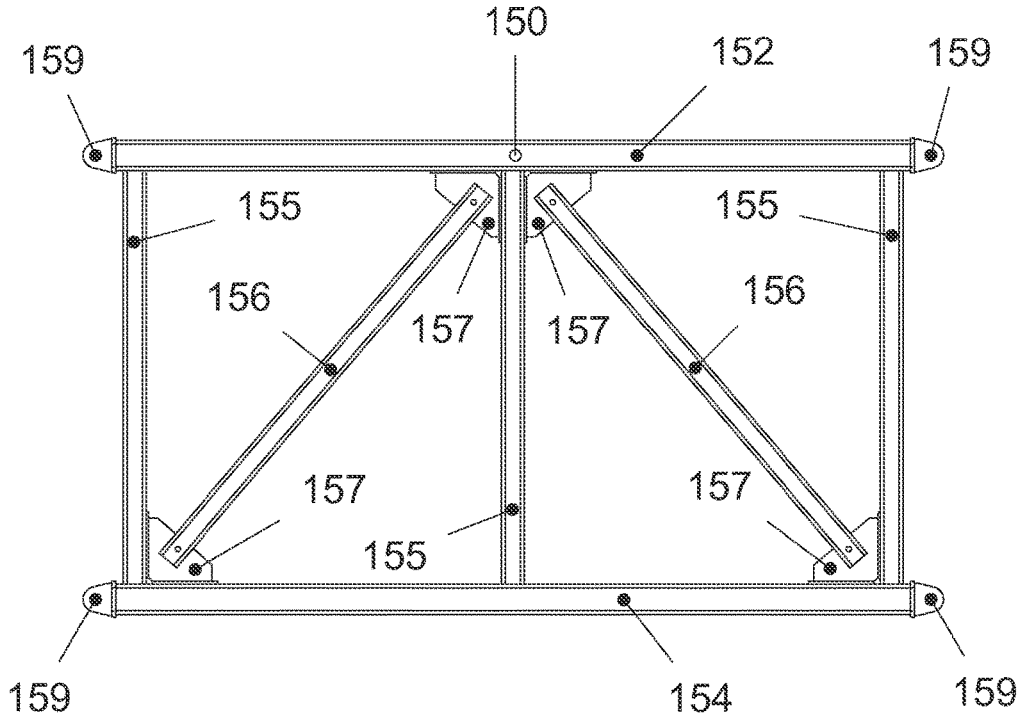
FIG. 34-D
SCALE 1 / 30

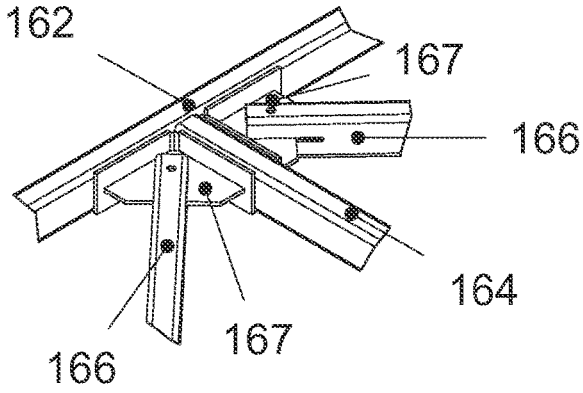
FIG. 35-A
SCALE 1 / 20
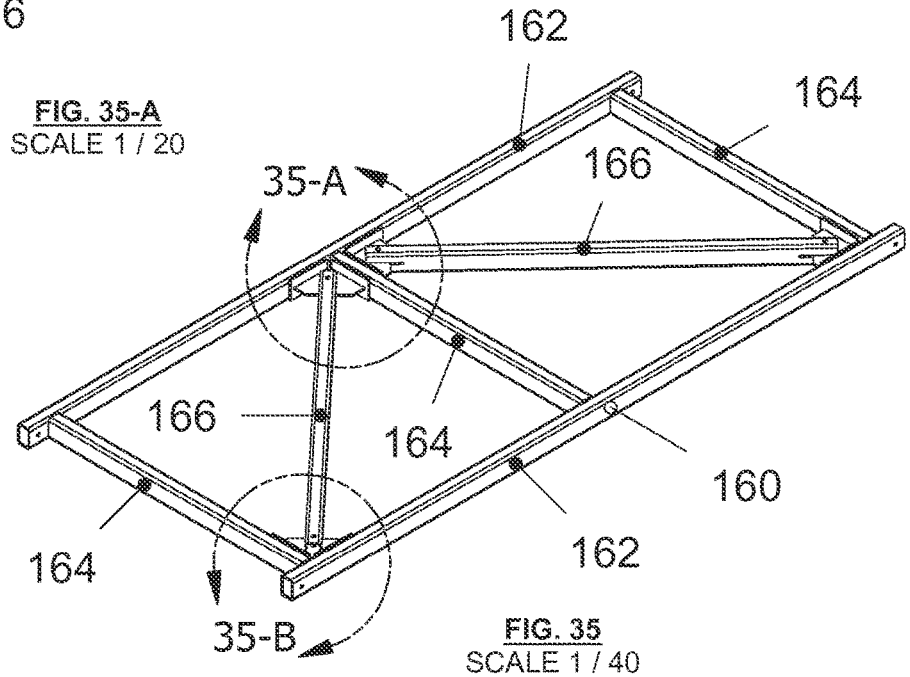
FIG. 35
SCALE 1 / 40
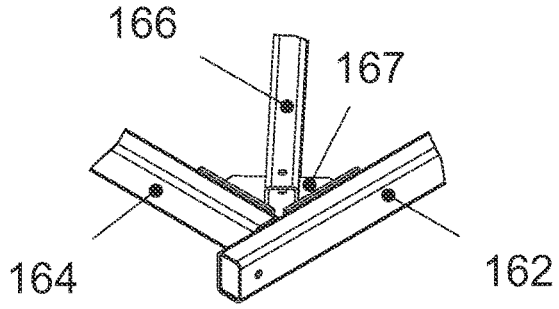
FIG. 35-B
SCALE 1 / 20

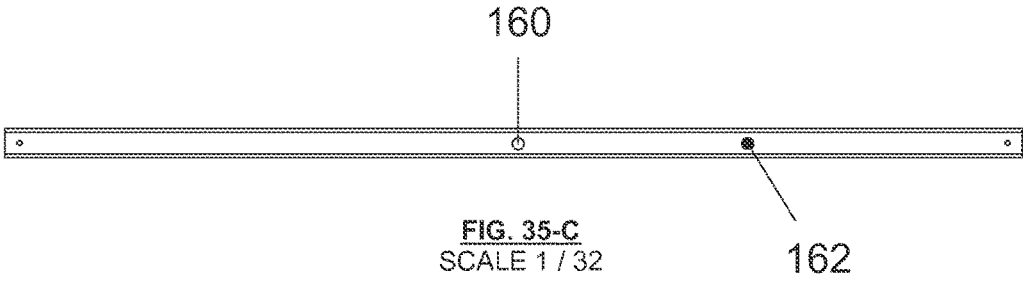
FIG. 35-C
SCALE 1 / 32
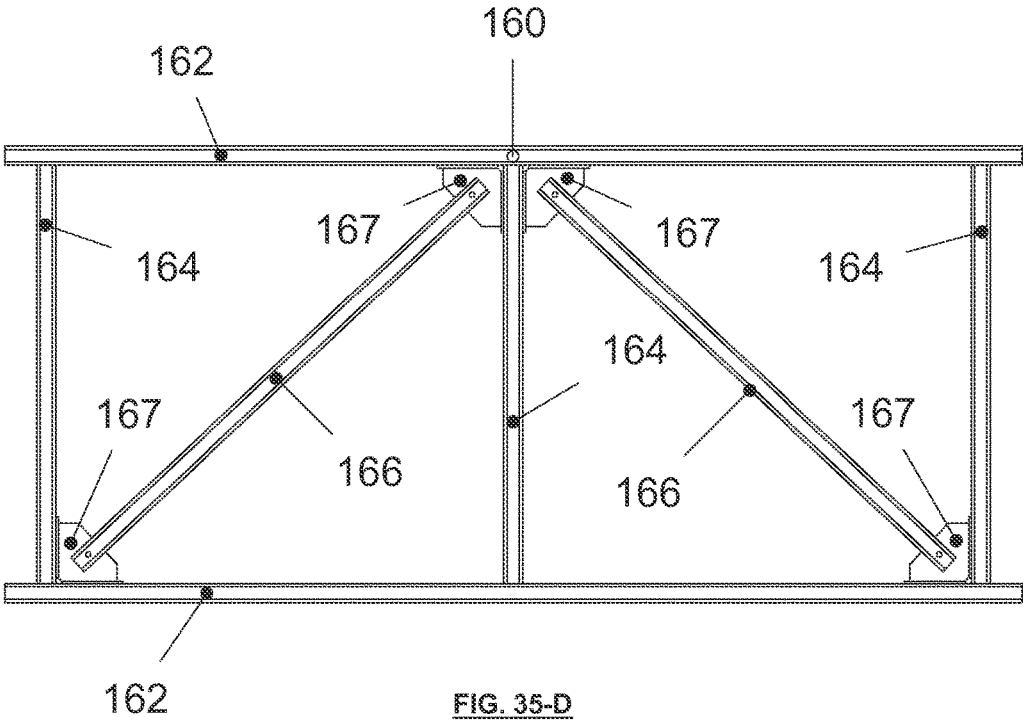
FIG. 35-D
SCALE 1 / 32

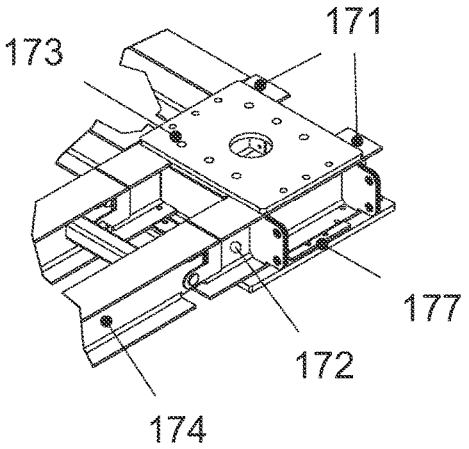
FIG. 36-A
SCALE 1 / 30
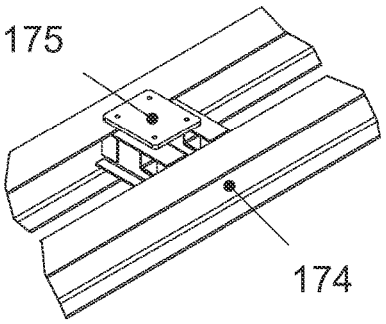
FIG. 36-B
SCALE 1 / 30
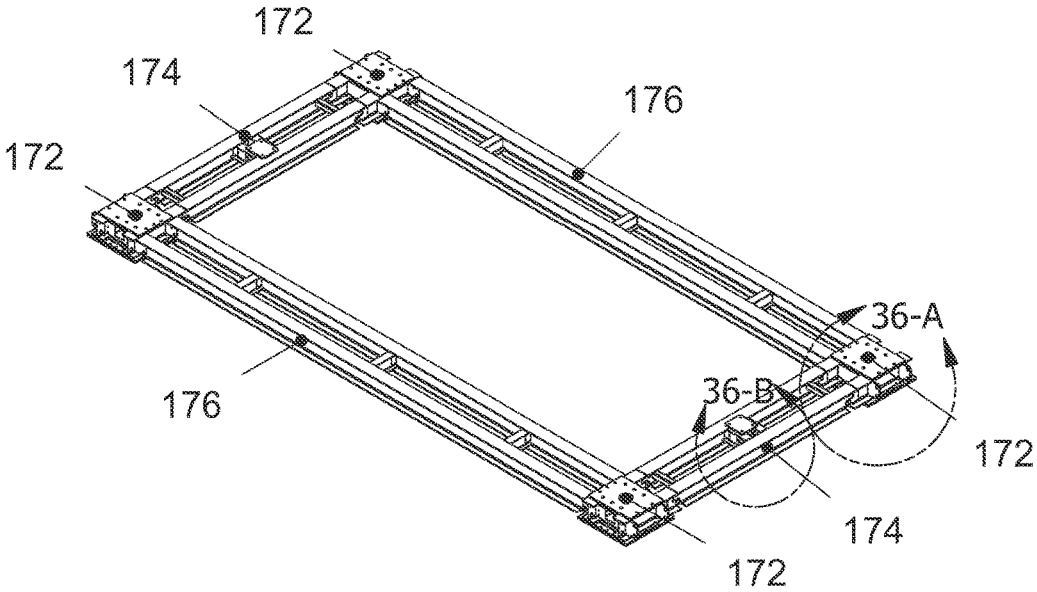
FIG. 36
SCALE 1 / 90

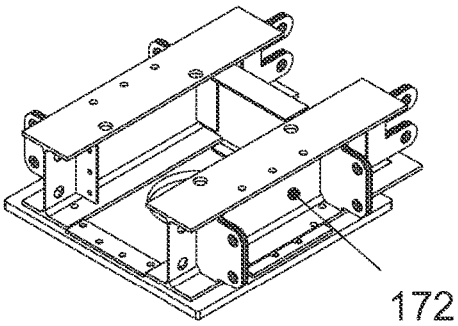
FIG. 36-C
SCALE 1 / 24
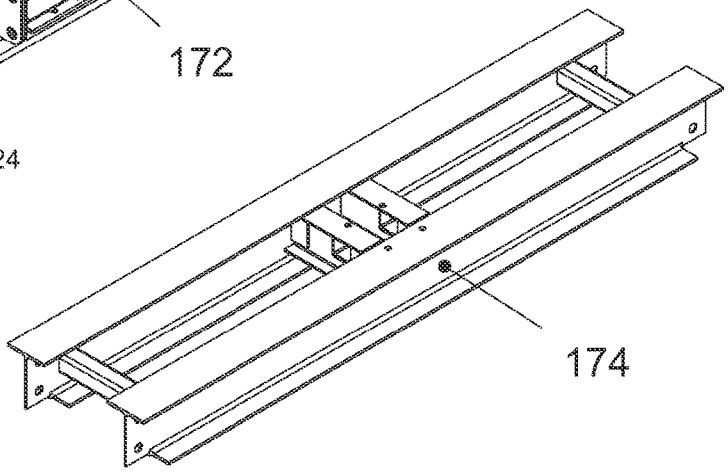
FIG. 36-D
SCALE 1 / 30
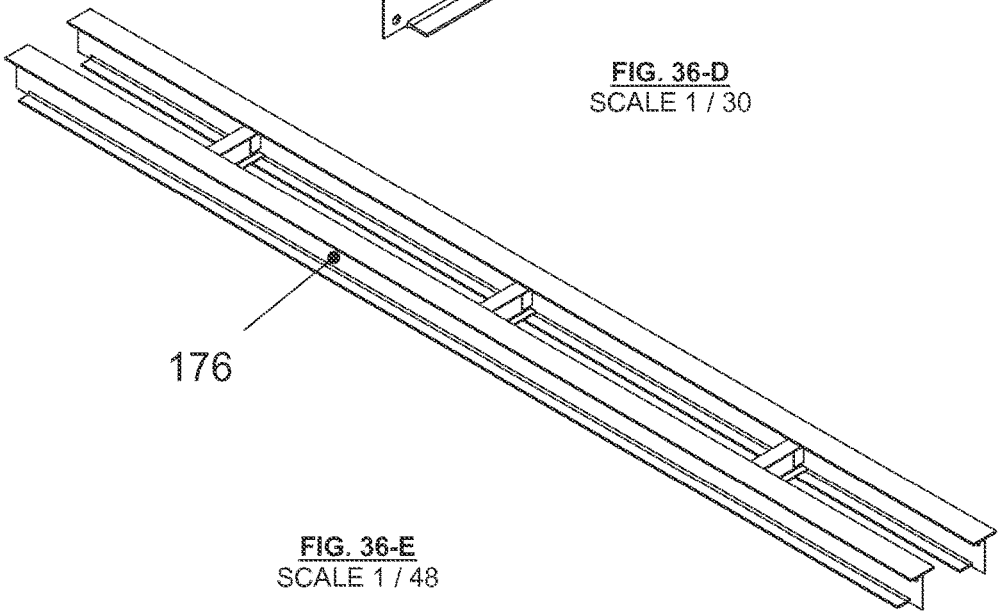
FIG. 36-E
SCALE 1 / 48

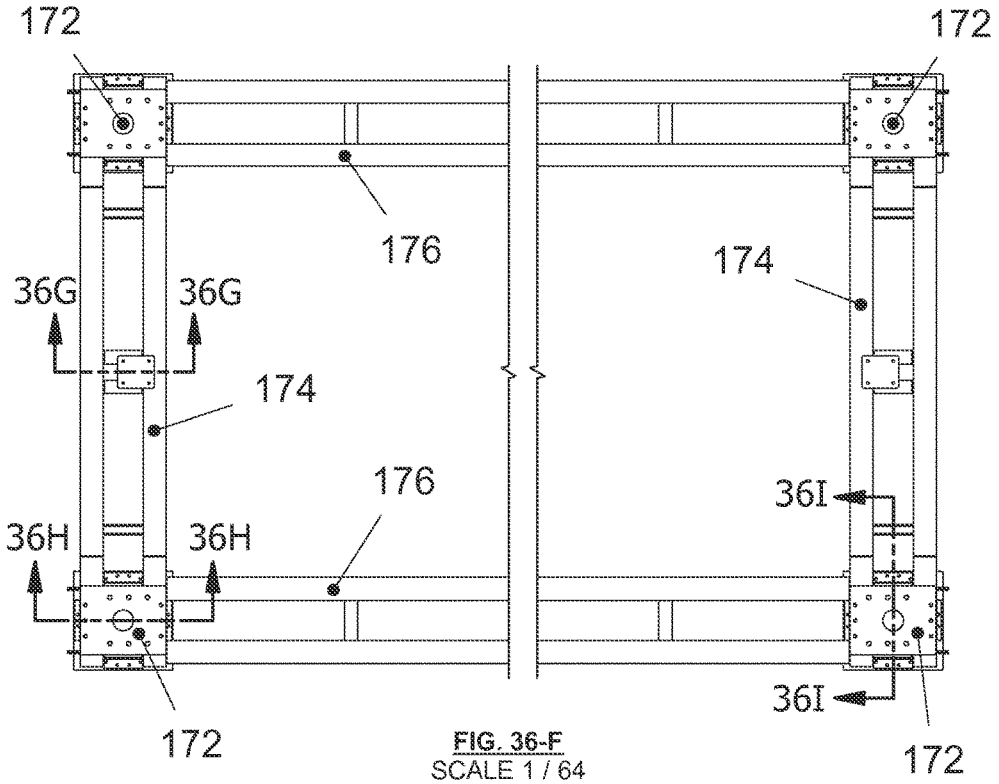
FIG. 36-F
SCALE 1 / 64
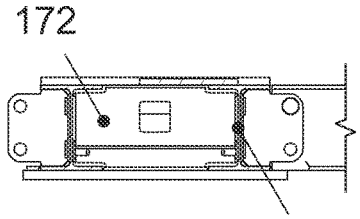
FIG. 36G
SCALE 1 / 24
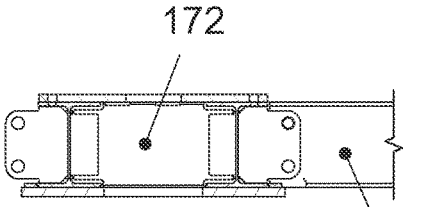
FIG. 36H
SCALE 1 / 24
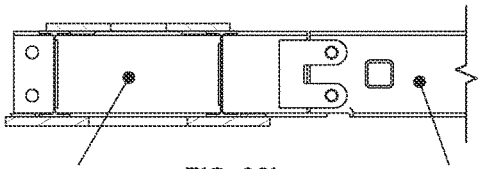
FIG. 36I
SCALE 1 / 24

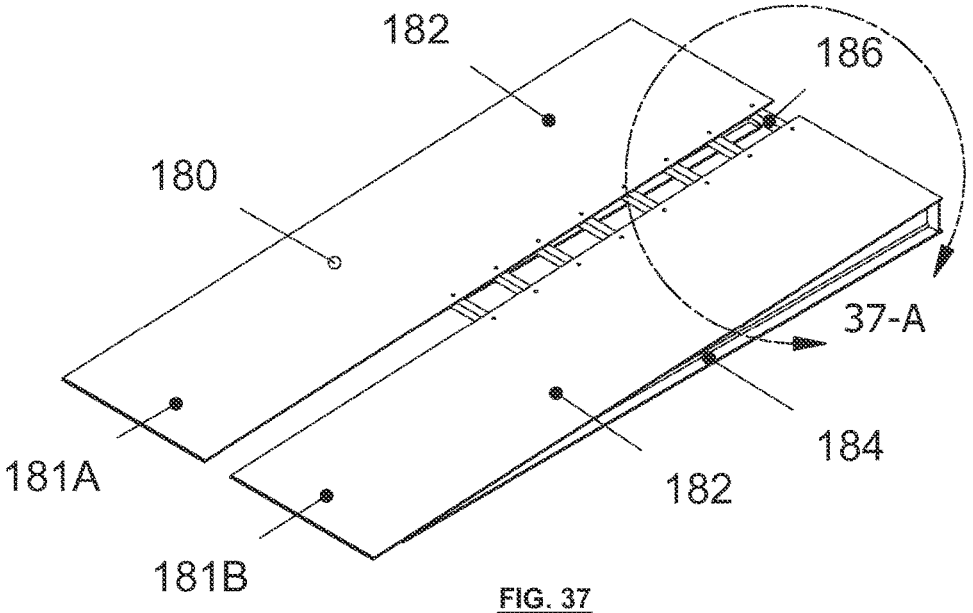
FIG. 37
SCALE 1 / 48
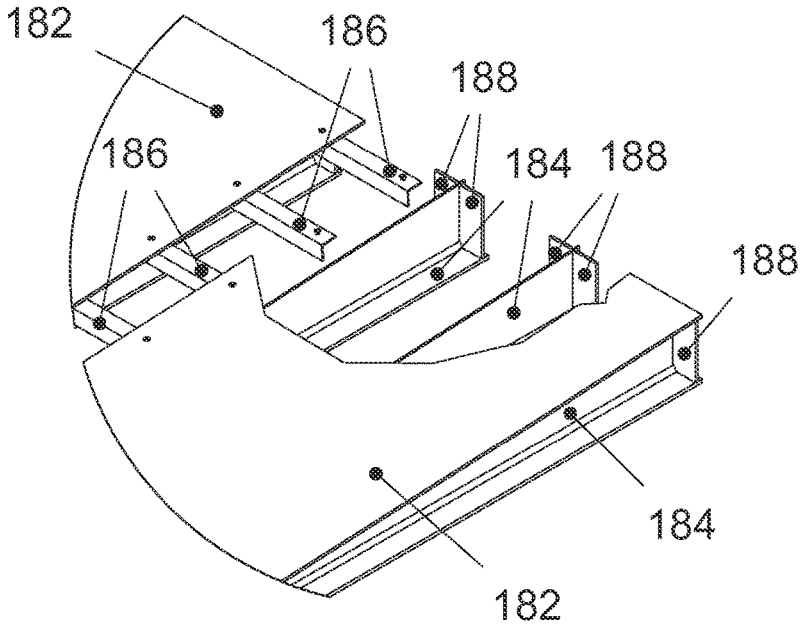
FIG. 37-A
SCALE 1 / 24

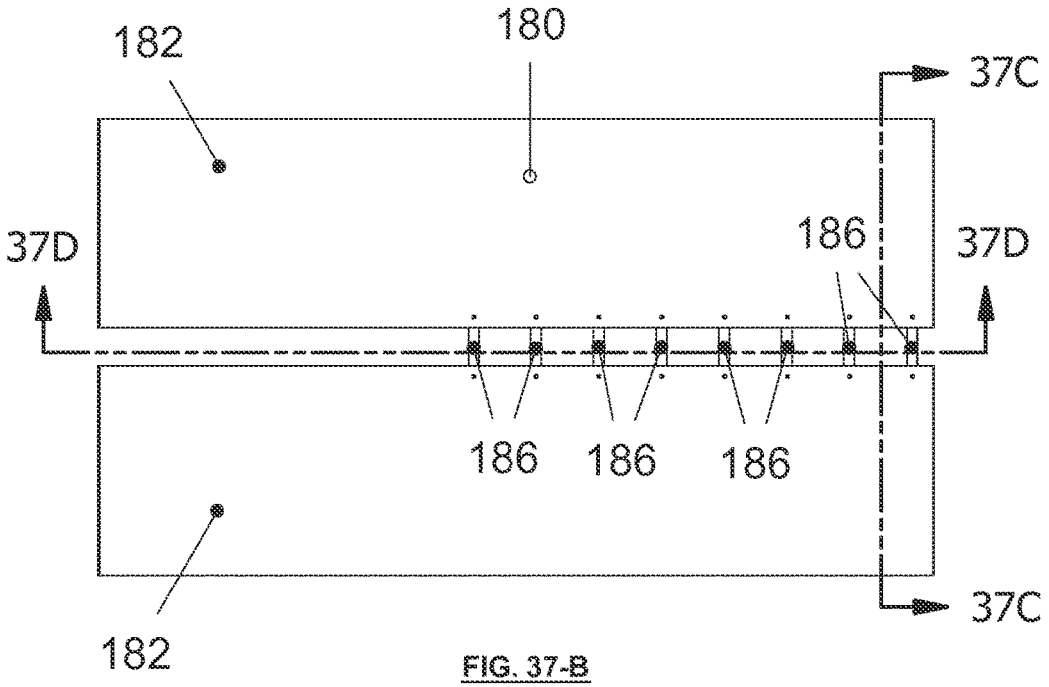
FIG. 37-B
SCALE 1 / 48
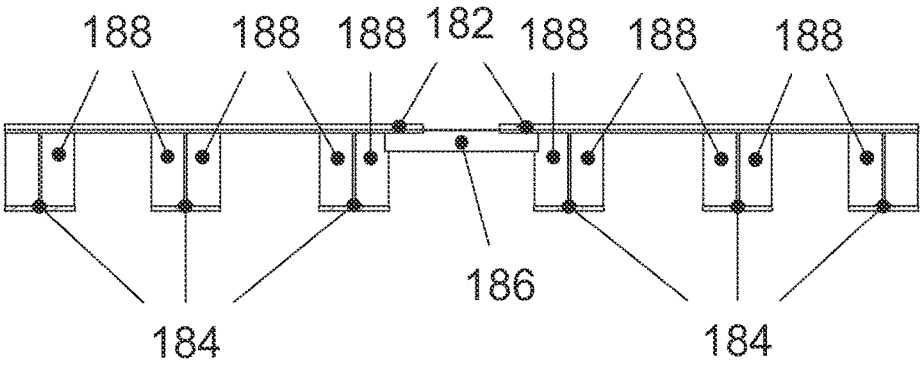
FIG. 37C
SCALE 1 / 24

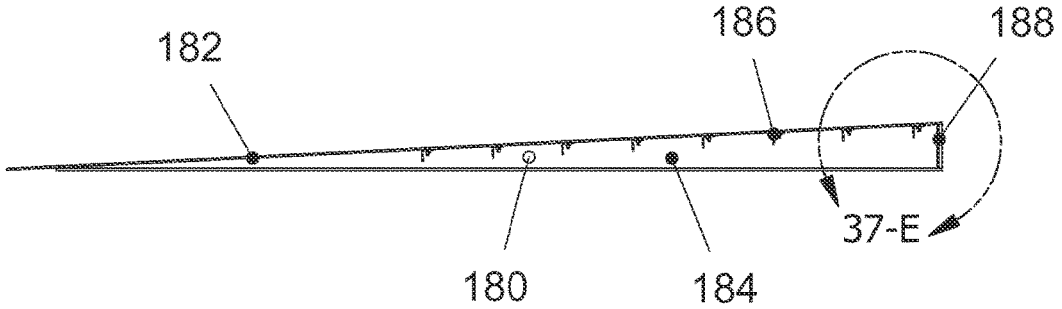
FIG. 37D
SCALE 1 / 40
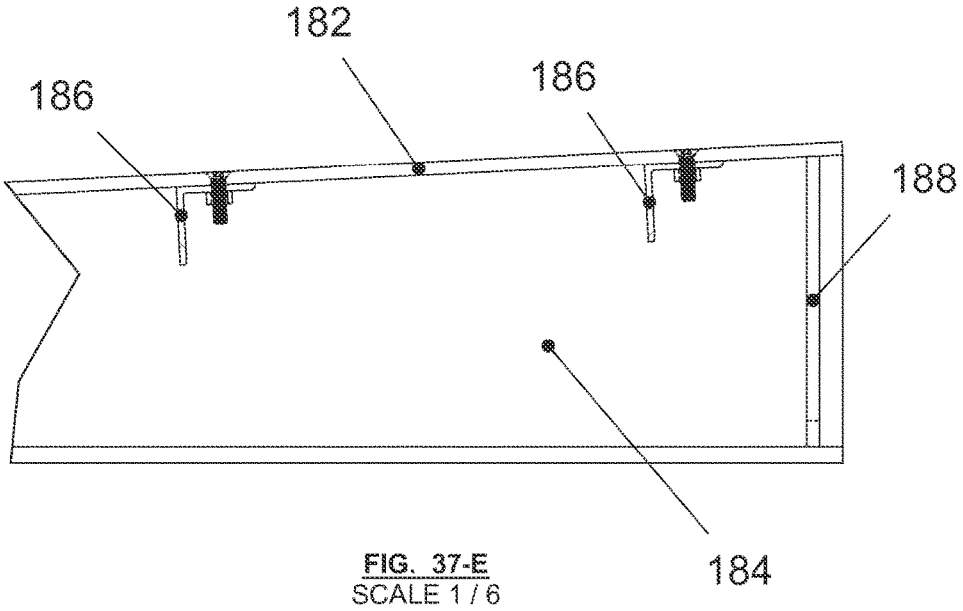
FIG. 37-E
SCALE 1 / 6

SCALE 1 / 3

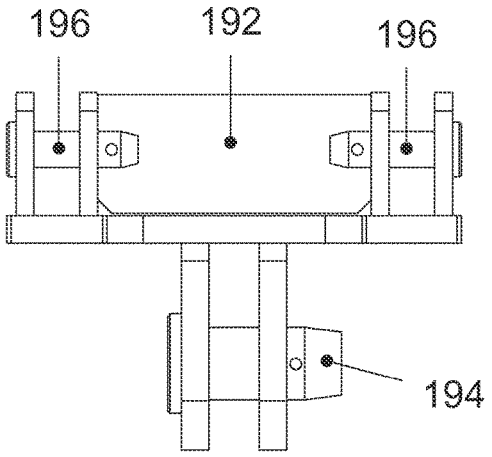
FIG. 38-A
SCALE 1 / 4
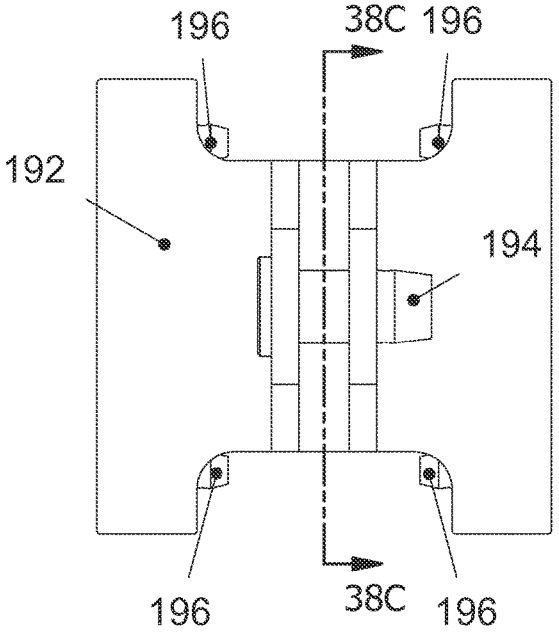
FIG. 38-B
SCALE 1 / 4
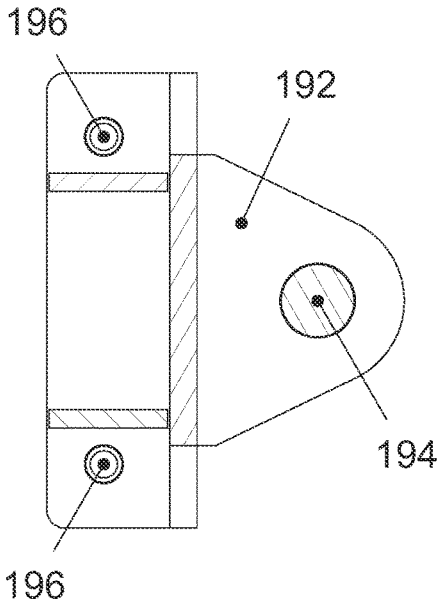
FIG. 38C
SCALE 1 / 4

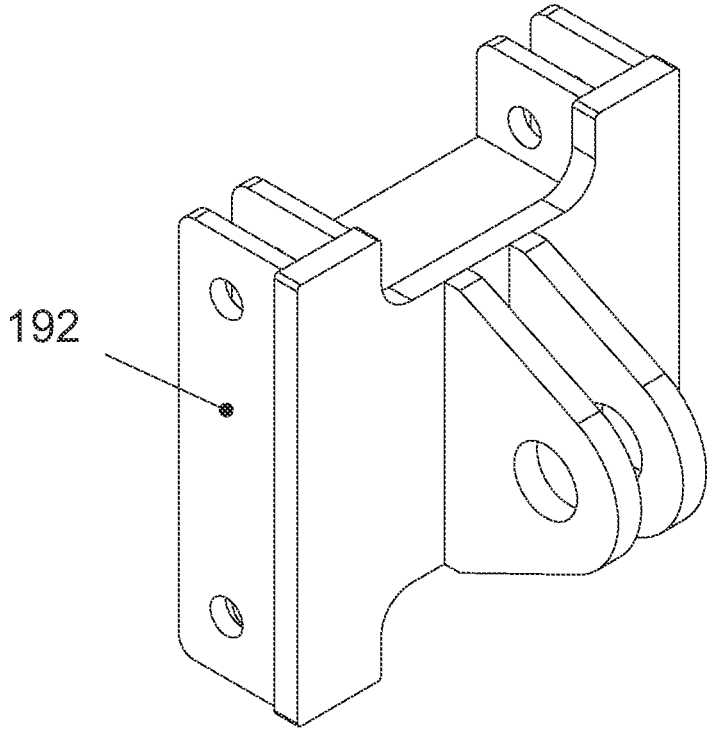
FIG. 38-D
SCALE 1 / 4
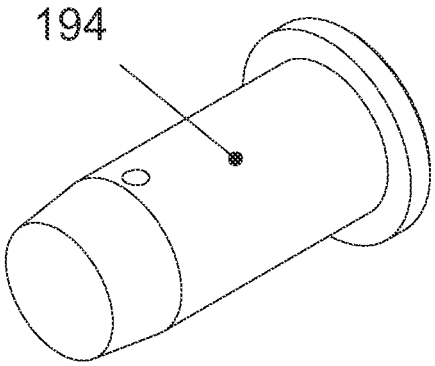
FIG. 38-E
SCALE 1 / 2
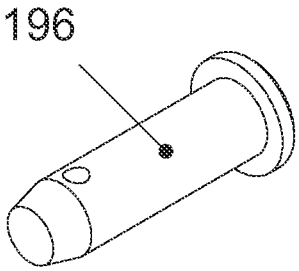
FIG. 38-F
SCALE 1 / 2

SCALE 1 / 2

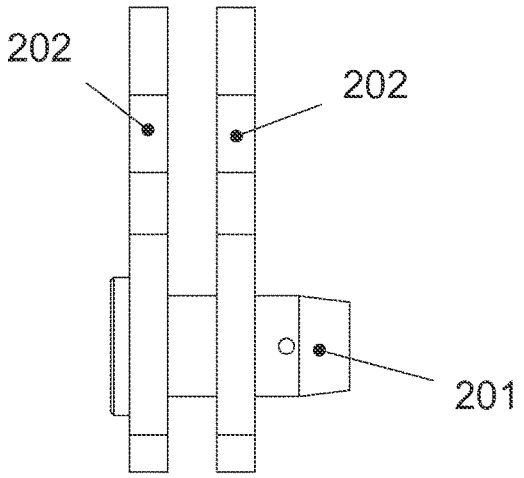
FIG. 39-A
SCALE 1 / 3
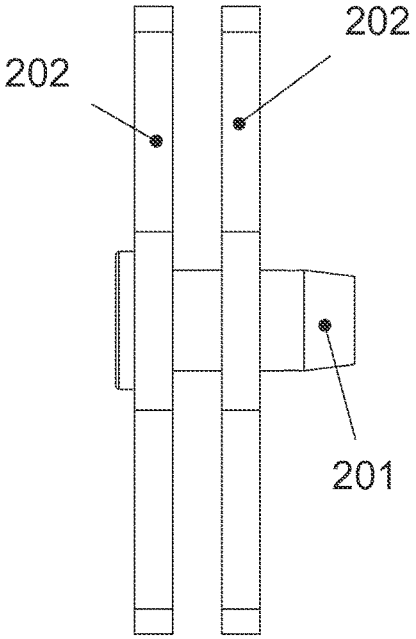
FIG. 39-B
SCALE 1 / 3
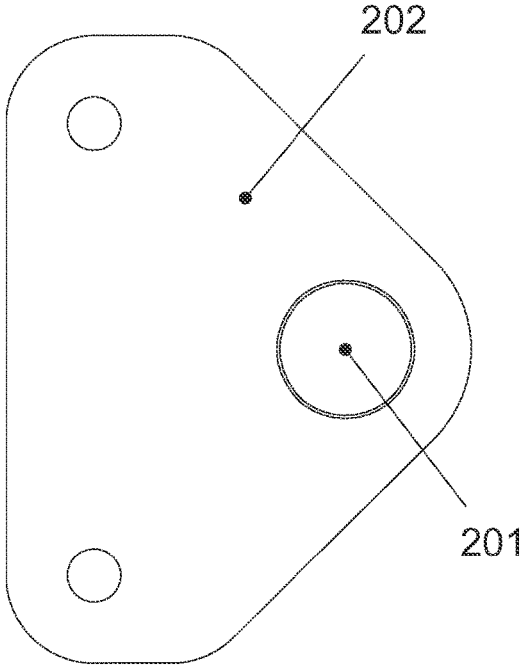
FIG. 39-C
SCALE 1 / 3

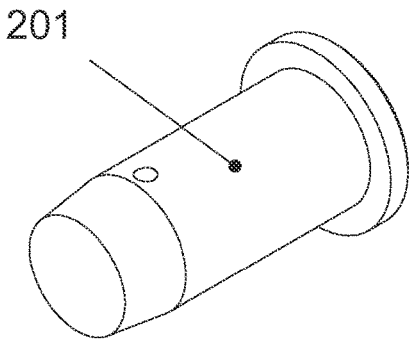
FIG. 39-D
SCALE 1 / 2
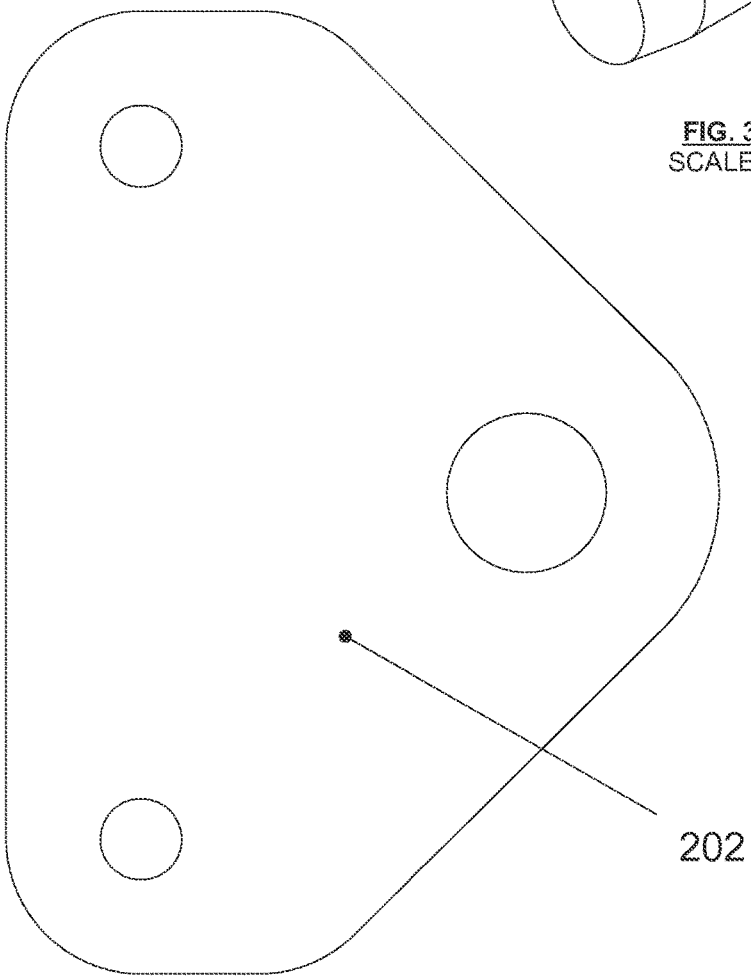
FIG. 39-E
SCALE 1 / 2

APPARATUS, SYSTEM, AND METHOD FOR PIPE MODULAR LIFT SYSTEM

CROSS-REFERENCE TO RELATED APPLICATIONS

The present invention claims priority to U.S. Provisional Application 62/121,740 filed Feb. 27, 2015, which is hereby incorporated by reference in its entirety.

FIELD OF THE INVENTION

The present invention relates to the moving of heavy structure or load vertically by way of a modular lifting system.

BACKGROUND OF THE INVENTION

There are various apparatuses, methods, and systems utilized today to transport heavy loads vertically. Various issues exist with the current methods in that the lift systems today all require suspended loads and conventional rigging attachment methods (e.g. slings, cables), hereafter referred to as "conventional lifting methods" all of which carry an inherent risk of failure. Many of these conventional lifting methods utilize cranes, which require time-consuming training and preparation, are prone to human performance failures, provide unreliable service due to wind speeds, and are often difficult to use because of scheduling. The embodiments disclosed herein include a lifting system that lifts the load at a steady rate while maintaining constant steel-on-steel contact, and as such does not rely on conventional methods to lift the load. There is thus disclosed various embodiments herein directed to a pipe modular lift system.

SUMMARY OF THE INVENTION

In one embodiment of the present invention, there is provided a unique heavy lifting system capable of transporting heavy loads from grade to any elevation required by the project.

The configuration consists of four (4) pipe columns that support a machine screw actuator at each column. At the base of each column, a column pedestal distributes the column loads to the supporting surface below. Each of the columns and pedestals are stabilized at their bases by a base stabilizing beam extending horizontally, orthogonal to the direction of the long span, at each column location. The columns are laterally braced along their height by long-span trusses and short-span trusses. The long-span trusses are braced at their top chord by K-brace panels. At the top of each column, a motor frame supports the machine screw synchronized lift system components.

Each travel nut supports a travel nut bracket, connected to a lift beam which spans the long direction of the system. The lift beam supports the array of deck section panels, which span the short direction of the system.

All the lifting system components quoted above are referenced numerically in the description of drawings and the drawings themselves on the pages that follow.

BRIEF DESCRIPTION OF THE DRAWINGS

FIGS. 1-A through 1-D are various cutout perspective detail views taken from FIG. 1;

FIGS. 6-A and 6-B are various cutout perspective detail views taken from FIG. 6;

FIG. 7 is a partial plan view through a pipe column from the PMLS;

FIG. 7A is a section view of the pipe column from FIG. 7 taken along section line 7A;

FIG. 7-B is a cutout detail view of the connection between the stabilizer beam and the base pedestal;

FIG. 13 is a partial isometric view of the PMLS at the actuating system and frame connection;

FIGS. 13-A through 13-C are cutout perspective detail views of the PMLS from FIG. 13 taken along corresponding section lines;

FIGS. 14-A through 14-C are various cutout perspective detail views from FIG. 14 taken along corresponding section lines;

FIGS. 20-A and 20-B illustrate the rotational degrees of freedom in the transverse plane of the lift beam on the nut bracket to lift beam connection shown in an upright view of nut bracket and in a deflected lift beam and rotated nut bracket, respectively;

FIG. 21-A is a partial top view of the lift beam to the deck panels connection;

FIGS. 22 through 22-B are various views of the travel nut component from the PMLS;

FIGS. 25 through 25-B illustrate the rotational degrees of freedom from the flexible rod of FIG. 24;

FIG. 26 is a partial isometric view of the lifting motor assembly;

FIGS. 26-A and 26-B are isometric details of individual lifting motor components;

FIGS. 27-D through 27-H are isometric views of individual components of the pipe column from the PMLS;

FIG. 28D is a section view from FIG. 28-B taken along the section line 28D;

FIGS. 28-E through 28-K are isometric views of individual components of the base pedestal from the PMLS;

FIGS. 29-F through 29-J are isometric views of individual components of the base stabilizing beam from the PMLS;

FIGS. 30-F through 30-M are isometric views of individual components of the deck panel from the PMLS;

FIGS. 32 through 32-D are various views of a lift beam component from the PMLS;

FIGS. 32-E through 32-I are isometric views of individual components of the lift beam from the PMLS;

FIGS. 33 through 33-E are isometric and orthographic views of a long span truss and cutout detail views thereof from the PMLS;

FIGS. 34 through 34-D are isometric and orthographic views of a short span truss and cutout detail views thereof from the PMLS;

FIGS. 35 through 35-D are isometric and orthographic views of a K-brace panel and cutout detail views thereof from the PMLS;

FIGS. 36 through 36-C are various views of a top actuator frame from the PMLS;

FIGS. 36D-through 36F are section views from FIG. 36-C taken along corresponding section lines;

FIGS. 37 through 37-B are various views and details of a ground access ramp from the PMLS;

FIGS. 37C and 37D are section views from FIG. 37-B taken along corresponding section lines;

FIG. 37-E is a cutout detail from FIG. 37D of the ground access ramp from the PMLS;

FIG. 38C is a section view from FIG. 38-B taken along the line 38C;

FIGS. 38-D through 38-F are isometric views of individual components of the column slot adaptor from the PMLS;

FIGS. 39-D and 39-E are isometric views of individual components of the column rib bracket from the PMLS.

DETAILED DESCRIPTION OF THE DRAWINGS

Figure 1:
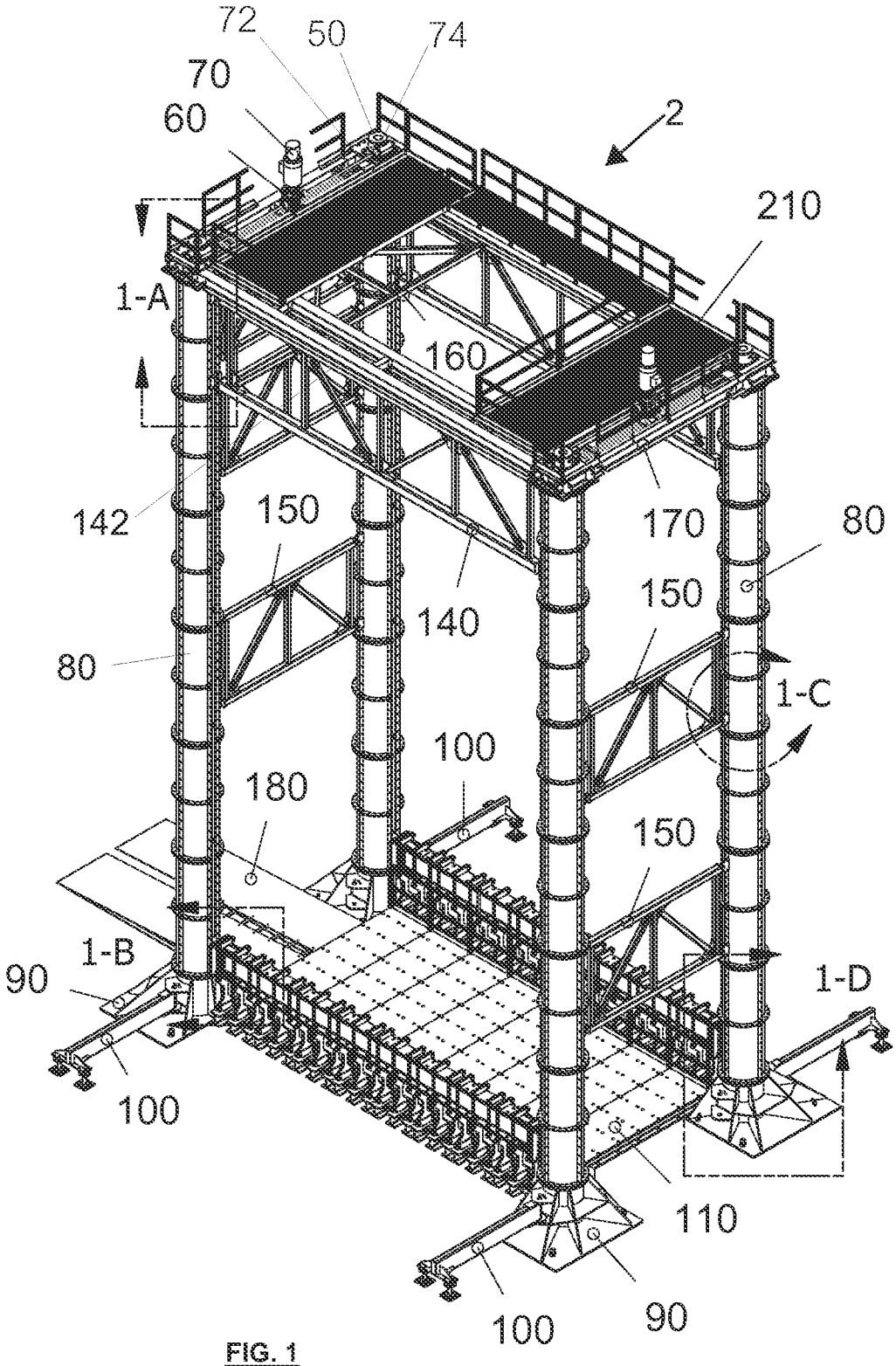
FIG. 1 is an isometric view of the Pipe Modular Lift System (PMLS) in accordance with one configuration of the present invention.

While the invention is susceptible to embodiments in many different forms, the preferred embodiments of the present invention are shown in the drawings, and will be described in detail herein. It should be understood, however, that the present disclosure is to be considered an exemplification of the principles of the invention, and is not intended to limit the spirit or scope of the invention of the embodiments illustrated.

FIG. 1 shows the Pipe Modular Lift System (PMLS) 2 assembled to accommodate (spatially and load-wise) a standard 6-axle Self-Propelled Modular Transport (SPMT) vehicle (not shown), which would access the lifting system deck comprising of (in this configuration) eight (8) deck panel assemblies 110 via a ground access ramp assembly 180.

The long braces referred to as long-span truss panels 140 provide the primary lateral bracing system to the structure, and are attached to the highest pipe column assembly 80 at the column slot openings positioned parallel to the long direction axis. The short braces referred to as short-span truss panels 150 along with the K-brace panels 160 provide the secondary lateral bracing system to the structure. The short-span truss panels 150 are attached to the pipe column assemblies 80 at various staggered elevations to achieve optimal lateral support along the short direction span. The K-brace panels 160 are set parallel to the deck panel assemblies 110, and are attached to the long-span truss panels 140 at their top chords 142, thereby providing additional stiffness to the long-span truss panels 140 and ultimately to the PMLS 2.

At the bottom of the PMLS 2, the four (4) base pedestals 90 are each supported on the outer sides of the PMLS 2 by a base stabilizing beam 100 oriented to resist overturning of the structure about the long (weak) axis in much the same way that outriggers do for crane mounts and similar assemblies. The base stabilizing beams 100 provide additional redistribution of ground-bearing pressure at the site surface, thereby further reducing the likelihood of local overstress.

The diaphragm at the top of the structure referred to as the top actuator frame assembly 170 exists to house the motor (electrical) components of the lift actuating system. These include four (4) M150 UNI-LIFT machine screw actuators 50, two (2) MOTOVARIO worm gear reducers 60, two (2) Lincoln 50 hp brake motors 70, four (4) M150 UNI-LIFT coupling rods 72, eight (8) sleeve gear couplers 74, and other miscellaneous coupling, electrical, and cooling system components.

FIG. 1-A shows the top corner cutout detail with breakouts made through a pipe column assembly 80 that encloses the 20' Acme-threaded screw rod 20 whose rotation enables the vertical motion. Additionally, the aforementioned figure shows the flexible rod 40 attached at its bottom end to the screw rod 20, and shows the machine screw actuator 50 at its top end, as well as a column slot adaptor 190 attached to the column slot vertical stiffeners 82 at the column opening 83.

FIG. 1-B shows a cutout detail near the base of the column with break-outs made through the pipe column assembly 80 in order to display the travel nut 10 and the travel nut bracket assembly 120 which bears on the travel nut 10 and connects via the pipe column assembly 80 slot to the lift beam assembly 130.

FIG. 1-C shows a cutout detail close to mid-height of the structure where a short-span truss panel 150 and pipe column assembly 80 connect via a column rib bracket 200.

FIG. 1-D shows a cutout detail of the base of a column with break-outs made through the pipe column assembly 80 and base pedestal assembly 90 in order to display the rotating screw rod guide assembly 30 attached to the screw rod 20 at its bottom end 21.

Figure 2:
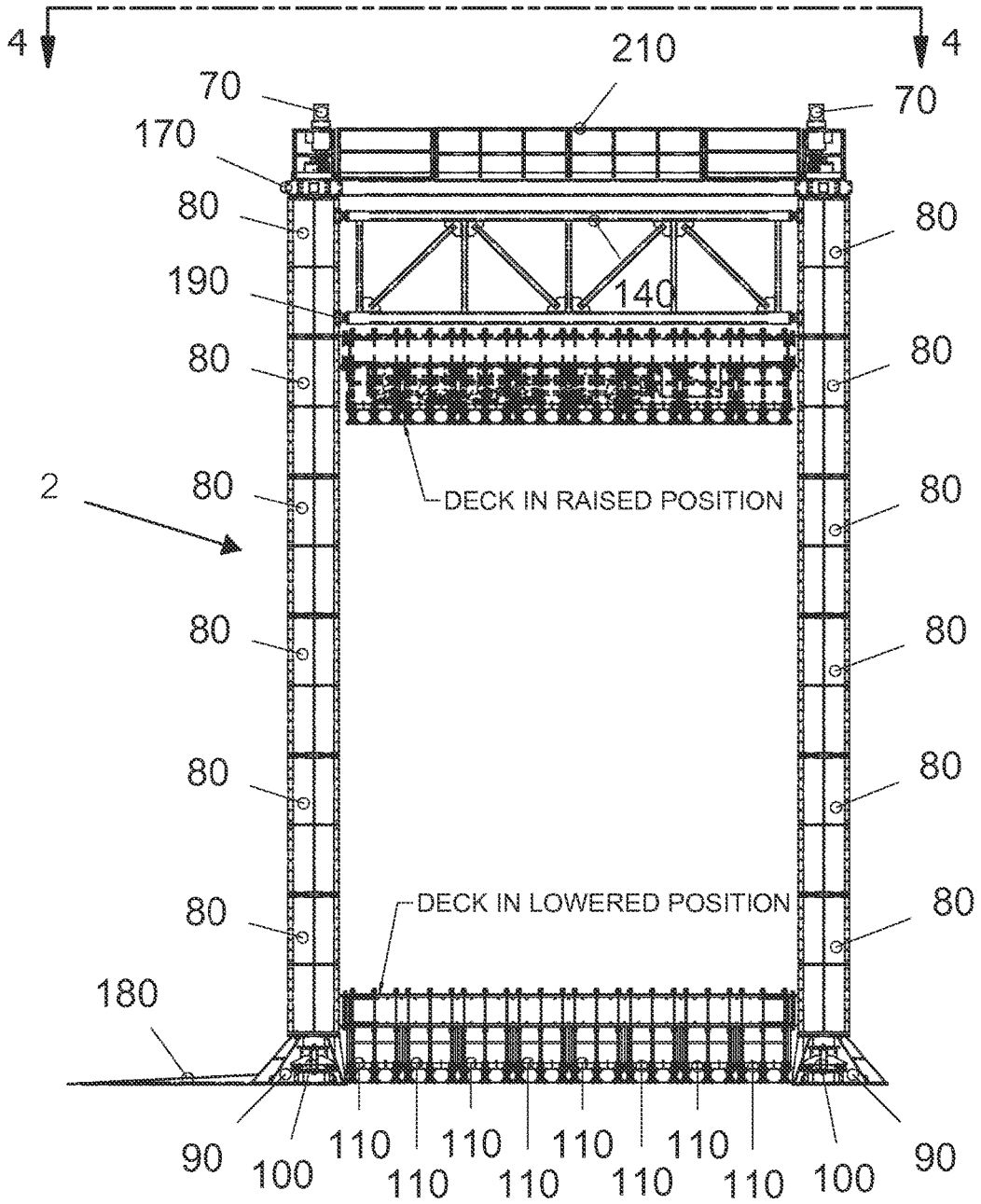
FIG. 2 is a long direction elevation of the PMLS from FIG. 1.

FIG. 2 shows an elevation of the PMLS along the long span with lifting deck platform (which consists of deck panel assemblies 110 and lift beam assemblies 130) depicted in the lowered position as the main view, and—in the highest position achievable with six (6) pipe column assembly 80 sections per vertical support—as an overlay view.

Figure 3:
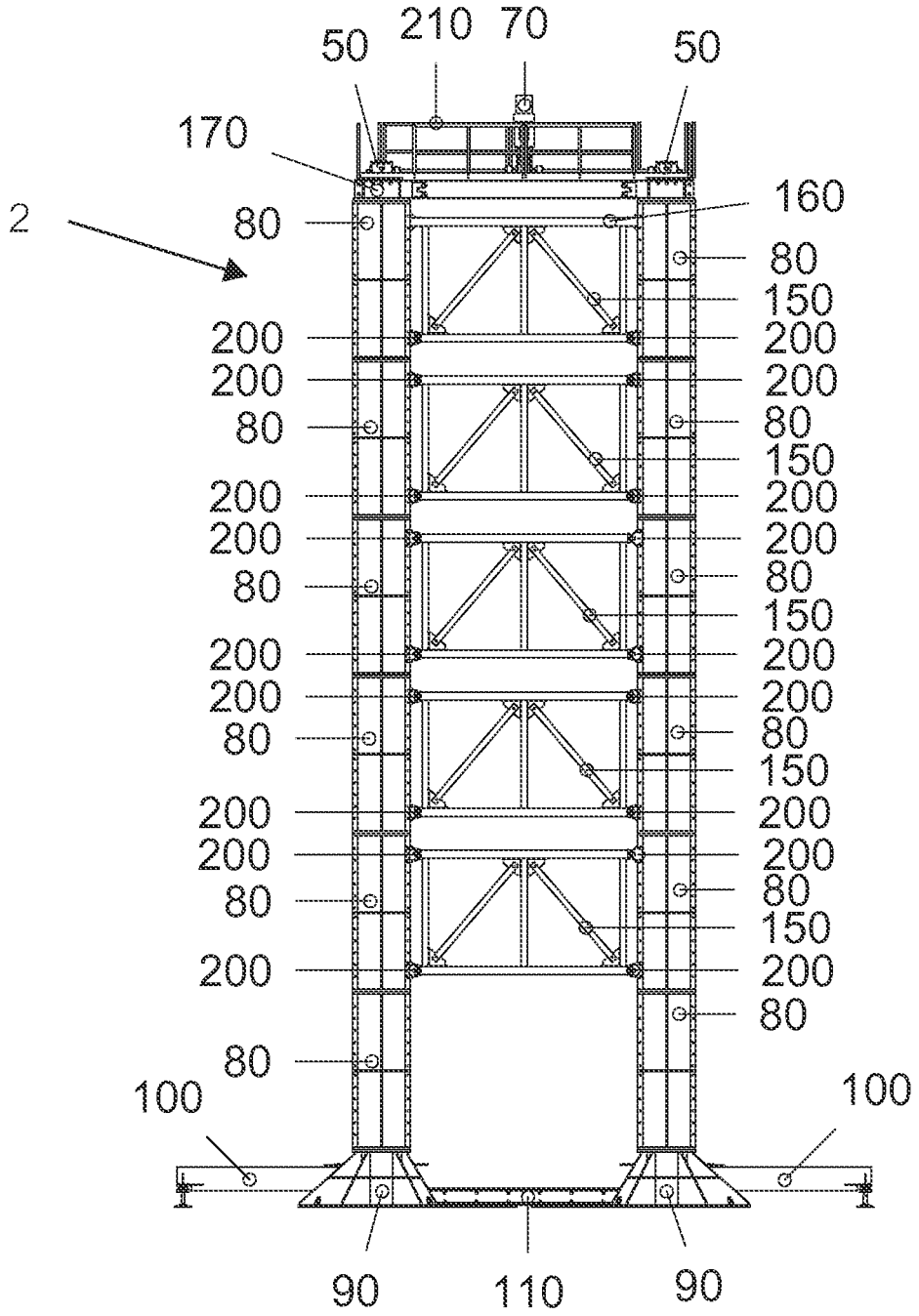
FIG. 3 is a short direction elevation of the PMLS from FIG. 1.

FIG. 3 shows an elevation of the PMLS along its short span, with lifting deck platform (assemblies 110 & 130) depicted in the lowered position. This view reveals a uniform vertically projected array of five (5) short-span truss panels 150, each centered on a given pipe column assembly 80.

Figure 4:
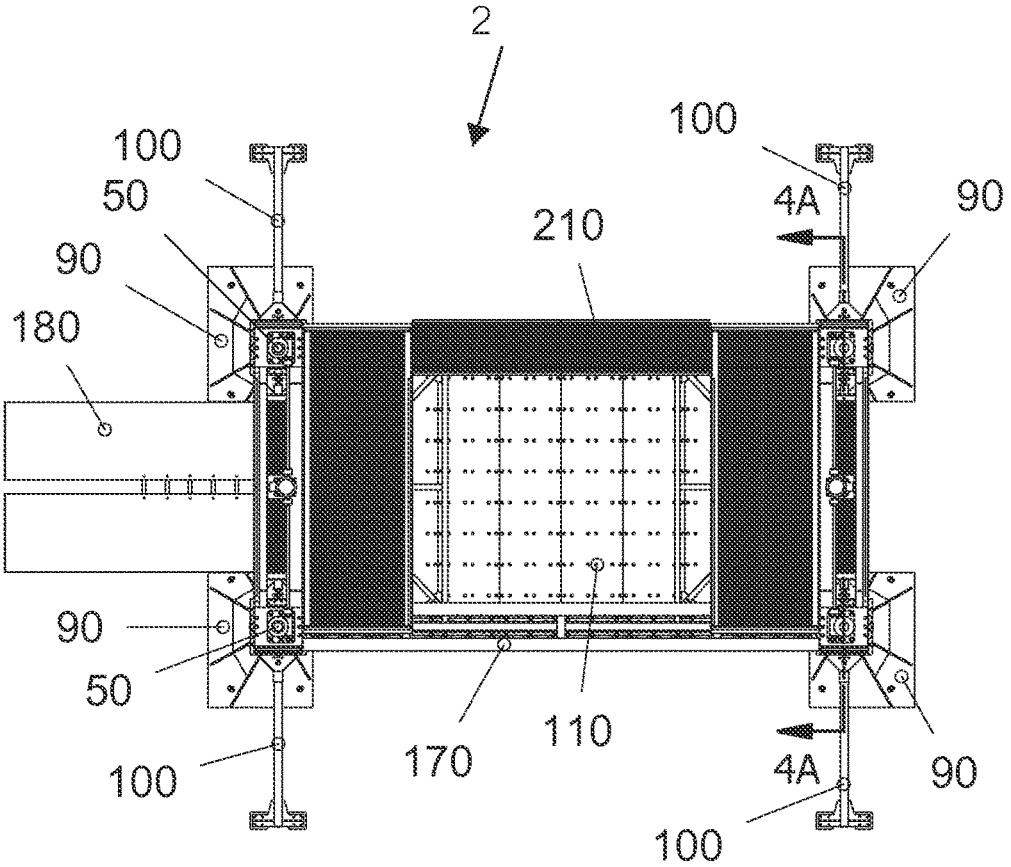
FIG. 4 is a plan view of the PMLS from FIG. 1.
Figure 4A:
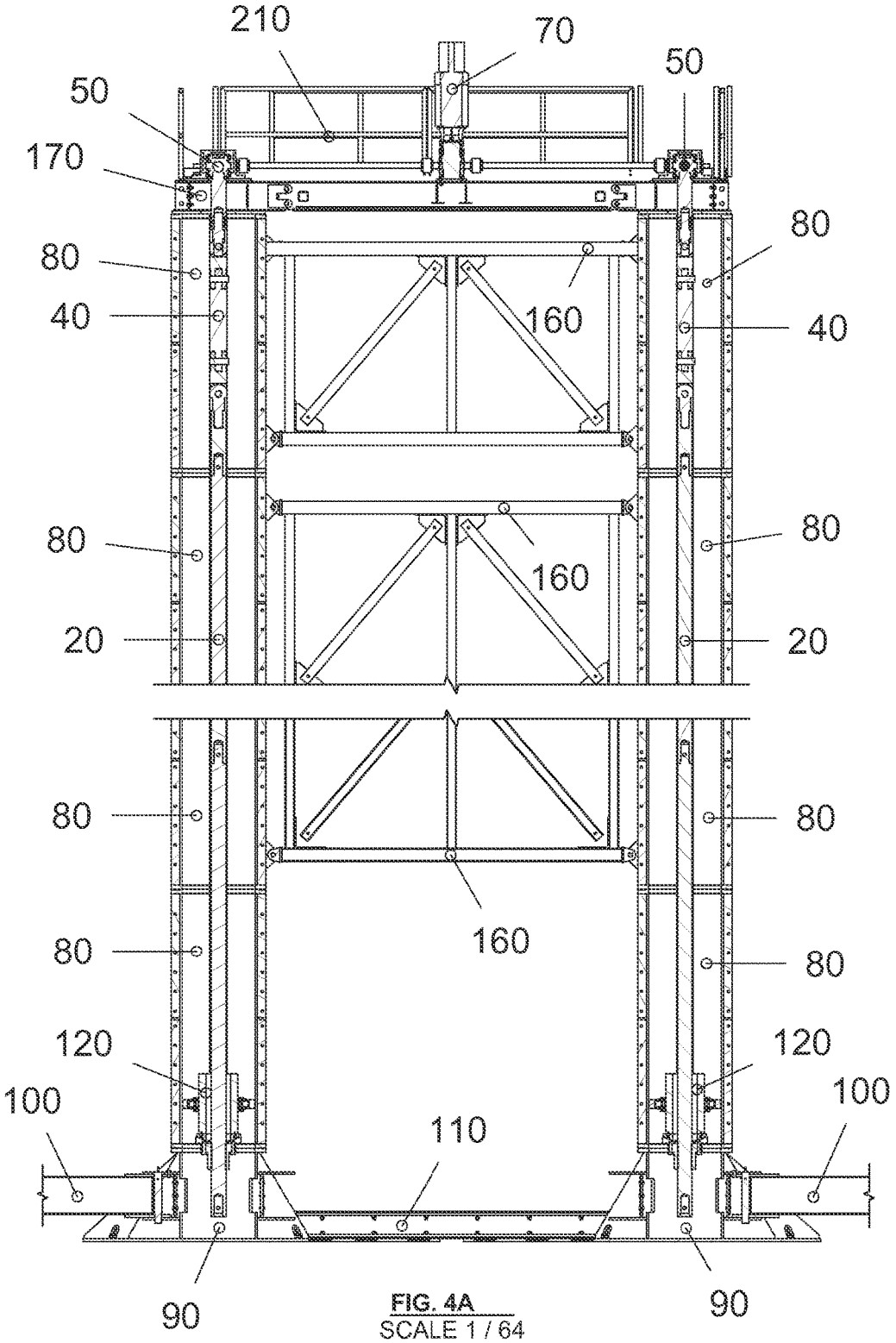
FIG. 4A is a broken sectional view of the PMLS from FIG. 4 taken along section line 4A.

FIG. 4 shows a plan view of the PMLS, which provides general information about the footprint and aspect ratio of the long and short directions. It also shows the top access platform 210 used for personnel and light construction equipment access to the motor components.

FIG. 4-A shows a broken section through one of the short support bays, connecting visually the structure via the continuous line of rotating screw rods 20 from the machine screw actuators 50 on top to the travel nuts 10 at the bottom.

Figure 5:
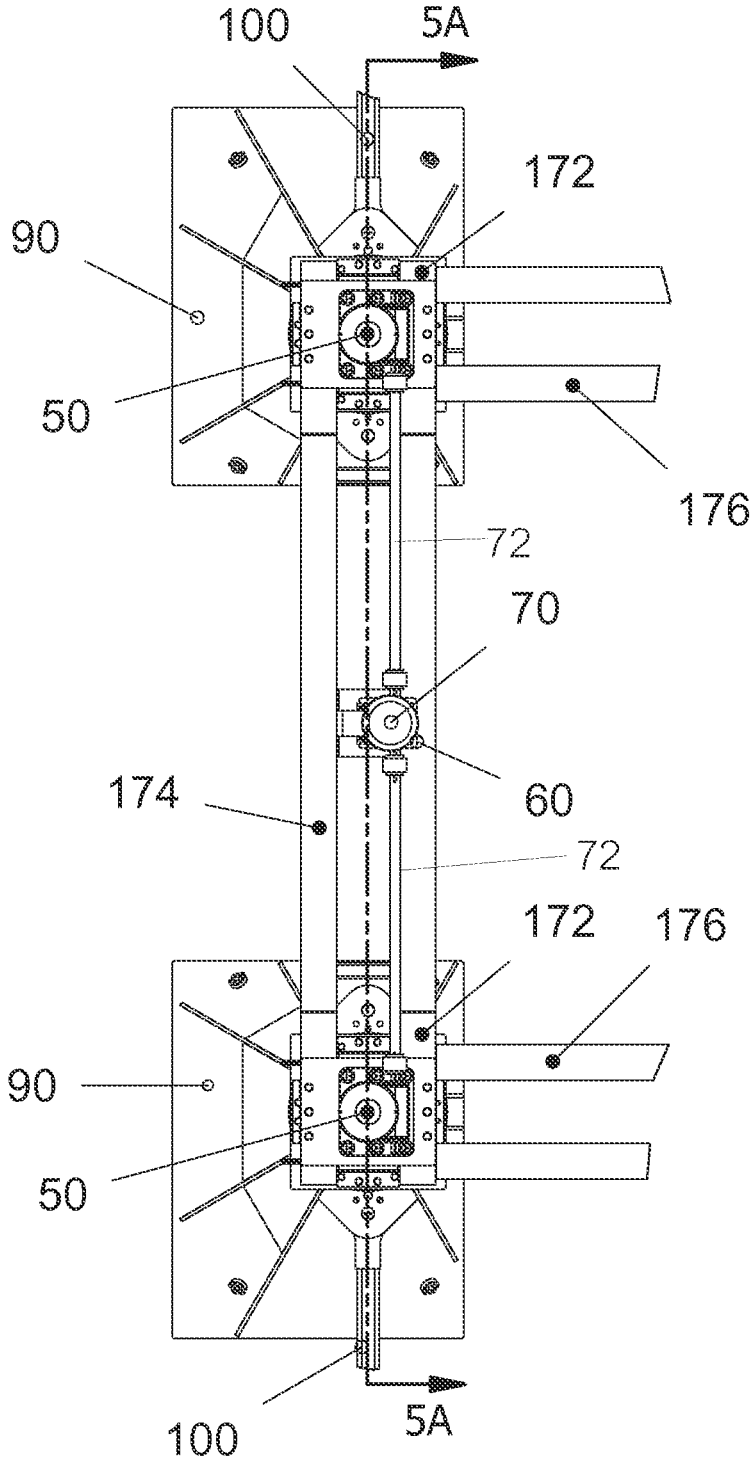
FIG. 5 is a partial plan view of the PMLS from FIG. 1.
Figure 5A:
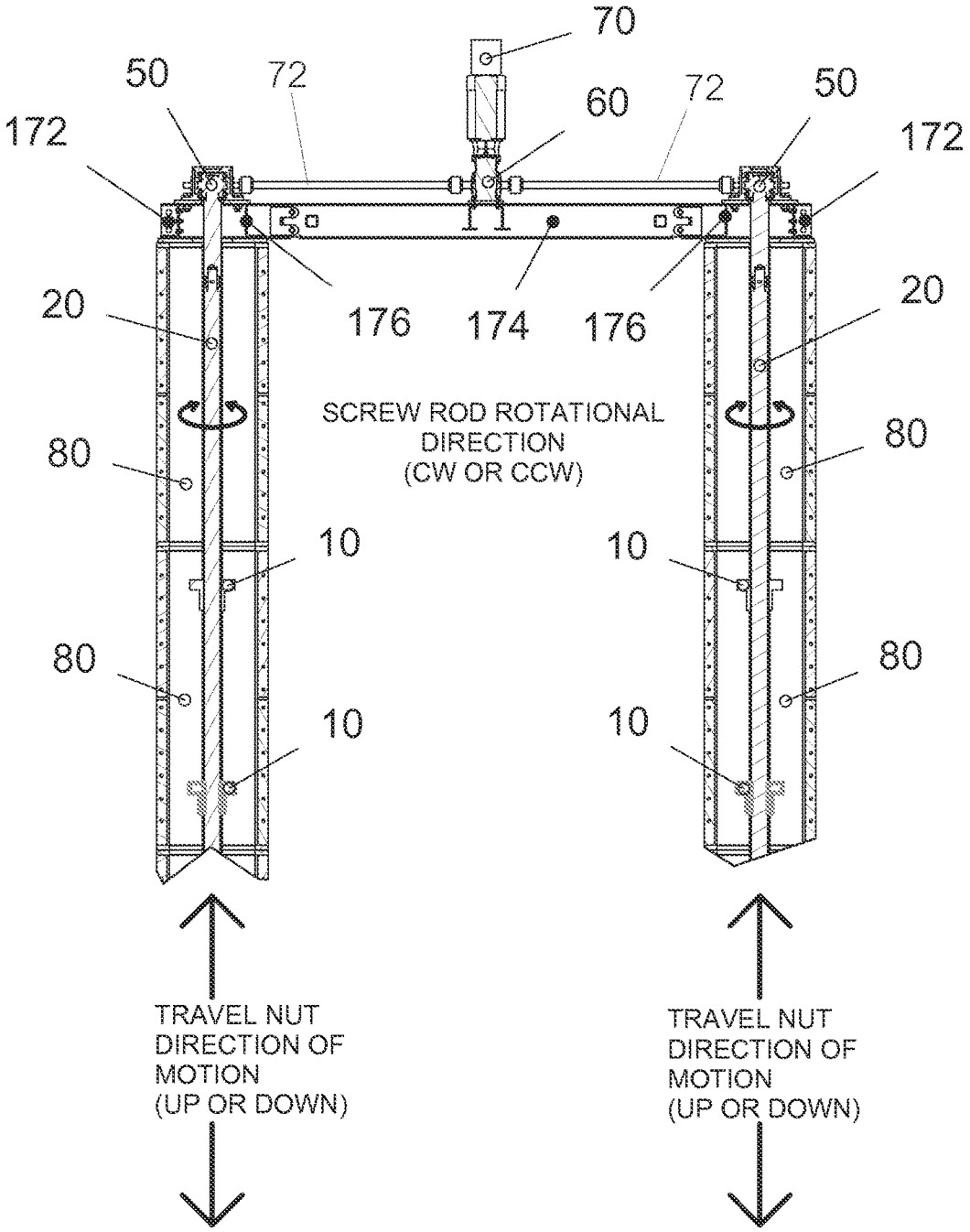
FIG. 5A is a section view of the PMLS from FIG. 5 taken along section line 5A.

FIG. 5 is placed to show the context of the section cut, FIG. 5A, which in itself depicts a motion diagram of the travel nut 10 enabled by rotational motion of the threaded screw rods 20. All four (4) screw rods 20 are synchronized in direction and rate of rotation by coupling rods 72 and the two (2) brake motors 70 in order to enable smooth and even vertical translation.

Figure 6:
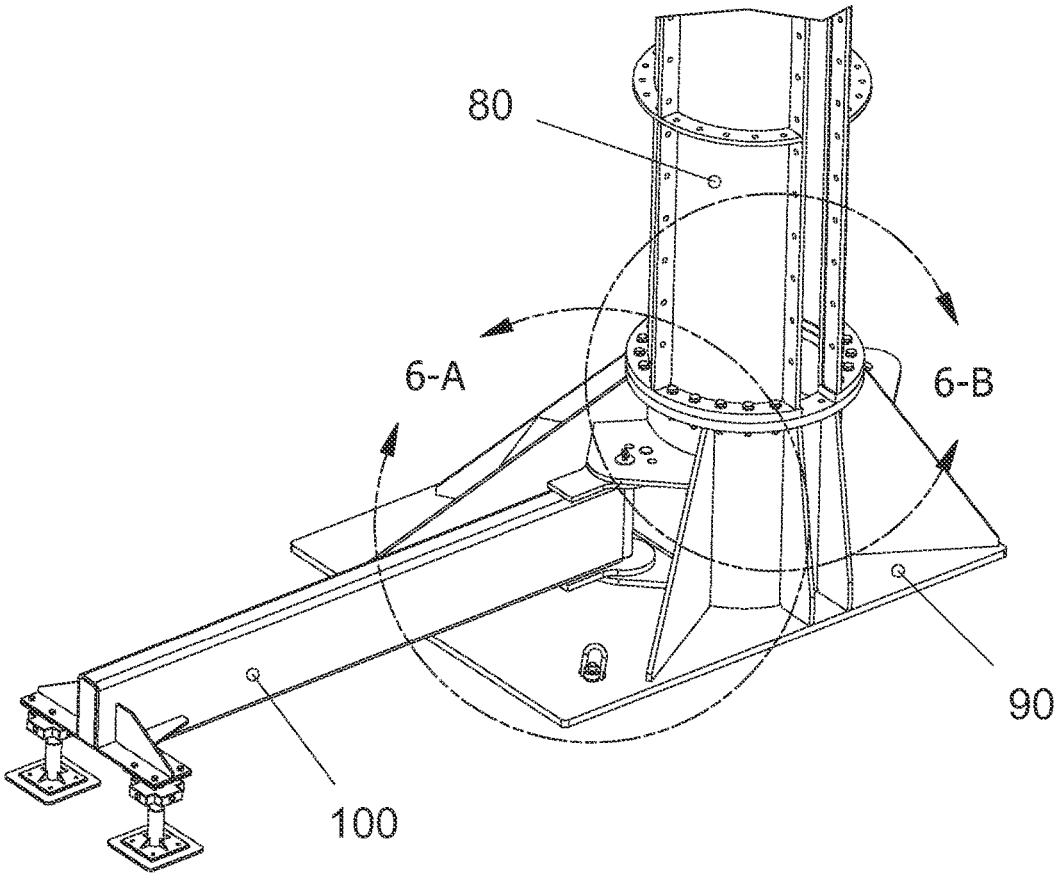
FIG. 6 is a partial isometric view of the PMLS at the base connections.

FIG. 6 shows a close-up view of the column base (consisting of a base pedestal assembly 90 and the lower portion of a pipe column assembly 80), and provides the context for cutout FIGS. 6-A and 6-B.

The cutout FIG. 6-A shows the connection of the base pedestal assembly 90 to the base stabilizing beam 100, which is achieved via a main link pin 102. The main link pin 102 has a narrowed section that positions the main link pin 102 to the appropriate location on the bottom pin cap plate 104B in the vertical direction. The main link pin 102 is shown in more detail in FIG. 29-G, and the link pin connection through the base pedestal attachment plates 96A & 96B on FIG. 7-B. During the connecting process of the base pedestal assembly 90 to the base stabilizing beam 100, the two (2) stabilizer pin cap plates 104A & 104B are aligned with the base pedestal attachment plates 96A & 96B respectively. The main link pin 102 is then inserted through central holes on top plates 96A and 104A and set in place through central holes on bottom plates 104B and 96B. For this configuration, the base stabilizing beam 100 is secured parallel to the short span of the structure by an additional locking pin 106 inserted into the central hole of the aligned base pedestal assembly's 90 top attachment plate 96A and stabilizer beam 100 top pin cap plate 104A. Two (2) additional holes are provided on the top pin cap plate 104A to position the base stabilizing beam 100, seven (7) degrees from the central hole position in either direction. The locking pin 106 secures the base stabilizing beam 100 in its intended position.

The cutout FIG. 6-B shows a typical connection of the base pedestal assembly 90 to the pipe column assembly 80 via an array of twenty-two (22) uniformly spaced fasteners. Gusset plates 94 on the pipe column assembly 80 slot side, referred to as slot side gusset plates 94A, are aligned with the pipe column assembly 80 slot opening before the installation of fasteners.

FIG. 7 shows the partial view through a pipe column assembly 80 and base pedestal assembly 90 for the purposes of providing context to FIG. 7A and enlarged section in FIG. 7B, which shows a cross-section of the stabilizer pin cap plates 104A & 104B and the two (2) connection pins (link pin 102 and locking pin 106).

Figure 8:
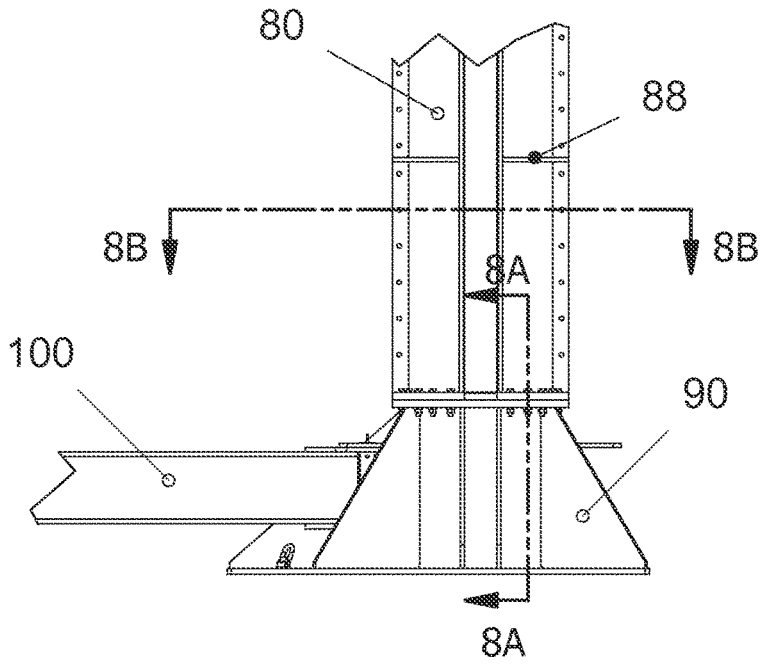
FIG. 8 is a partial side view of the base from the PMLS.
Figure 8A:
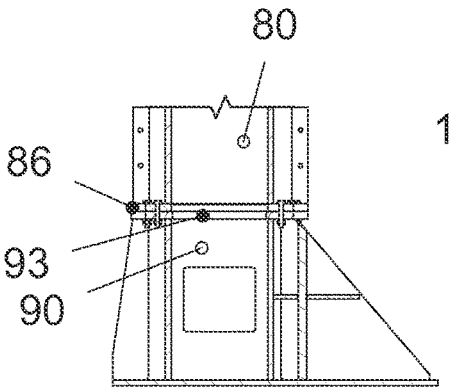
FIG. 8A is a section view of the base from FIG. 8 taken along section line 8A.
Figure 8B:
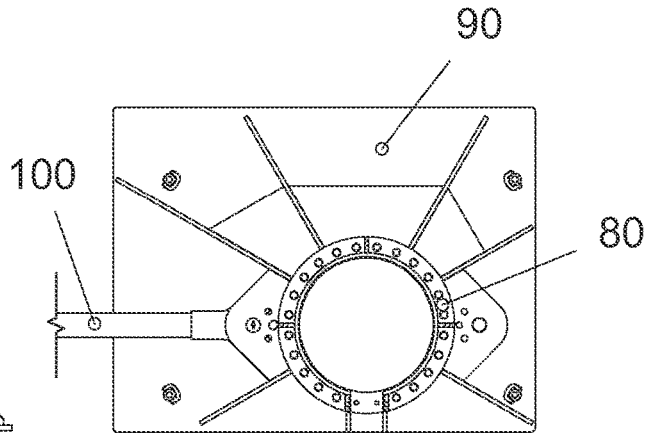
FIG. 8B is a section view of the base from FIG. 8 taken along section line 8B.

FIG. 8 shows the partial side view of a column base (assemblies 80 & 90) for the purposes of providing context to FIG. 8A, which displays a section cut through the base pedestal assembly 90 and the connection fasteners, and to FIG. 8B, which displays a section cut through the pipe column assembly 80 below the column wall rib ring 88.

Figure 9:
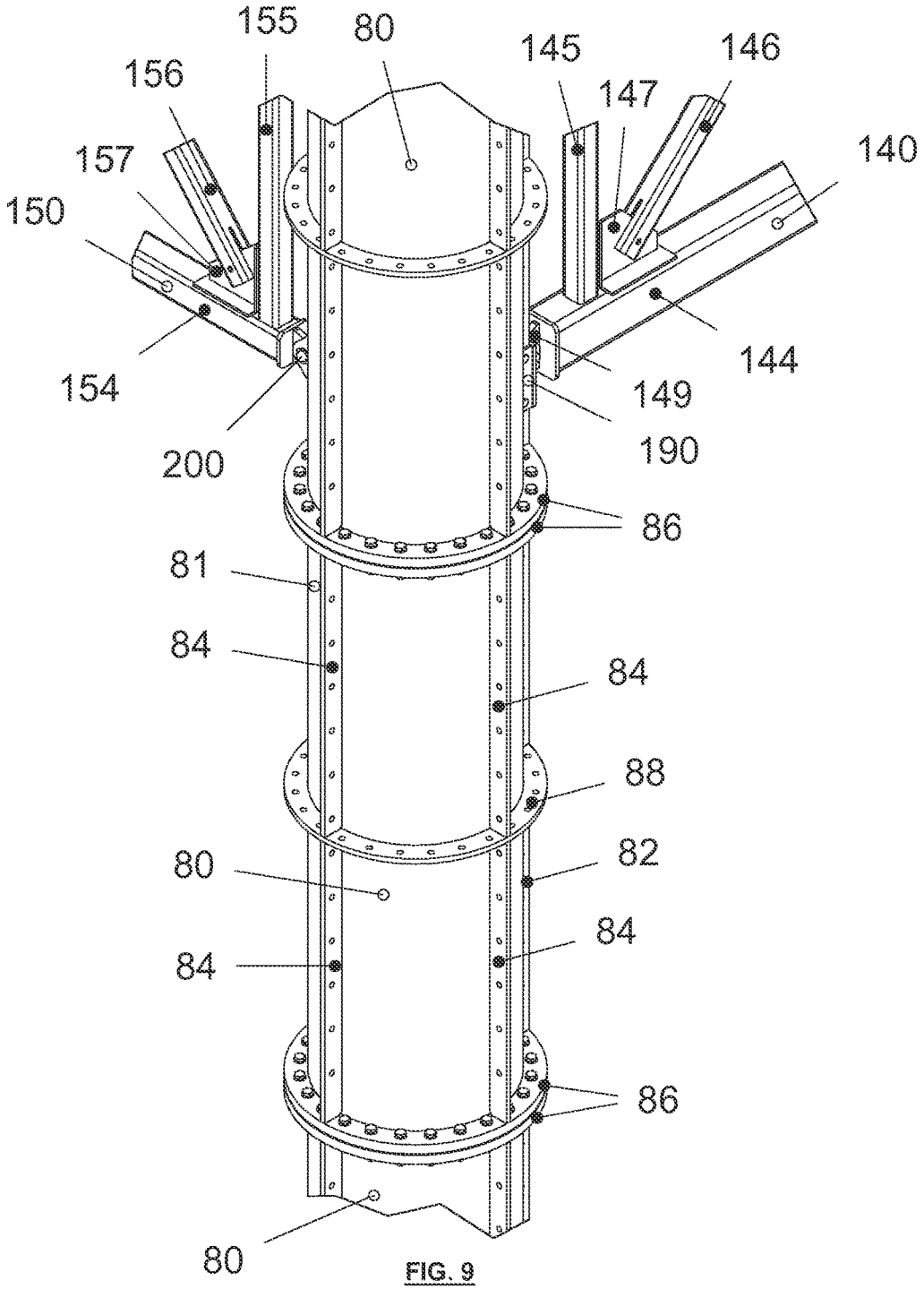
FIG. 9 is a partial view of the PMLS at the modular pipe column connections.

FIG. 9 shows the partial isometric view of three (3) vertically adjacent pipe column assemblies 80, and two (2) typical pipe column assembly 80-to-pipe column assembly 80 connections. In the same manner as in the previous connection, the fasteners are arrayed along the adjoining column flange plates 86. The pipe column assembly 80 slot openings 83 (not shown) defined by column slot vertical stiffeners 82 are all aligned appropriately.

Figure 10:
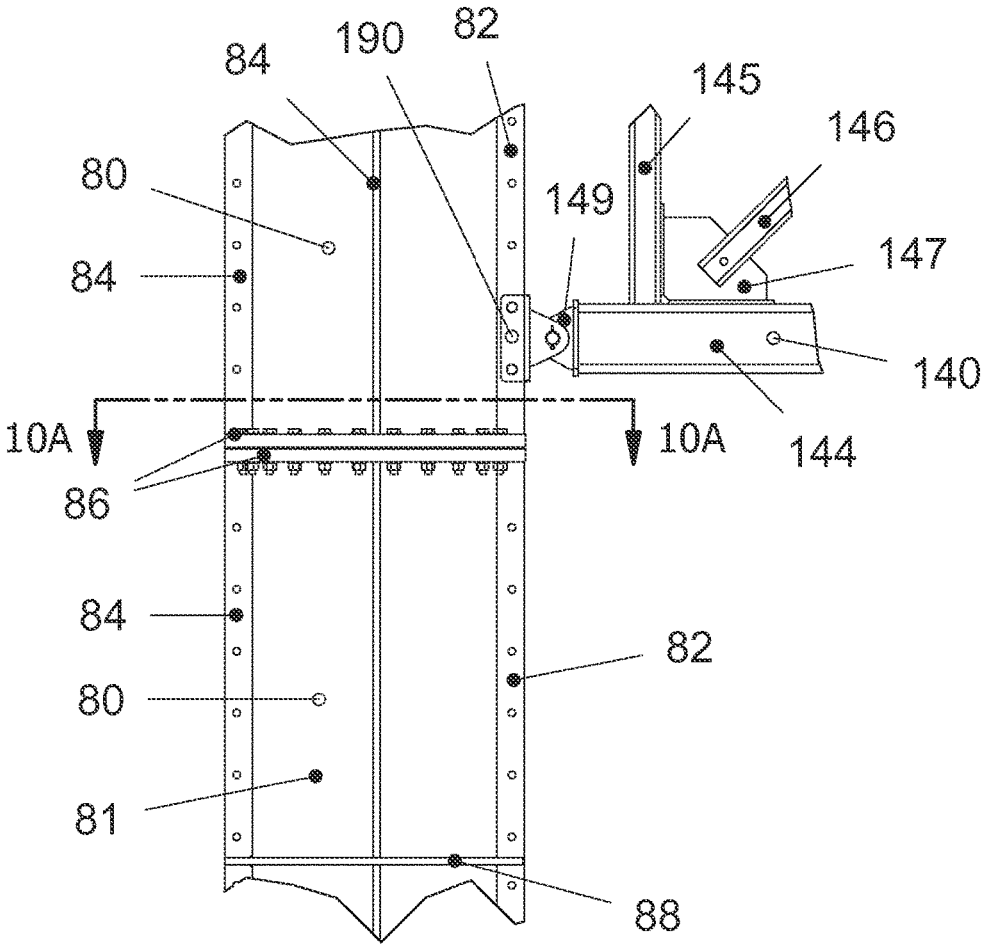
FIG. 10 is a partial side view of the pipe column to pipe column connection
Figure 10A:
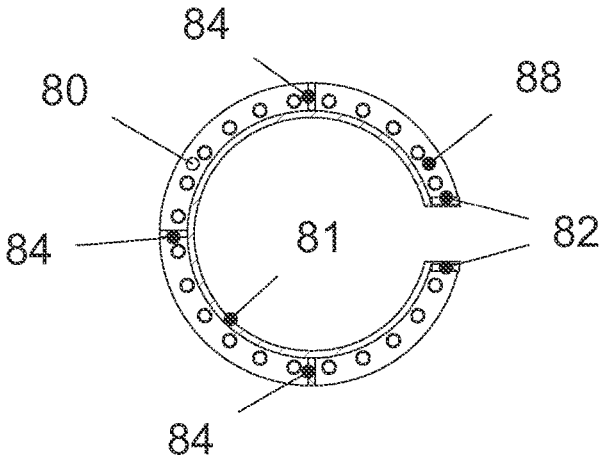
FIG. 10A is a section view of the connection from FIG. 10 taken along section line 10A.

FIG. 10 shows one of the pipe column assembly 80-to-pipe column assembly 80 connections in a partial orthographic view of a pipe column assembly 80 in order to provide context for the section cut which is FIG. 10A.

Figure 11:
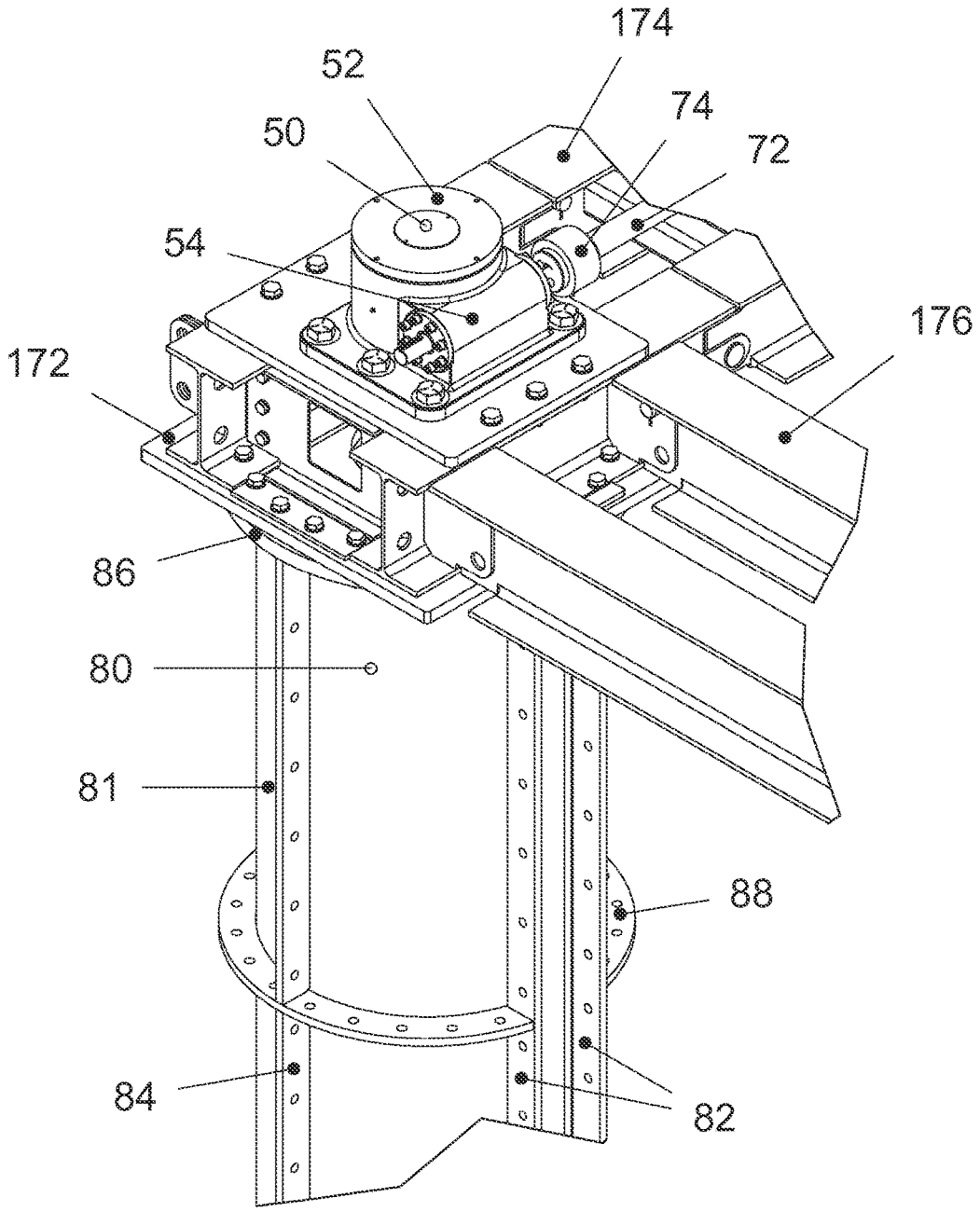
FIG. 11 is a partial isometric view of the PMLS at the pipe column and actuator frame connection.

FIG. 11 shows a partial view of the PMLS at the top corner of a pipe column assembly 80 that connects to the top actuator frame assembly 170 via an array of fasteners arranged in the same way as in the pipe column assembly 80 to base pedestal assembly 90 connection and in the pipe column assembly 80 to pipe column assembly 80 connection.

Figure 12:
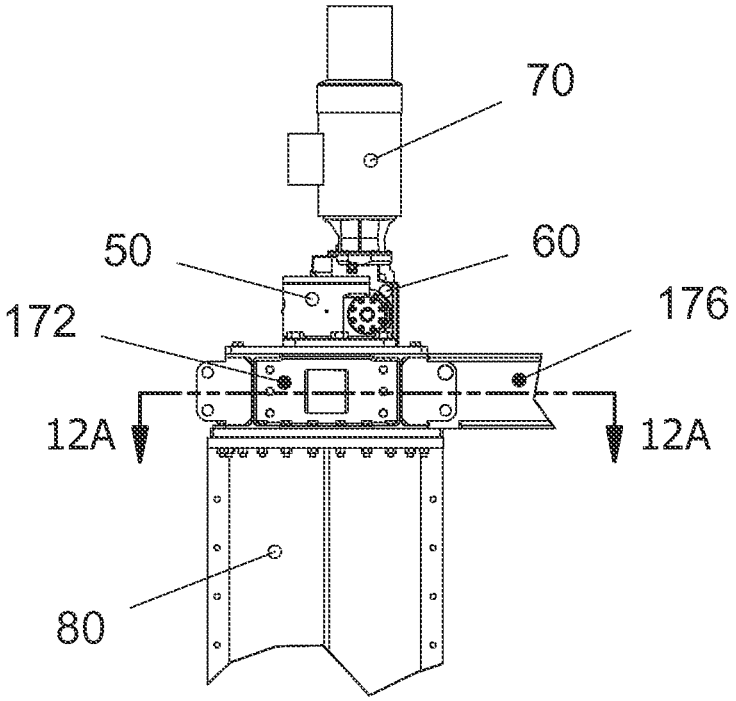
FIG. 12 is a partial side view of the pipe column to top actuator frame connection.
Figure 12A:
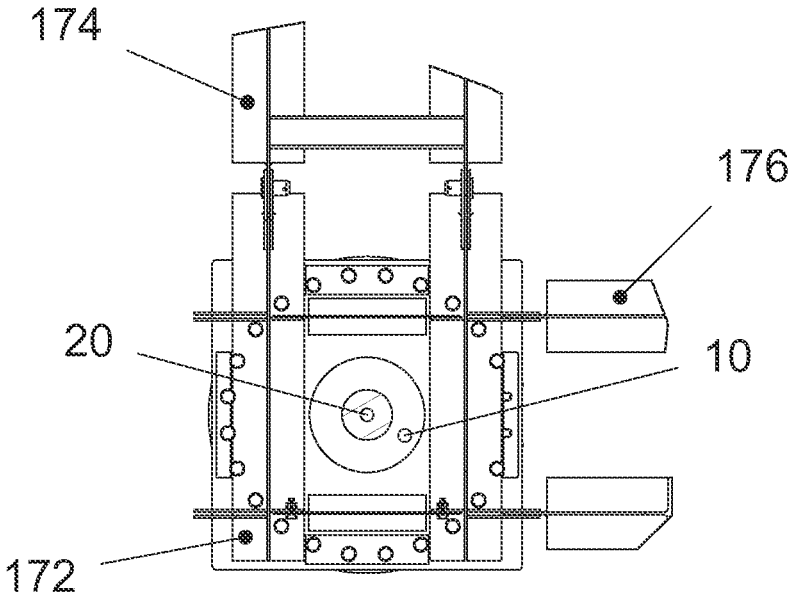
FIG. 12A is a section view of the connection from FIG. 12 taken along section line 12A.

FIG. 12 shows a partial side view of the PMLS at the top corner of a pipe column assembly 80 that connects to the actuator frame assembly 170 in order to provide context for the section cut FIG. 12A, which shows the array of twenty-four (24) fasteners through the bottom flanges of actuator frame corner beams 171, and actuator frame shim plates.

FIG. 13 shows a partial isometric view of the assembly at the two top corners along the short span of the PMLS. This provides the context for the cutout details, FIG. 13-A, FIG. 13-B, and FIG. 13-C.

FIGS. 13-A and 13-C show the connection of the machine screw actuator 50 to the actuator frame top plate 173 via six (6) fasteners per machine screw actuator 50. The fastener holes on the actuator frame top plate 173 are positioned such that the main cylinder 52 of the machine screw actuator 50 is aligned with the central axis of the pipe column assembly 80.

FIG. 13-B shows the connection of the worm gear reducer 60 to the actuator frame gear box plate 175 via four (4) fasteners. The worm gear reducer 60 is positioned on the top actuator frame assembly 170 so that each coupling rod 72 extends towards and attaches to the machine screw actuator's 50 secondary horizontal cylinder 54.

Figure 14:
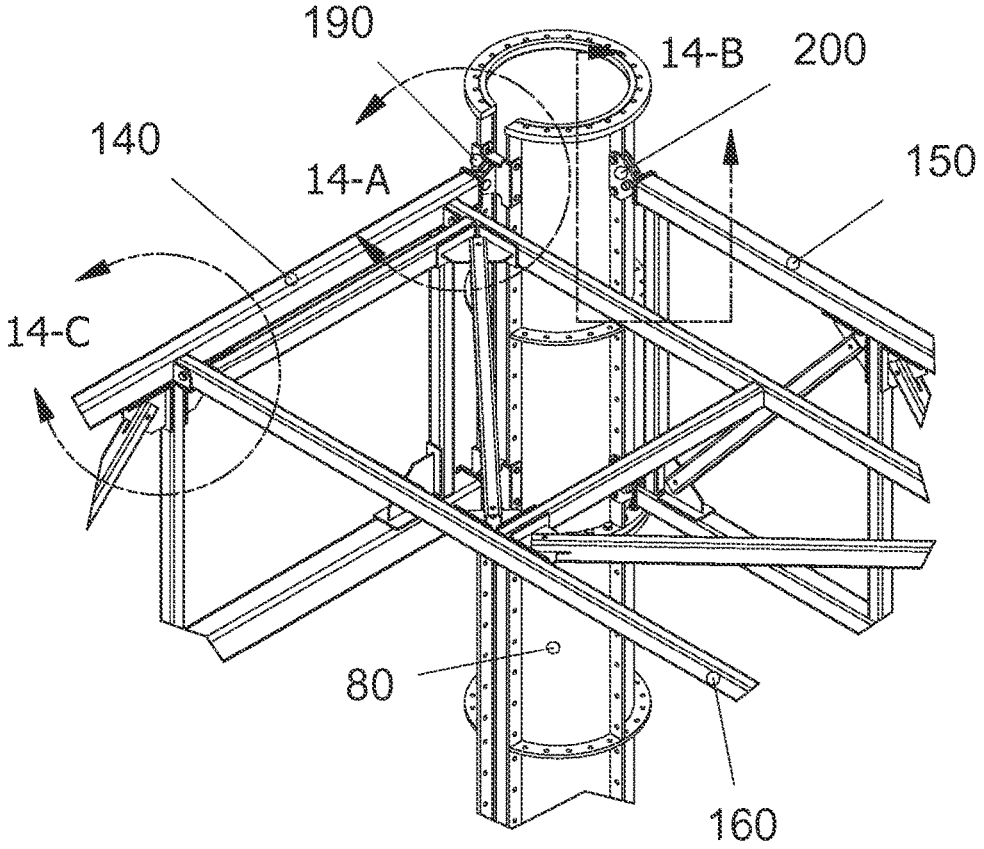
FIG. 14 is a partial isometric view of the PMLS at the pipe column to truss connections, and at the truss to K-brace connection.

FIG. 14 shows the partial isometric view of the PMLS with the top actuator frame assembly 170 removed for visual clarity. It provides the context for the cutout details which show different brace (long-span truss panel 140, short-span truss panel 150 & K-brace panel 160) connections.

FIG. 14-A shows the connection of the long-span truss 140 to the pipe column assembly 80 via a column slot adaptor 190. The long-span truss top chord 142 and long-span truss bottom chord 144 (not shown) connect to separate column slot adaptors 190 via a slot adaptor pin 194. Four (4) smaller pins, referred to as column slot pins 196, secure the column slot adaptor bracket 192 to the column slot vertical stiffeners 82.

FIG. 14-B shows the connection of a short-span truss panel 150 to a column vertical rib 84. The short-span truss top chord 152 and the short-span truss bottom chord 154 (not shown) connect through separate short-span truss panel lugs 159 to the column rib bracket 200 via a rib bracket pin 201. Two (2) bolts that are inserted into properly aligned holes of involved components secure the two (2) rib bracket plates 202 to the column vertical rib 84. Each rib bracket plate 202 is positioned on a different side of a column vertical rib 84.

FIG. 14-C shows the connection of a K-brace panel 160 to the long-span truss top chord 142. The rectangular hollow steel tube that comprises the long-span truss top chord 142 has four (4) shelf brackets 148 welded to its face oriented towards the inside of the PMLS frame at each end section of the long-span truss top chord 142. The shelf brackets 148 have holes that align with holes on the K-brace main chords 162. A fastener is inserted through the holes, thereby securing the K-brace panels 160 to the long-span truss panel 140, and ultimately to the PMLS.

Figure 15:
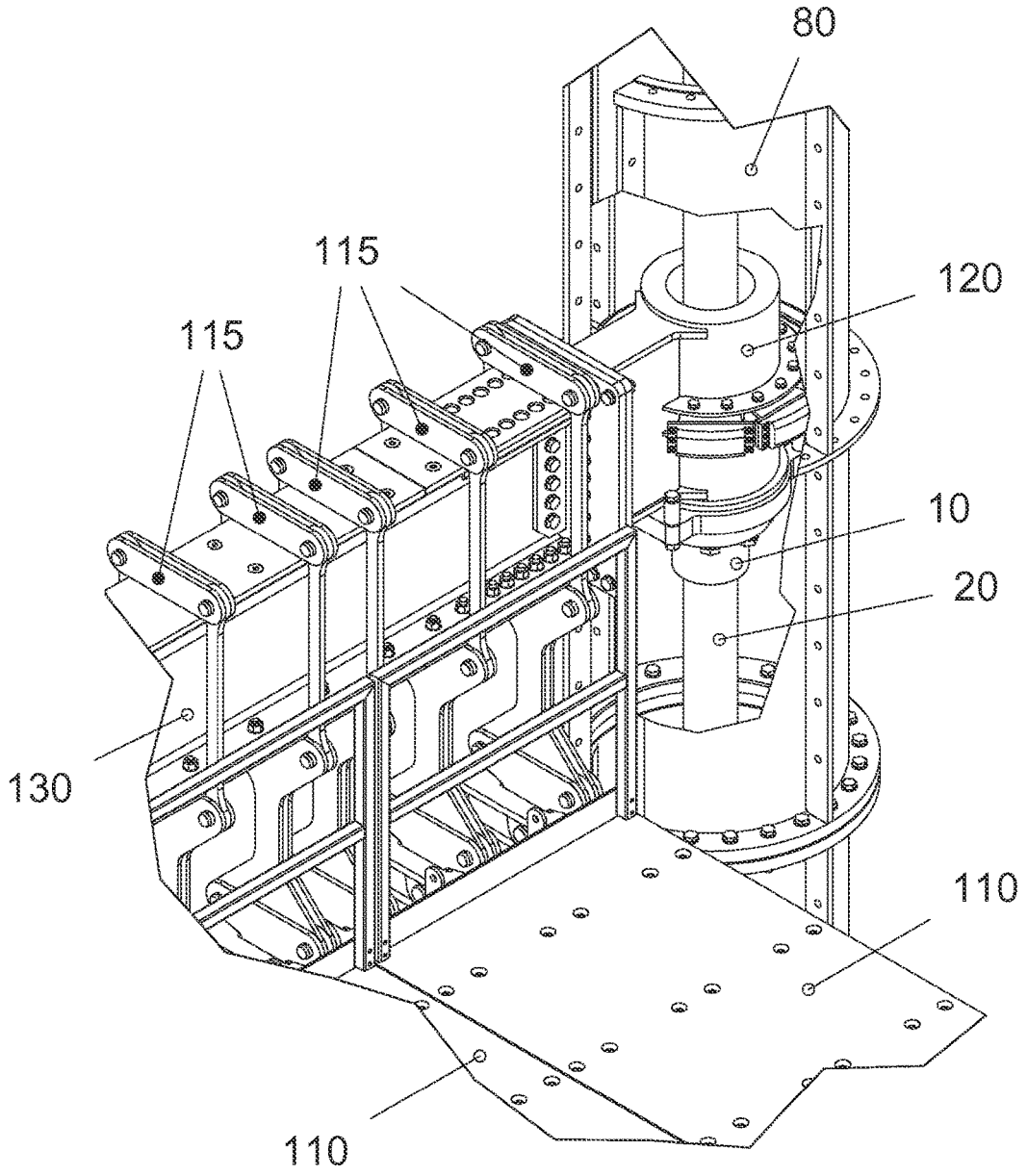
FIG. 15 is a partial isometric view of the travel nut to the nut bracket connection.

FIG. 15 shows a partial isometric view of the travel nut 10 to the travel nut bracket assembly 120 connection, with a break-out through the pipe column wall 81 for greater visual clarity.

Figure 16:
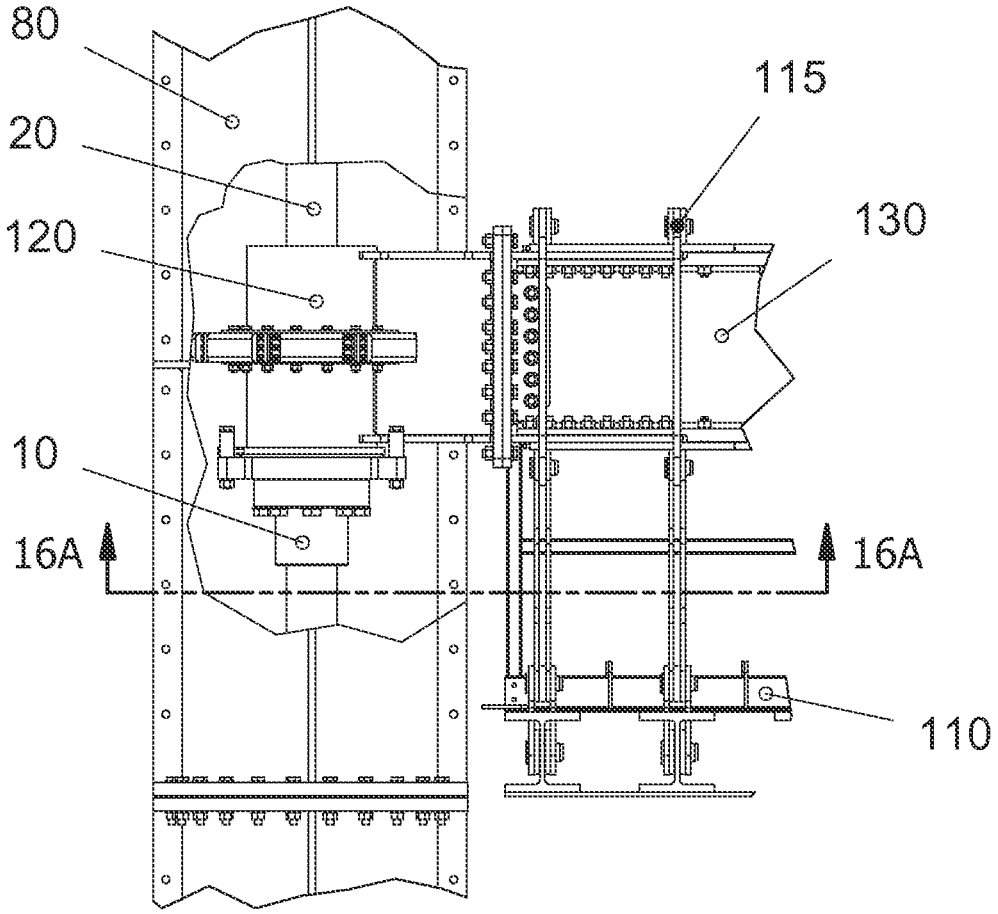
FIG. 16 is a partial side view for the travel nut to the nut bracket connection.
Figure 16A:
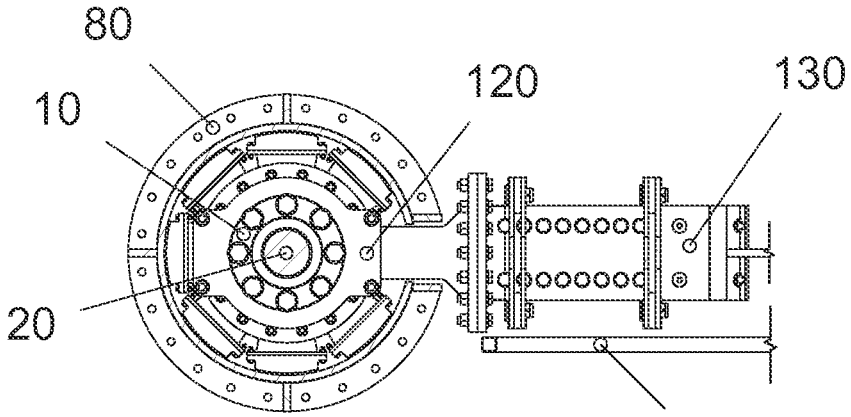
FIG. 16A is a section view from FIG. 16 taken along section line 16A.
Figure 17:
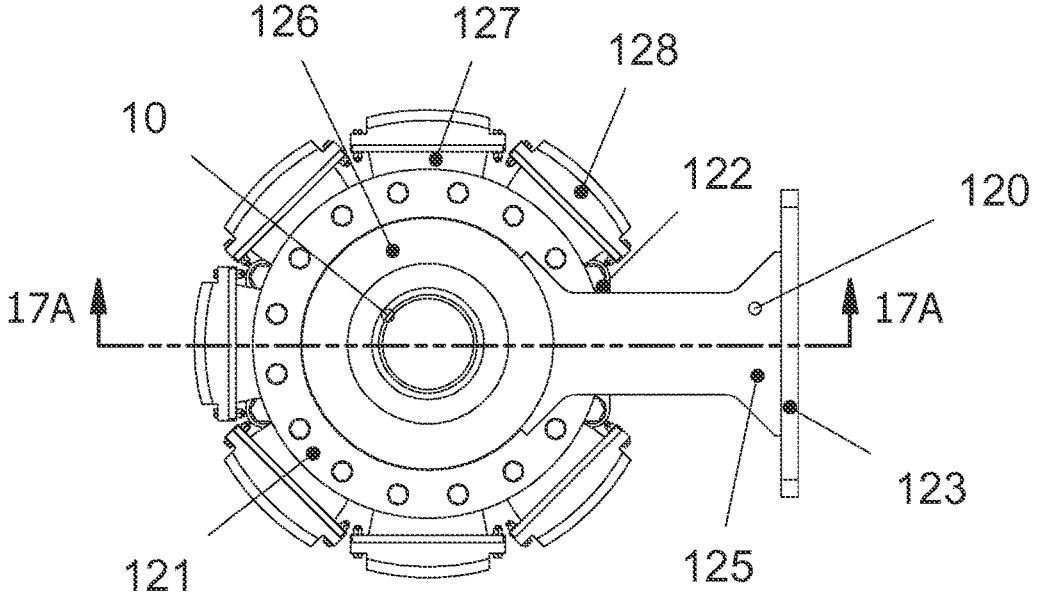
FIG. 17 is a plan view of the nut bracket assembly.

FIG. 16 shows a partial orthographic view of the travel nut 10 to the travel nut bracket 120 connection, with a break-out through the pipe column wall 81 to show the location of the connection viewed from the side. It also provides the context of the section cut, FIG. 16A, taken at the bottom of the travel nut 10 looking upward. The travel nut 10 has eight (8) holes through its top portion, which are aligned with the bottom holes of the travel nut bracket rocker plate 122 (as seen in FIG. 17). The fasteners that terminate within the material of the travel nut bracket rocker plate 122 secure the two (2) components together. This connection in turn secures the travel nut 10 into a static position, allowing the screw rod 20 to rotate freely and in doing so to engage the threads of the travel nut 10. This interaction between the rotationally static travel nut 10 and the rotating screw rod 20 enables the desired upward or downward motion of the travel nut 10 and the lifting deck platform (assemblies 110 & 130) which is suspended from it.

FIG. 17 shows only the travel nut bracket assembly 120 and the travel nut 10 in plan view taken from the top of the assembly. This provides the context to the section cut, FIG. 17A, which is taken through the two (2) diametrically opposite travel nut bracket rocker plate 122 to travel nut 10 fasteners in order to show their engagement of the two (2) components. The section also shows the fasteners that connect the travel nut bracket rocker plate 122 to the travel nut bracket rocker cone 124.

Figure 18:
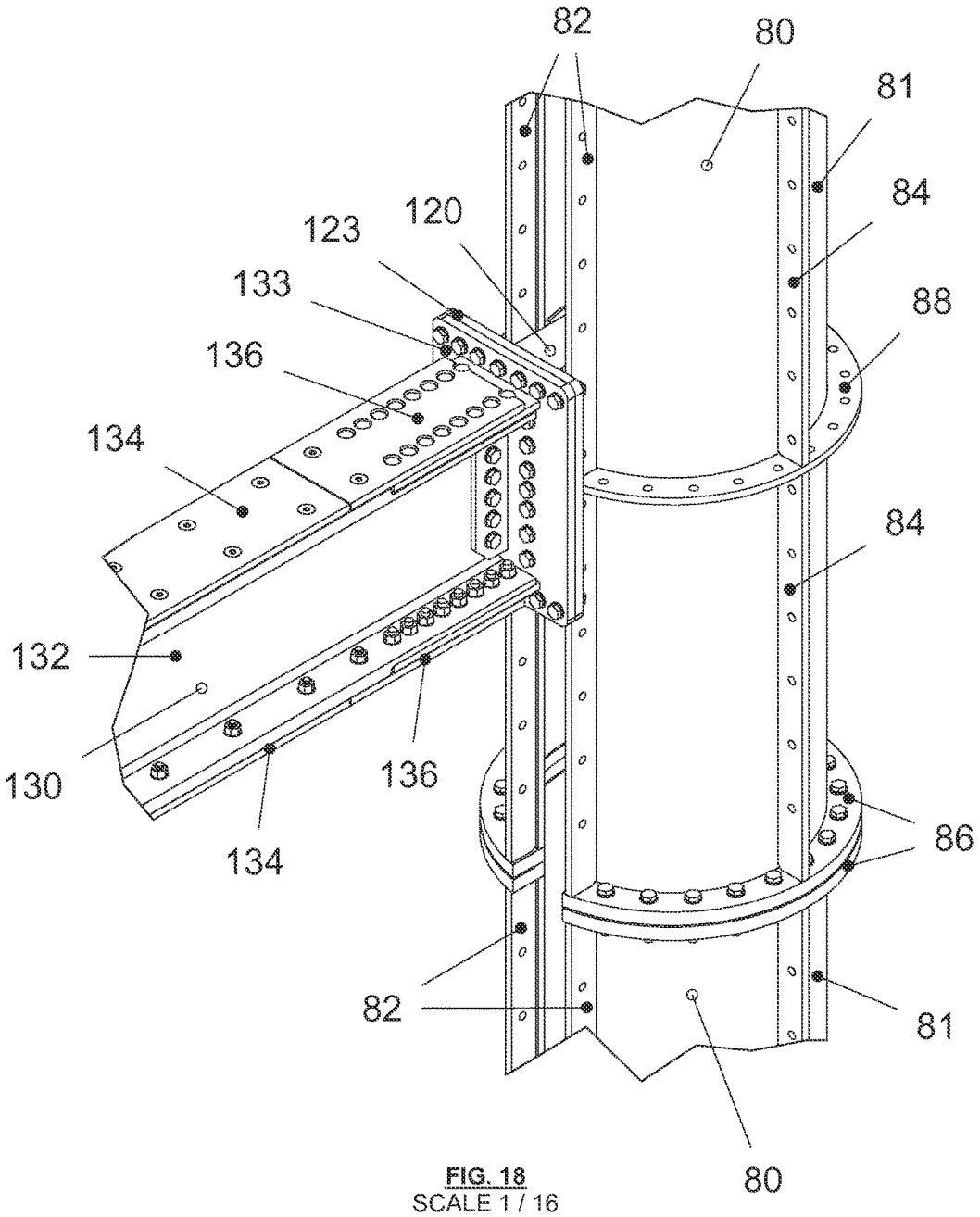
FIG. 18 is a partial isometric view of the nut bracket to lift beam connection.

FIG. 18 shows a partial isometric view of the assembly at the travel nut bracket assembly 120 to lift beam assembly 130 connection via each component's end plate (travel nut bracket end plate 123 and lift beam end plate 133). The two (2) end plates (components 123 & 133) are identical in material, thickness, and bolt hole patterns.

Figure 19:
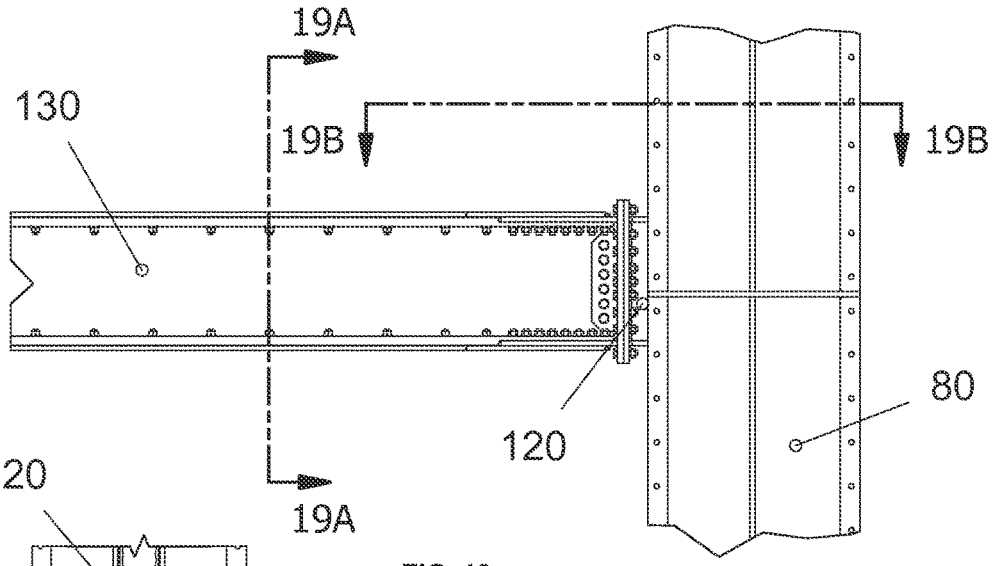
FIG. 19 is a partial side view of the nut bracket to lift beam connection.
Figure 19A:
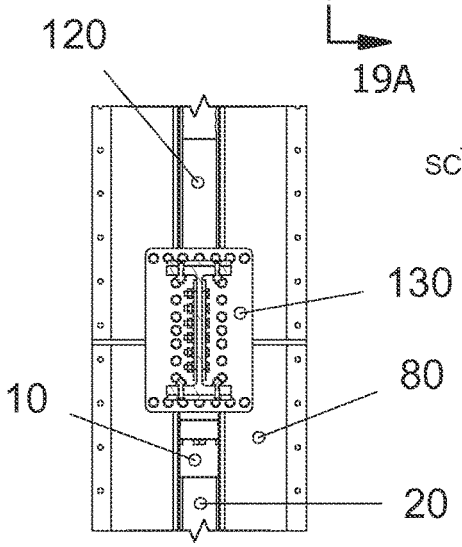
FIGS. 19A and 19B are section views from FIG. 19 taken along corresponding section lines.
Figure 19B:
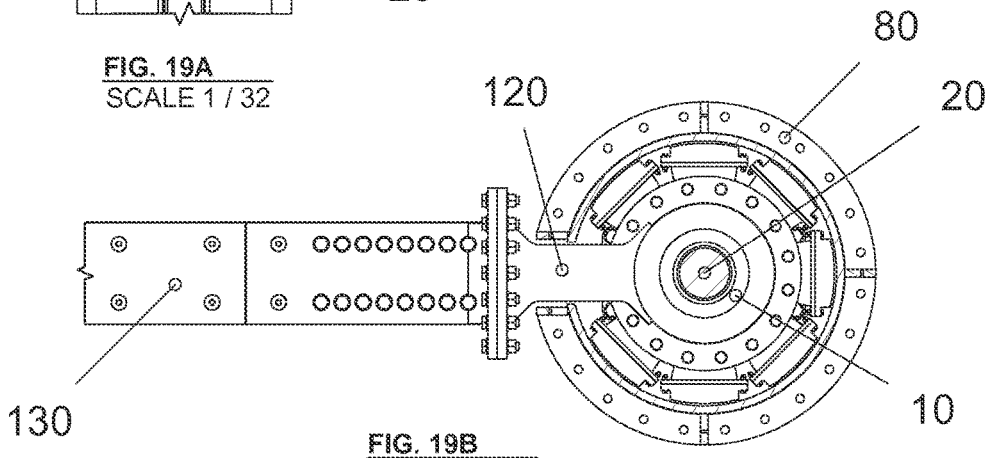

FIG. 19 shows a partial orthographic view of the assembly at the travel nut bracket assembly 120 to the lift beam assembly 130 connection, and provides context to the section cuts, FIG. 19A and FIG. 19B.

FIG. 19A shows a section view through the main span of the lift beam assembly 130, which delineates the lift beam end plate 133 and travel nut bracket end plate 123 bolt patterns, as well as the general fastening arrangement of the lift beam assembly's 130 subcomponents: lift beam rolled section 132, lift beam cover plates 134, lift beam flange plates 135, lift beam end plate tabs 136, and lift beam end cover plates 137 (shown in FIGS. 32 and 32A).

FIG. 19B shows an enlarged section view through the pipe column assembly 80 looking down on the connection, and showing both the top row of the lift beam end plate 133 bolts, and the lift beam cover plate 134 to lift beam rolled section 132 countersunk fasteners.

FIG. 20-A shows a partial side view of the PMLS at the lift beam assembly 130 to travel nut bracket assembly 120 connection, with a break-out through the pipe column assembly 80, to delineate the rotational degrees of freedom of the travel nut bracket assembly 120 with respect to the travel nut 10. In this configuration, the travel nut bracket assembly 120 is positioned so that its central axis is coincident with the central axis of the screw rod 20.

FIG. 20-B also shows a partial side view of the PMLS at the lift beam assembly 130 to travel nut bracket assembly 120 connection, with a break-out through the pipe column assembly 80 to delineate the rotational degrees of freedom of the travel nut bracket assembly 120 with respect to the travel nut 10. In this configuration, the travel nut bracket assembly 120 is positioned so that it allows for a rotation of the lift beam assembly 130 in its transverse plane due to its natural sag when loaded in the said plane, without engaging the travel nut 10 and imparting strains on the screw rod 20.

Figure 17A:
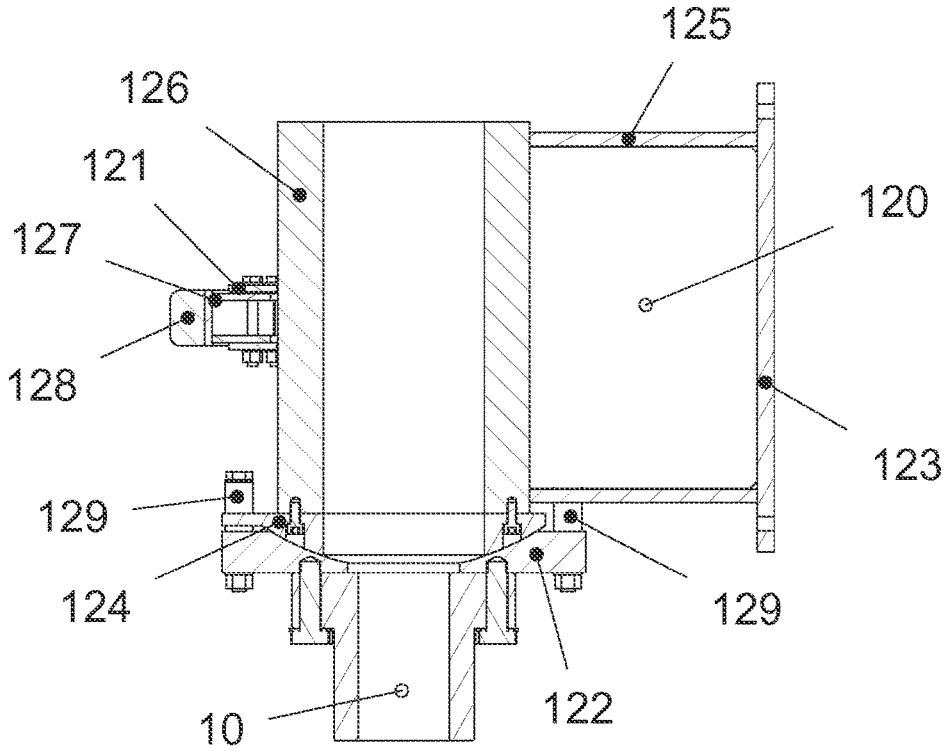
FIG. 17A is a section view from FIG. 17 taken along section line 17A.

The nature of the sliding connection between the travel nut bracket rocker plate 122 and the travel nut bracket rocker cone 124, depicted most descriptively in FIG. 17A, allows for rotation of the travel nut bracket assembly 120 above the travel nut bracket rocker plate 122 in all three (3) principal directions. FIG. 19B shows the clearance between the travel nut bracket sleeve 125 and the pipe column assembly 80 opening, which sufficiently accommodates the relatively small lateral deflection of the lift beam assembly 130 due to wind and other lateral loads, as well as even smaller twisting (rotation with respect to the lift beam assembly's 130 long axis) due to unbalanced distribution of loads. In addition, FIG. 15 and FIG. 17A show an ample void inside of the travel nut bracket hollow cylinder 126, which encloses the screw rod 20 along the travel nut bracket hollow cylinder's 126 height. However, because the loads imparted on the lift beam assembly 130 are primarily in the transverse plane direction, and the displacements due to out-of-transverse-plane loads are comparatively miniscule, only the most pronounced rotation is shown visually.

Figure 21:
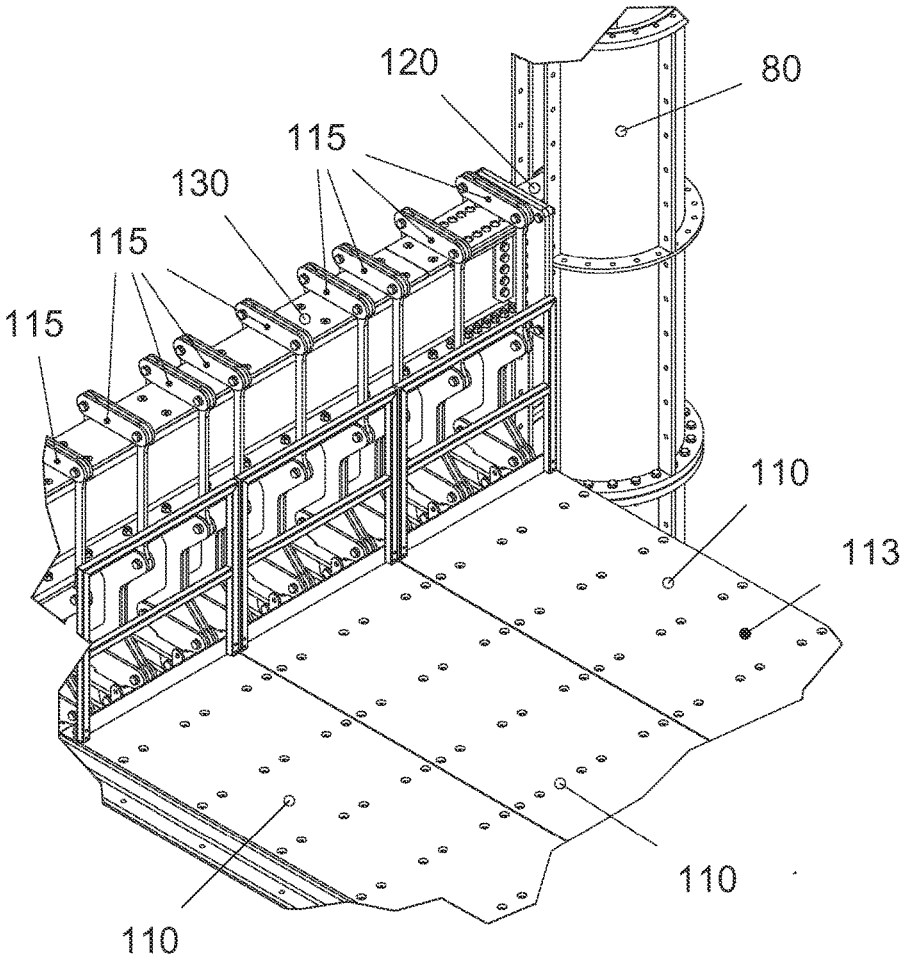
FIG. 21 is a partial isometric view of the lift beam to the deck panels connection.

FIG. 21 shows a partial isometric view of the PMLS at the deck panel assembly 110 to lift beam assembly 130 connection. The lift beam assembly 130 is "strung through" the deck panel supporting links 115, which are dimensioned so that a tight but smooth fit is achieved. The current configuration and lift beam assembly 130 dimensions (length, depth and width) are suitable for an array of eight (8) deck panel assemblies 110.

Figure 21B:
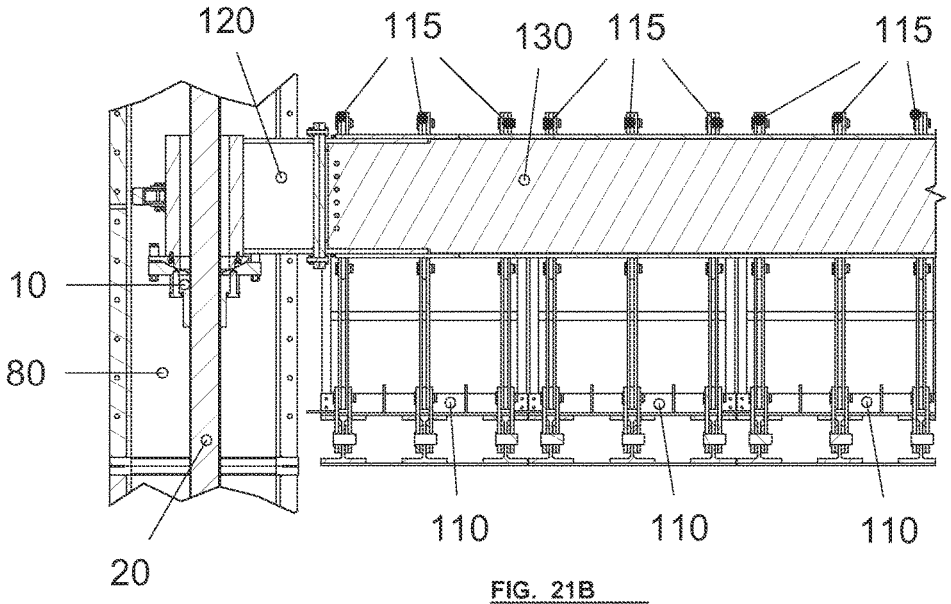
FIGS. 21B and 21C are section views from FIG. 21-A taken along corresponding section lines.
Figure 21C:
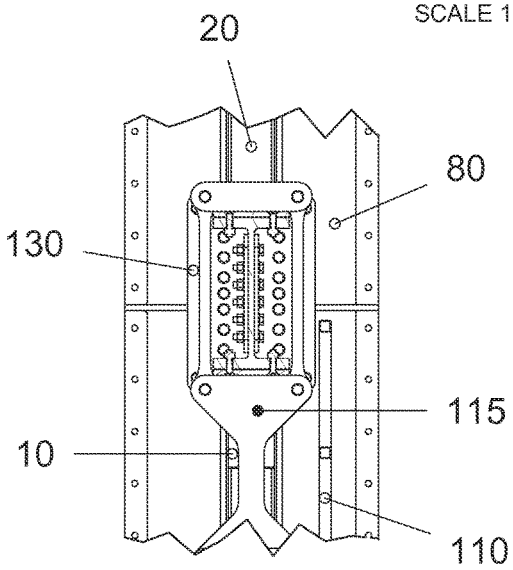

FIG. 21-A shows a partial plan view of the connection looking at the lifting deck platform (assemblies 110 & 130) below the long-span truss bottom chords 144. This figure provides the context for the two section cuts: longitudinal cut at FIG. 21B, and transverse at FIG. 21C. FIG. 21B shows the even bearing surface of the lift beam assembly 130, and consequentially the flush deck panel top plates 113. FIG. 21C-21C shows the tight but forgiving clearances of the lift beam assembly's 130 cross-section with respect to the deck panel supporting links' 115 top components.

FIG. 22 shows an isometric view of the travel nut 10. The travel nut 10 is part of an actuating system generated outside of PSC, and is included in the drawings insofar as it works conjunctively with the directly attached components that are part of the travel nut bracket assembly 120. FIGS. 22-A and 22-B provide a top and side orthographic view respectively, and give a more complete depiction of the bolt hole arrangement and extents.

Figure 23:
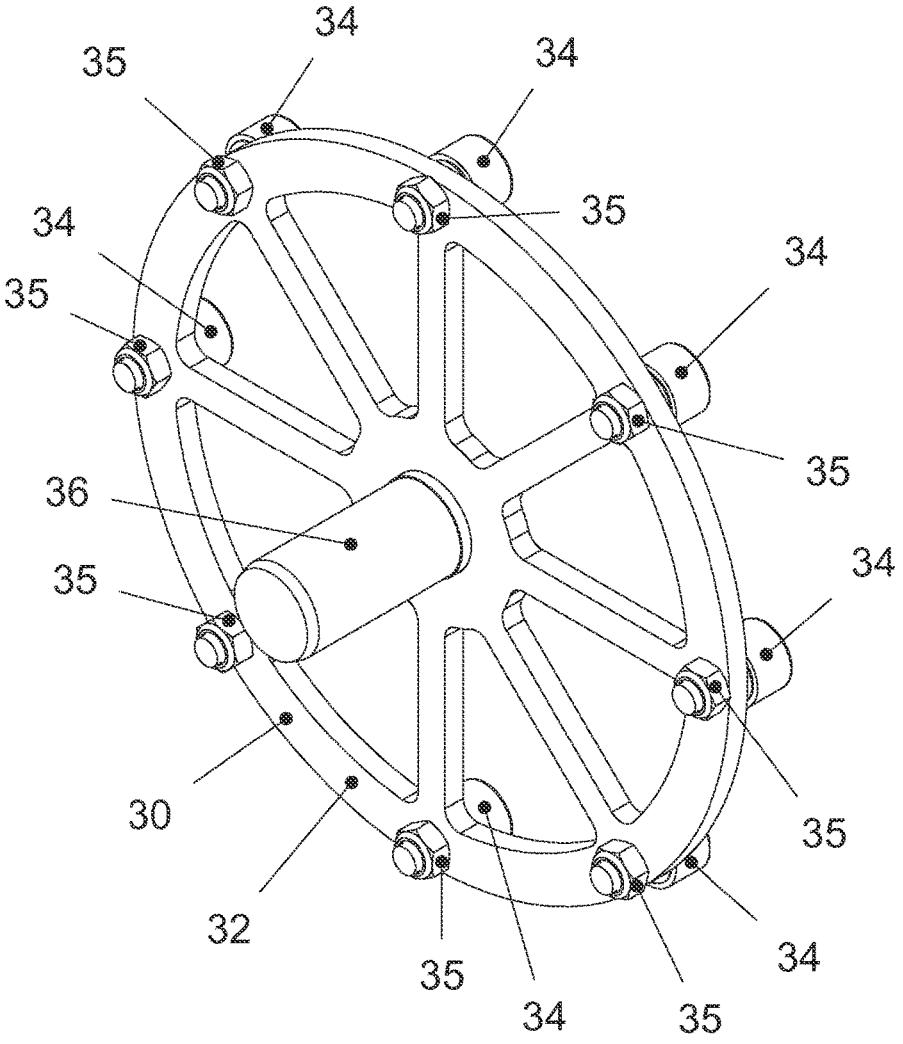
FIGS. 23 through 23-F are various views of the rod guide component and its subcomponents from the PMLS.

FIG. 23 shows an isometric view of the screw rod guide assembly 30. The screw rod guide assembly 30 consists of a screw rod guide circular plate 32, eight (8) screw rod guide track rollers 34 with eight (8) screw rod guide locknuts 35, and one (1) screw rod guide threaded rod 36. The screw rod guide assembly 30 serves the purpose of aligning the rotating screw rod 20 during the functional period of its operation. The screw rod guide track rollers 34 glide along the inner surface of pipe column walls 81, and the screw rod guide circular plate 32 provides rigidity to the system.

FIG. 23-A and FIG. 23-B show the screw rod guide assembly 30 in top and side view. The top view shows the screw rod guide track rollers 34 projecting sufficiently beyond the circumference of the screw rod guide circular plate 32 to prevent friction between the plate's circumferential edge and the interior surface of the pipe column wall 81. The side view shows the relative arrangement of the screw rod guide track rollers 34 and the screw rod guide threaded rod 36.

FIG. 23-C shows the screw rod guide circular plate 32 with holes and cutouts for optimal rigidity and self-weight. FIG. 23-D shows the screw rod guide track roller 34. FIG. 23-E shows the screw rod guide locknut 35. FIG. 23-F shows the screw rod guide threaded rod 36, which is inserted through the central hole of the screw rod guide circular plate 32, and then welded to the plane wall on the underside of the screw rod guide circular plate 32.

Figure 24:
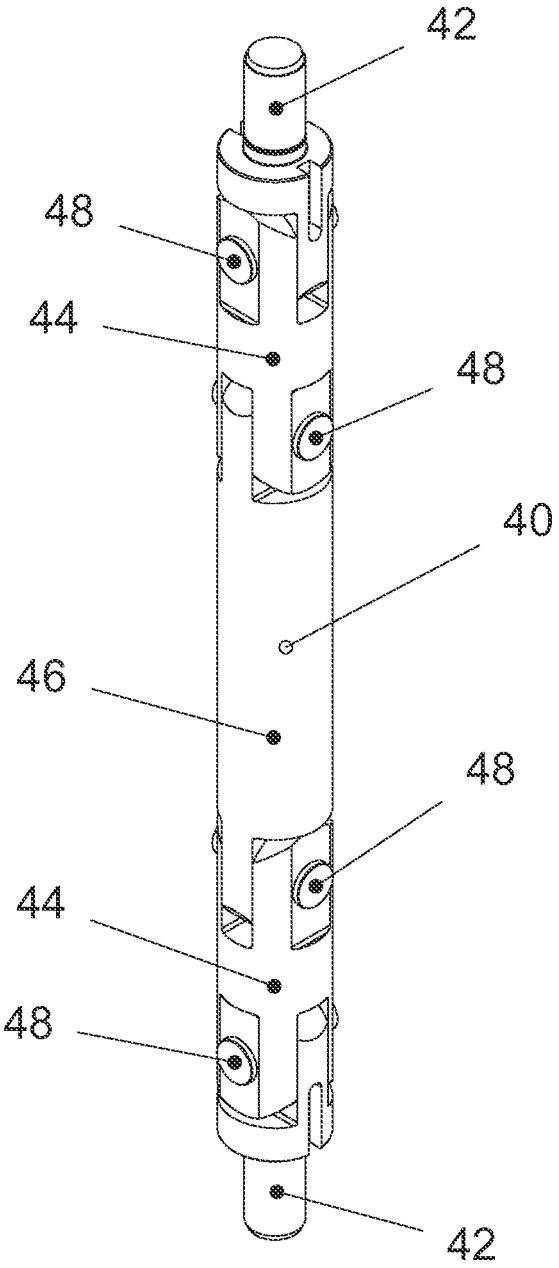
FIGS. 24 through 24-G are various views of the flexible rod component and its subcomponents from the PMLS.

FIG. 24 shows an isometric view of the flexible rod assembly 40. The flexible rod assembly 40 consists of three (3) distinct link components: flexible rod coupling link 42, flexible rod clevis link 44, and flexible rod middle link 46. The flexible rod coupling and clevis link components (components 42 & 44) are arranged symmetrically around the flexible rod middle link 46 via four (4) flexible rod pins 48. The purpose of the flexible rod assembly 40 is to release the amount of torque imparted on the actuating system assemblies (consisting of assemblies 50, 60 & 70), and ultimately on the top actuator frame assembly 170 during the rotation of the screw rod 20.

FIG. 24A shows a broken section cut through the top view of the flexible rod assembly 40, which is displayed in FIG. 24-B. FIG. 24-C shows a broken side view of the flexible rod assembly 40, with positioning and orientation of the flexible rod pins 48 with respect to the connected links (flexible rod coupling link 42, flexible rod clevis link 44, and flexible rod middle link 46).

FIG. 24-D shows a flexible rod coupling link 42, out of a total of two (2) flexible rod coupling links 42 per flexible rod assembly 40. The flexible rod coupling link 42 is a machined part that inserts into the top portion of the hollow screw rod 56 connected to the machine screw actuator 50 via threaded screws. The pin hole on the opposite side of the flexible rod coupling link 42 serves the purpose of connecting to the flexible rod clevis link 44 displayed on FIG. 24-E. The flexible rod clevis link 44 has two female ends with holes on separate ends perpendicular to one another, and this hole arrangement reorients the main component, the flexible rod middle link 46 shown on FIG. 24-F, by 90 degrees. The reorientation enables an additional rotational degree of freedom to the flexible rod assembly 40, thereby fully releasing the induced torque to the brake motor 70 and top actuator frame assembly 170 components. FIG. 24-G shows one of four (4) flexible rod link pins 48 which connect all the flexible rod assembly 40 components together (components 42, 44, and 46).

FIGS. 25, 25-A and 25-B show the flexible rod assembly 40 in a general rotational displacement of the flexible rod coupling link 42 and the flexible rod clevis link 44.

FIG. 26 shows a partial isometric view of an isolated actuating system assembly, which includes the machine screw actuator 50, the worm gear reducer 60, the main brake motor 70, and the two (2) coupling rods 72. FIG. 26-A and FIG. 26-B show cutout details of the machine screw actuator 50, and the worm gear reducer 60, and the brake motor 70, respectively.

Figure 27:
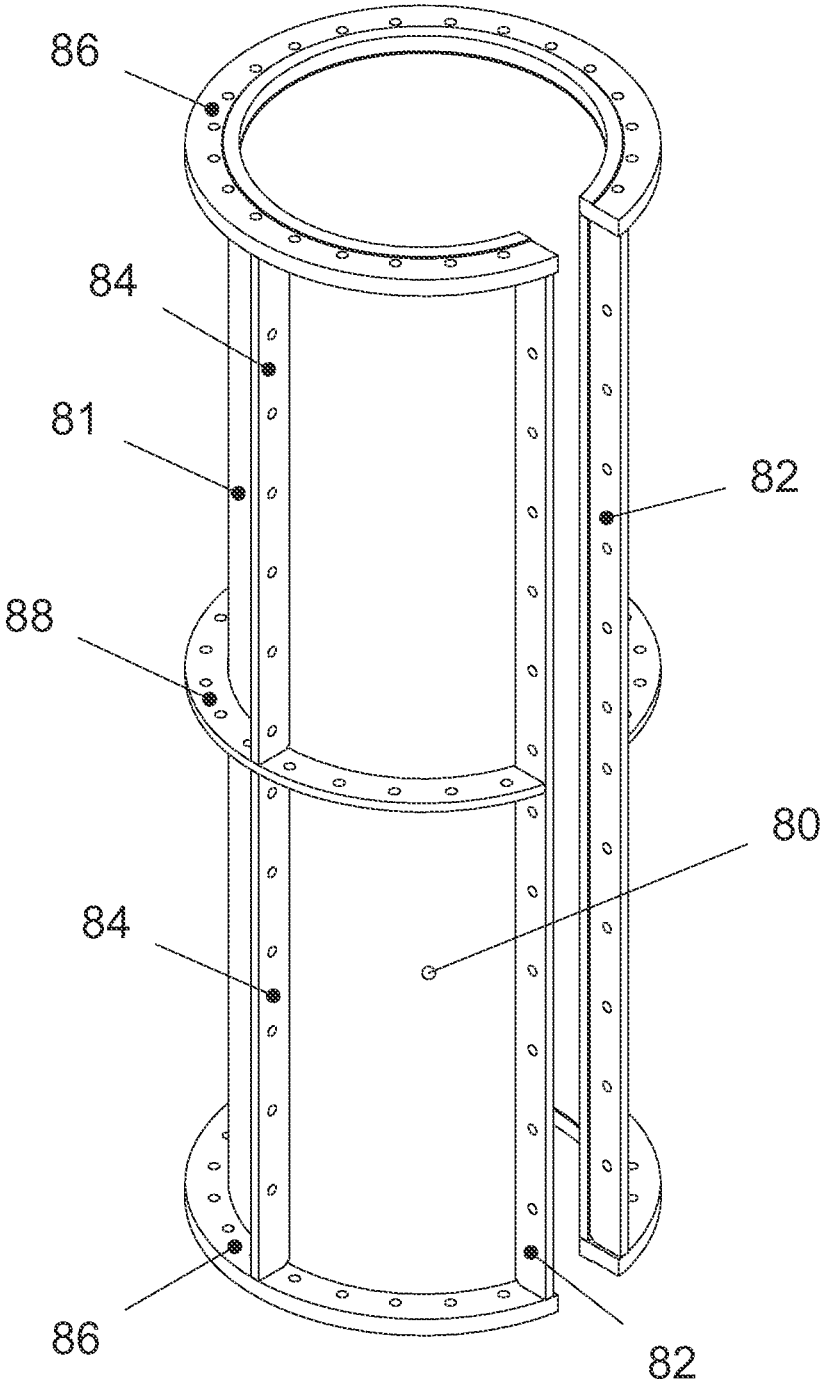
FIGS. 27 through 27-C are isometric and orthographic views of a pipe column from the PMLS and various section views.

FIG. 27 shows an isometric view of a 10 ft-long pipe column assembly 80. The parts that comprise this assembly are the pipe column wall 81, two (2) column slot vertical stiffeners 82, six (6) column vertical ribs 84, two (2) column flange plates 86, and one (1) column wall rib ring 88. These individual components are shown in FIGS. 27-D to 27-H. All the components are welded at designated locations during the process of the pipe column assembly 80 construction.

FIG. 27-A shows an orthographic view of the pipe column assembly 80 looking at the pipe column opening defined by column slot vertical stiffeners 82. FIG. 27B shows a longitudinal section through the mid-plane of the column opening defined by column slot vertical stiffeners 82. FIG. 27C shows a cross-section taken through the pipe column assembly 80 above the column wall rib ring 88 looking down.

Figure 28:
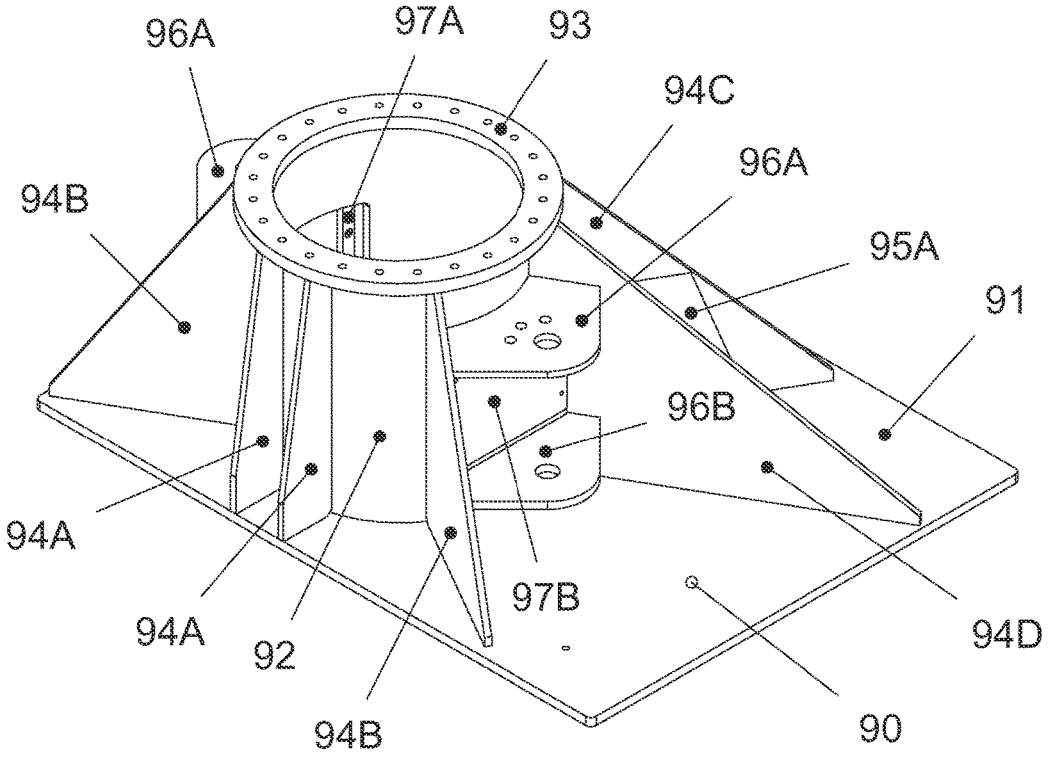
FIGS. 28 through 28-C are isometric and orthographic views of a column base pedestal from the PMLS.

FIG. 28 shows an isometric view of the column base pedestal assembly 90. The base pedestal assembly 90 consists of one (1) rectangular base plate 91, one (1) base pedestal cylindrical pipe 92, one (1) base pedestal flange plate 93, eight (8) vertical gusset plates (94A, 94B, 94C, and 94D), three (3) stiffener cross plates (95A, 95B, and 95C), two (2) top attachment plates 96A, two (2) bottom attachment plates 96B, one (1) base pedestal opening hatch plate 97A, and one (1) base pedestal hatch plate 97B. All the components are welded together along appropriate adjacent edges during the process of column base pedestal assembly 90 construction. Individual components are shown in FIGS. 28-E through 28-K.

FIG. 28-A shows the top view of the column base pedestal assembly 90 delineating the arrangement of gusset plates 94, stiffener cross plates 95, and attachment plates 96 with respect to the rectangular base plate 91. FIGS. 28-B through 28-D show additional side views and sections for added clarity on vertical arrangement of attachment plates 96 and the position of the base pedestal cylindrical pipe 92 opening as well as the pedestal hatch plate 97B that serves as the hole cover.

Figure 29E:
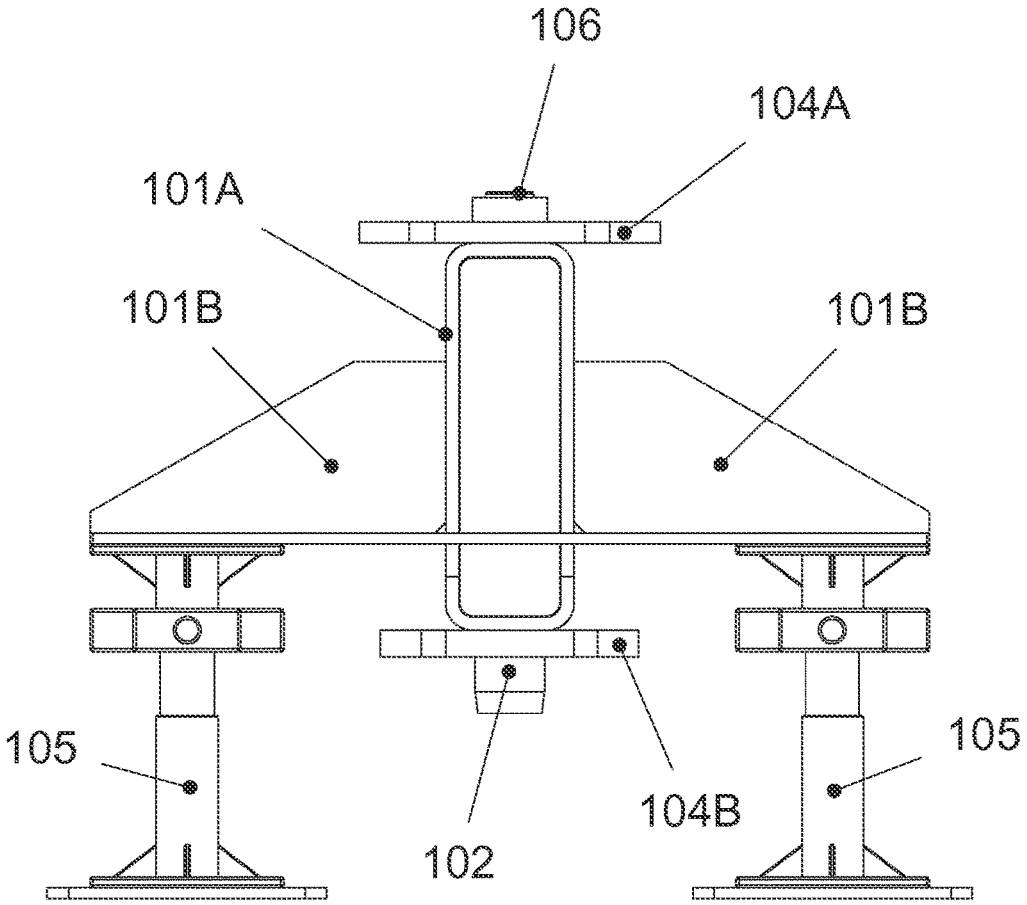
FIGS. 29 through 29-E are various views of a base stabilizing beam from the PMLS.

FIG. 29 shows an isometric view of the base stabilizing beam 100. The base stabilizing beam 100 consists of one (1) stabilizer hollow steel section 101A which includes two (2) welded cap plates and a flange plate; two (2) hollow steel section web plates 101B; one (1) main link pin 102; one (1) top pin cap plate 104A; one (1) bottom pin cap plate 104B; two (2) bridge jacks with bearing plates 105; and one (1) locking pin 106. Individual components are shown in FIGS. 29-F to 29-J.

FIG. 29-A shows the cutout detail of the bridge jack 105 in a standard configuration, and FIG. 29-B shows the cutout detail of the main link pin 102 connection to the PMLS base pedestal assembly 90.

FIGS. 29-C through 29-E show the three principal orthographic views for greater clarity on arrangement of individual components of the base stabilizing beam 100.

Figure 30:
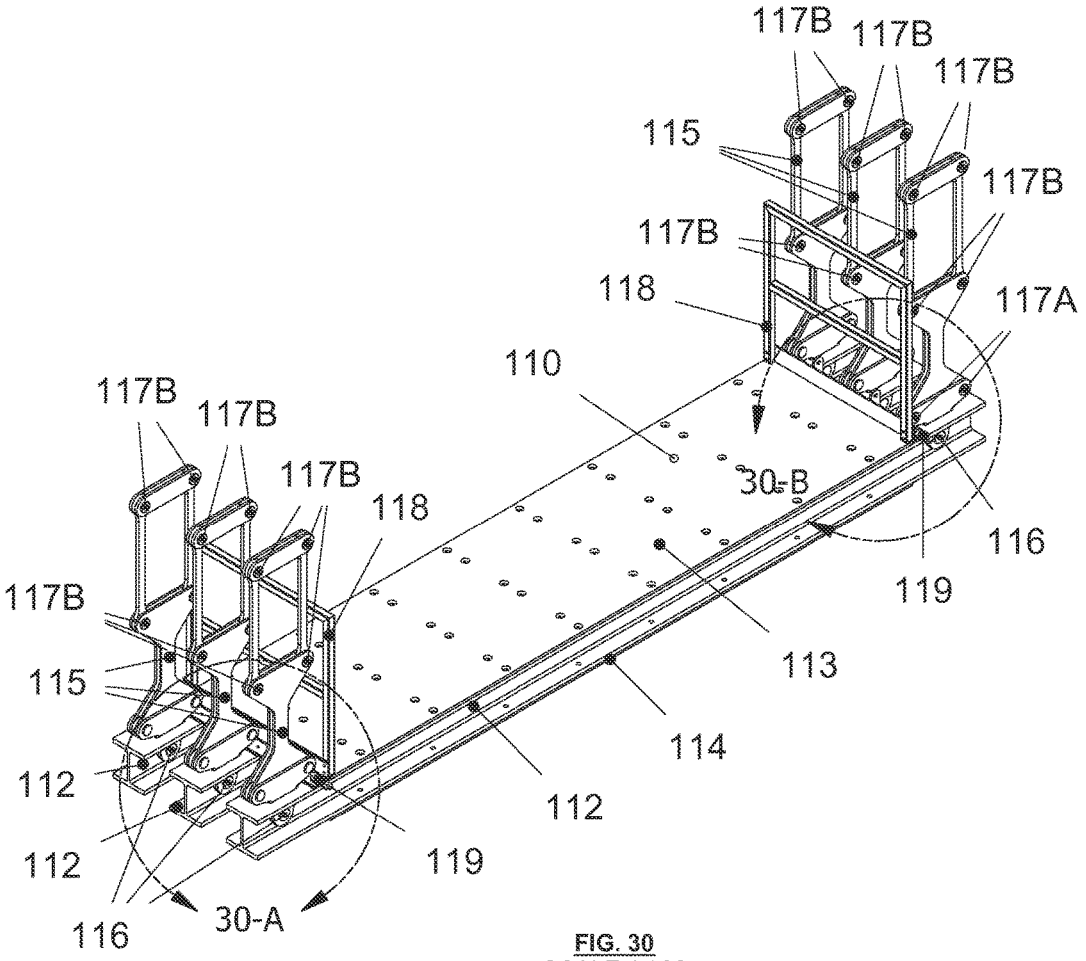
FIGS. 30 through 30-D are various views of a deck panel from the PMLS.

FIG. 30 shows an isometric view of the deck panel assembly 110. Each deck panel consists of three (3) deck panel beams 112, one (1) deck panel top plate 113, one (1) deck panel bottom plate 114, six (6) deck panel supporting links 115, six (6) beam link pins 116, twelve (12) supporting link bottom pins 117A, twenty-four (24) supporting link top pins 117B, two (2) deck panel railings 118, and two (2) inter-deck connecting plates 119. Individual components are shown in FIGS. 30-F through 30-M.

With the exception of the deck panel railing 118, there are no other welded components within the deck panel assembly 110. The deck panel top plate 113 is attached to the three (3) deck panel beams 112 by counter-sunk fasteners that are inserted through the holes of the deck panel top plate 113, and secured with a nut and a washer at the bottom face of the deck panel beams' 112 top flanges. The deck panel bottom plate 114 is attached to the three (3) deck panel beams 112 by through bolts that are inserted through the deck panel bottom plate 114 holes, and secured with a nut and a washer at the top face of the deck panel beams' 112 bottom flanges. The deck panel supporting links 115 are assembled by aligning the plates that comprise the deck panel supporting link 115 components, and inserting the deck supporting link pins (components 117A & 117B) through appropriate holes. Each deck panel supporting link 115 is inserted through the top flange openings of the deck panel beam 112, and connected to the deck panel beam's 112 web via a beam link pin 116.

FIGS. 30-A and 30-B show cutout details of the deck supporting link 115 and beam link pins 116 at the deck panel supporting link 115 to deck panel beam 112 connection.

FIGS. 30-C and 30-D show the two orthographic views—top and side, respectively—for greater clarity on arrangement of individual components of the deck panel assembly 110.

Figure 30E:
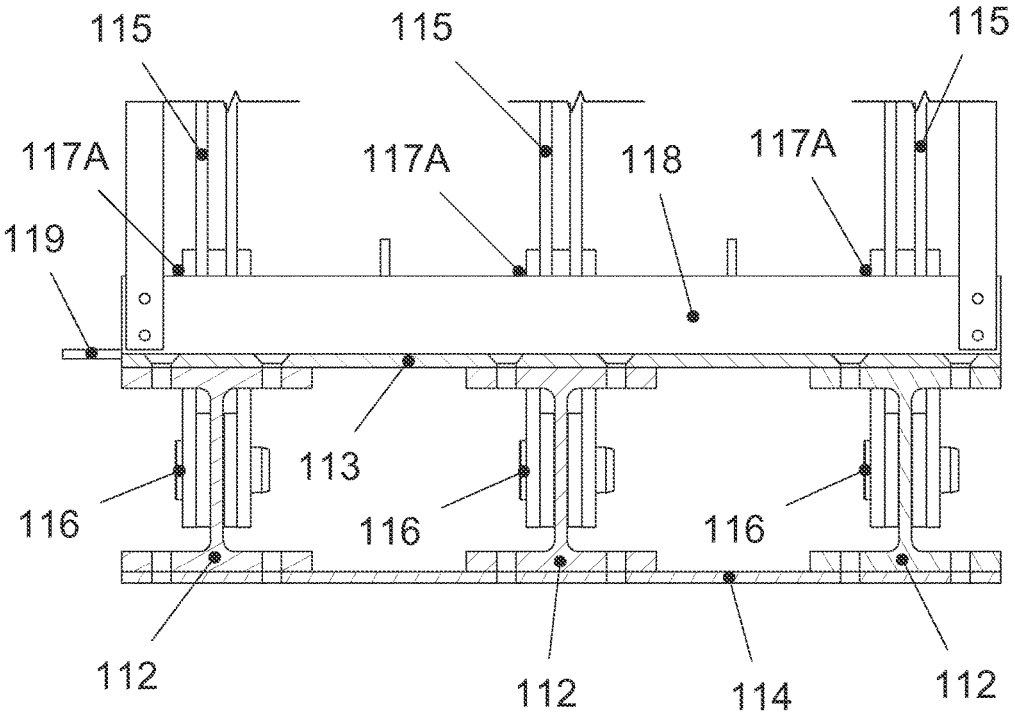
FIG. 30E is a section view from FIG. 30-D taken along the section line 30E.

FIG. 30E shows a partial cross-section taken within the interior of the deck panel assembly 110 platform. The section shows the alignment of deck panel plates (components 113 & 114) with deck panel beam 112 holes, as well as an orthographic view of a deck panel supporting link 115 to beam link pin 116 connection.

Figure 31:
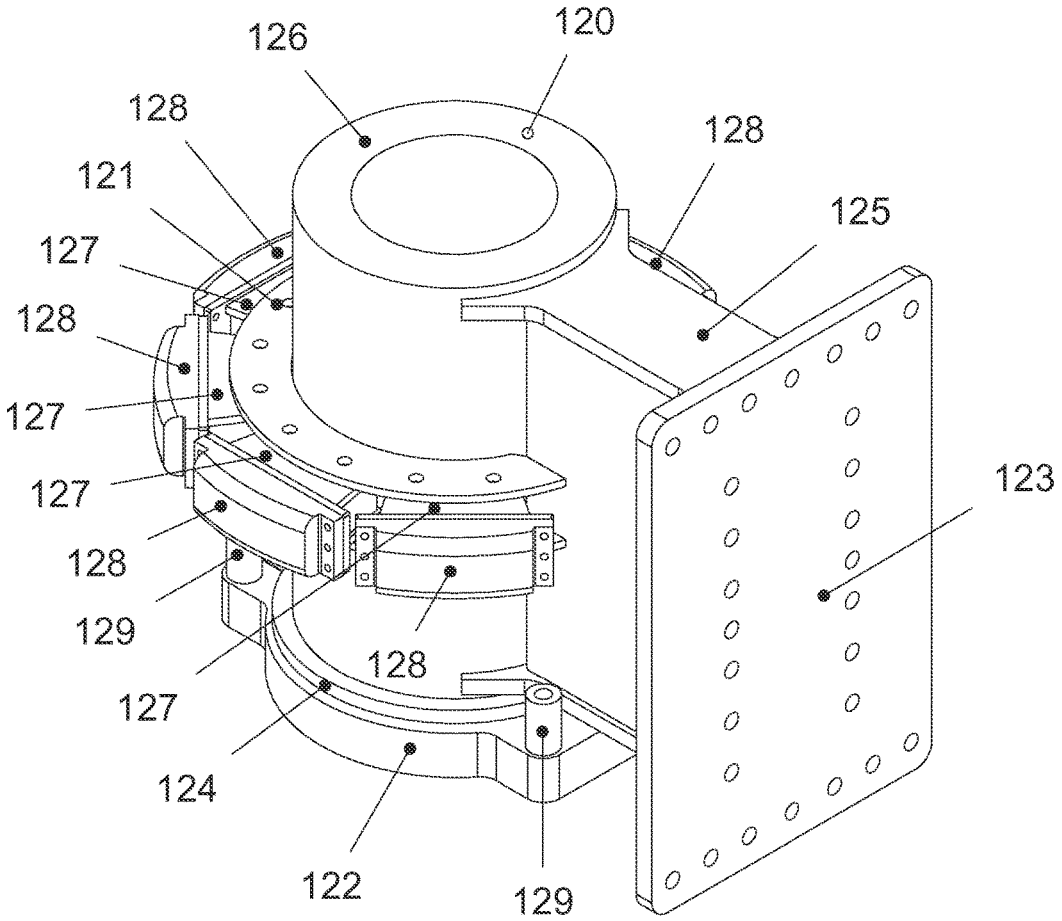
FIGS. 31 through 31-L are various views of a nut bracket and of components making up the nut bracket from the PMLS.

FIG. 31 shows an isometric view of the travel nut bracket assembly 120. The travel nut bracket assembly 120 consists of two (2) travel nut bracket rib plates, one (1) travel nut bracket rocker plate 122, one travel nut bracket end plate 123, one (1) travel nut bracket rocker cone 124, one (1) travel nut bracket sleeve 125, one (1) travel nut bracket hollow cylinder 126, seven (7) column wall bearing braces 127, seven (7) column bearing brace pads 128, and four (4) rocker stop pin sleeves 129. Individual components are shown in FIGS. 31-G through 31-L.

The travel nut bracket end plate 123, travel nut bracket sleeve 125, and travel nut bracket hollow cylinder 126 are welded along appropriate adjacent edges to form the main body of the travel nut bracket 120. The travel nut bracket rocker cone 124 is screwed via a threaded fastener to the travel nut bracket hollow cylinder 126. The column wall bearing braces 127 are fastened to the travel nut bracket rib plates 121 at appropriate hole locations via a through bolt for a total of fourteen (14) bolts per travel nut bracket assembly 120. Each bolt is secured into place by a nut and a washer.

FIGS. 31-A and 31-B show the two orthographic views—top and side, respectively—for greater clarity on arrangement of individual components of the deck panel assembly 110.

Figure 31C:
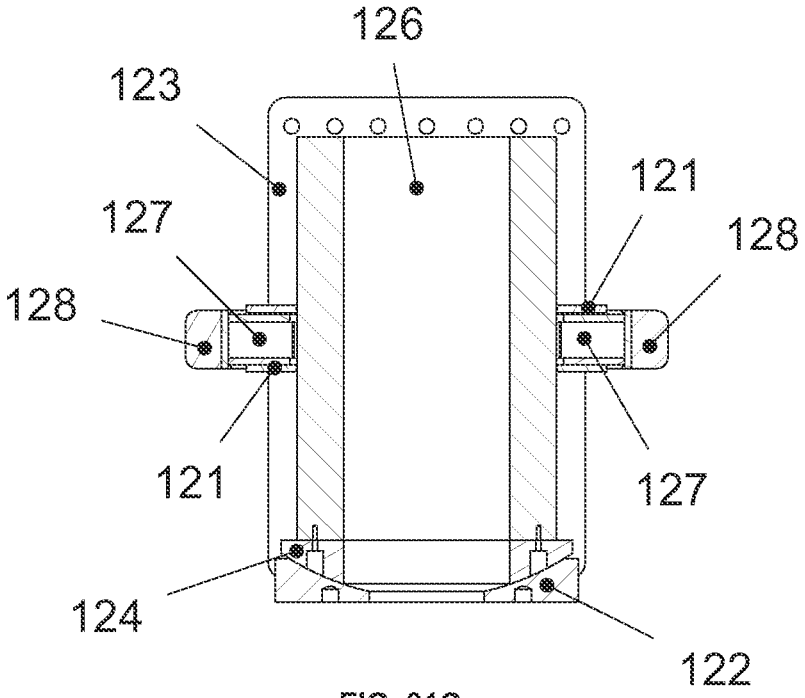

FIG. 31C shows a cross-section taken at FIG. 31-B through the central axis of the travel nut bracket hollow cylinder 126. It explains visually the placement of column wall bearing braces 127 with respect to the travel nut bracket rib plates 121.

Figure 31D:
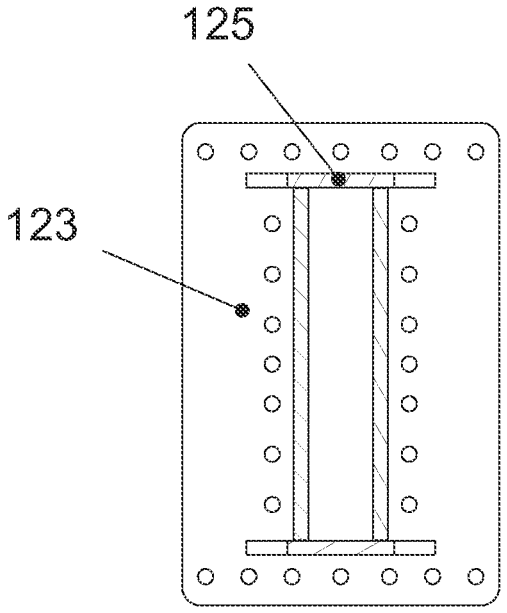

FIG. 31D shows a cross-section taken at FIG. 31-B through the nut bracket sleeve 125 looking towards the travel nut bracket end plate 123. It explains visually the location of the travel nut bracket end plate 123 bolt holes with respect to the travel nut bracket sleeve 125 made of four (4) welded plates.

FIG. 31E shows a cross-section taken at FIG. 31-B through a cross-sectional plane of the hollow travel nut bracket cylinder 126 looking down. It explains visually the placement of the travel nut bracket rocker cone 124 with respect to the orientation of the travel nut bracket sleeve 125, and the tight but smooth clearances between the travel nut bracket rocker cone 124 and rocker stop pin sleeves 129. The purpose of the rocker stop pin sleeves 129 is to adjust the travel nut bracket assembly 120 overall position due to local accidental eccentricities, so that its rotation is primarily in the transverse plane of the lift beam assembly 130.

FIG. 32 shows an isometric view of the lift beam assembly 130. The lift beam assembly 130 consists of one (1) lift beam rolled section 132, two (2) lift beam end plates 133, two (2) lift beam cover plates 134, four (4) lift beam end flange plates 135, four (4) lift beam end tab plates 136, and four (4) lift beam end cover plates 137. Individual components are shown in FIGS. 32-E through 32-I.

FIG. 32-A is a cutout detail of the lift beam assembly's 130 end. It shows the arrangement of lift beam end flange plates 135 with respect to the lift beam rolled section's 132 trimmed flanges and lift beam end cover plates 137. The lift beam end cover plates 137, when fastened through the adjoining lift beam end flange plate 135 surfaces, serve the purpose of leveling the lift beam assembly's 130 top and bottom surface in order for all the deck panel supporting links 115 to lay flush on top of the lift beam assembly 130.

FIGS. 32-B and 32-C show the two orthographic views—top and side, respectively—for greater clarity on arrangement of individual components of the lift beam assembly 130.

FIG. 32D shows a cross-section of the lift beam assembly 130 taken at FIG. 32-C through the end moment connection (consisting of components 133, 135, and 136) looking towards the lift beam end plate 133. It gives additional visual explanation of the positioning of the lift beam rolled section 132, the lift beam end flange plates 135, and the lift beam end cover plates 137.

FIG. 33 shows an isometric view of the long-span truss panel 140. The long-span truss panel 140 consists of one (1) long-span truss top chord 142, one (1) long-span truss bottom chord 144, five (5) long-span truss vertical braces

145, four (4) long-span truss diagonal braces 146, eight (8) long-span truss gusset plate assemblies 147, four (4) shelf brackets 148, and four (4) long-span truss panel lugs 149. Individual components are shown in FIGS. 33-A through 33-C.

FIG. 33-A shows a cutout detail of the top corner of a long-span truss panel 140 where the long-span truss vertical brace 145 joins the long-span truss top chord 142. The long-span truss vertical brace 145 is welded to the bottom face of the long-span truss top chord 142 along its perimeter. It also shows the connecting edges of the shelf brackets 148 to the side face of the long-span truss top chord 142, and the long-span truss panel lug 149, which connects the long-span truss panel 140 to the column slot adaptor 190, and ultimately to the pipe column assembly 80.

FIG. 33-B shows a cutout detail of the bottom corner of the long-span truss panel 140 where the long-span truss vertical brace 145 joins the long-span truss bottom chord 144 and one of the long-span truss gusset plate assemblies 147, which in turn serves as the connection point for the long-span truss diagonal brace 146. The long-span truss vertical brace 145 is welded to the top face of the long-span truss bottom chord 144 along its perimeter. The long-span truss diagonal brace 146 is welded along its connected slot edges to the long-span truss gusset plate assembly 147. The long-span truss gusset plate assemblies 147 are welded to the main long-span truss top and bottom chords (components 142 & 144) and long-span truss vertical braces 145. The long-span truss panel lugs 149 are welded to the ends of long-span truss top and bottom chords (components 142 & 144).

FIG. 33-C shows a cutout detail of the bottom corner of the long-span truss panel 140 at the mid-span of the assembly, where the long-span truss vertical brace 145 joins the long-span truss bottom chord 144 and two (2) of the long-span truss gusset plate assemblies 147, which in turn serve as connection points for the two (2) long-span truss diagonal braces 146. The long-span truss vertical brace 145 is welded to the top face of the long span truss bottom chord 144 along its perimeter. The long-span truss diagonal brace 146 is welded along its connected slot edges to the long-span truss gusset plate assembly 147. The long-span truss gusset plate assemblies 147 are welded to the long-span truss top and bottom chords (components 142 & 144) and long-span truss vertical braces 145.

FIGS. 33-D and 33-E show the two orthographic views—top and back, respectively—for greater clarity on arrangement of individual components of the long-span truss panel 140.

FIG. 34 shows an isometric view of the short-span truss panel 150. The short-span truss panel 150 consists of one (1) short-span truss top chord 152, one (1) short-span truss bottom chord 154, three (3) short-span truss vertical braces 155, two (2) short-span truss diagonal braces 156, four (4) short-span truss gusset plate assemblies 157, and four (4) short-span truss panel lugs 159. Individual components are shown in FIGS. 34-A and 34-B.

FIG. 34-A shows a cutout detail of the top central joint of the short-span truss panel 150 where the middle short-span truss vertical brace 155 joins the short-span truss top chord 152 and two (2) of the short-span truss gusset plate assemblies 157.

FIG. 34-B shows a cutout detail of the bottom corner of the short-span truss panel 150 where the short-span truss vertical brace 155 joins the short-span truss bottom chord 154 and one (1) of the short-span truss gusset plate assemblies 157, which in turn serve as connection points for the short-span truss diagonal brace 156. The short-span truss vertical brace 155 is welded to the top face of the short-span truss bottom chord 154 along its perimeter. The diagonal brace 156 is welded along its connected slot edges to the gusset plate assembly 157. The short-span truss gusset plate assemblies 157 are welded to the short-span truss top and bottom chords (components 152 & 154) and short-span truss vertical braces 155. It also shows the short-span truss panel lug 159, which connects the short-span truss panel 150 to the column rib bracket 200, and ultimately to the pipe column assembly 80.

FIGS. 34-C and 34-D show the two orthographic views—top and front, respectively—for greater clarity on arrangement of individual components of the short-span truss panel 150.

FIG. 35 shows an isometric view of the K-brace panel 160. The K-brace panel 160 consists of two (2) K-brace main chords 162, three (3) orthogonal braces 164, two (2) diagonal braces 166, and four (4) gusset plate assemblies 167. Individual components are shown in FIGS. 35-A, and 35-B.

FIG. 35-A shows a cutout detail of the central joint of the K-brace panel 160, where the middle orthogonal brace 164 joins the outer K-brace main chord 162 and two (2) of the K-brace gusset plate assemblies 167.

FIG. 35-B shows a cutout detail of the corner of the K-brace panel 160, where the orthogonal brace 164 joins the K-brace main chord 162 and one of the K-brace gusset plate assemblies 167, which in turn serve as connection points for the diagonal brace 166. The orthogonal brace 164 is welded to the inner side face of the K-brace main chord 162 along its perimeter. The orthogonal brace 166 is welded along its connected slot edges to the K-brace gusset plate assembly 167. The K-brace gusset plate assemblies 167 are welded to the K-brace main chords 162 and to the orthogonal braces 164.

FIGS. 35-C and 35-D show the two orthographic views—side and top, respectively—for greater clarity on arrangement of individual components of the K-brace panel 160.

FIG. 36 is an isometric view of the top actuator frame assembly 170. The top actuator frame assembly consists of four (4) corner jack frame sub-assemblies 172, two (2) motor frame sub-assemblies 174, and two (2) longitudinal frame sub-assemblies 176. Individual frame components are shown in FIGS. 36-C through 36-E.

FIG. 36-A is a cutout detail of a typical corner of the top actuator frame assembly 170. It shows the position of the actuator frame top plate 173 and actuator frame shim plate 177, as well as pinned connections between the corner jack frame assembly 172 and the motor frame assembly 174.

FIG. 36-B is a cutout detail of the motor frame assembly 174, which shows the positioning of the actuator frame gear box plate 175.

FIG. 36-F shows the top actuator frame assembly 170 viewed from the top, and provides the context for the three section cuts, FIG. 36G, FIG. 36H, and FIG. 36I. The section cuts provide added clarity on arrangement of sub-components (access holes, lugs, bracing elements, etc.) within each of the individual frames, as well as how they connect to each other.

FIG. 37 is an isometric view of the ground access ramp assembly 180. The ground ramp assembly 180 consists of two (2) ground access ramp main plates 182, six (6) ramp supporting beams 184, eight (8) ramp connecting angle braces 186, and twelve (12) ramp beam stiffener plates 188. The ground access ramp main plates 182 are welded to the webs of the ramp supporting beams 184 to form the two (2)

ramp tracks—left ramp track sub-assembly 181A and right ramp track sub-assembly 181B. The ramp beam stiffener plates 188 are welded at the ends of ramp supporting beams 184, two (2) per ramp supporting beam 184 on each side of its web. The ramp connecting angle braces 186 are bolted to the ground access ramp main plates 182 with through bolts and secured by nuts and washers. Individual components are shown in FIGS. 37 and 37-A.

FIG. 37-A is a cutout detail of the ground access ramp assembly 180 with a break-out through the ground access ramp main plate 182 to show the positioning of the ramp supporting beams 184 and a close-up view of a typical ramp connecting angle brace 186 to ground access ramp plate 182 connection.

FIG. 37-B is a top view of the ground access ramp assembly 180, which shows the layout and spacing of the left and right ramp track sub-assemblies (sub-assemblies 181A & 181B). It also provides context to the two section cuts, FIG. 37C and FIG. 37D.

FIG. 37C shows a transverse section cut near the high point of the ground access ramp assembly 180 looking towards the ramp beam stiffener plates 188, in order to provide added clarity to positioning and orientation of the ramp supporting beams 184 and ramp beam stiffener plates 188.

FIG. 37D shows a longitudinal section cut through the mid-plane of the ground access ramp assembly 180, and provides added clarity to the positioning and orientation of the ramp connecting angle braces 186. In addition, FIG. 37-E shows a cutout detail of the section cut from FIG. 37D, for added clarity on fastening of the ramp connecting angle braces 186 to the ground access ramp main plates 182.

Figure 38:
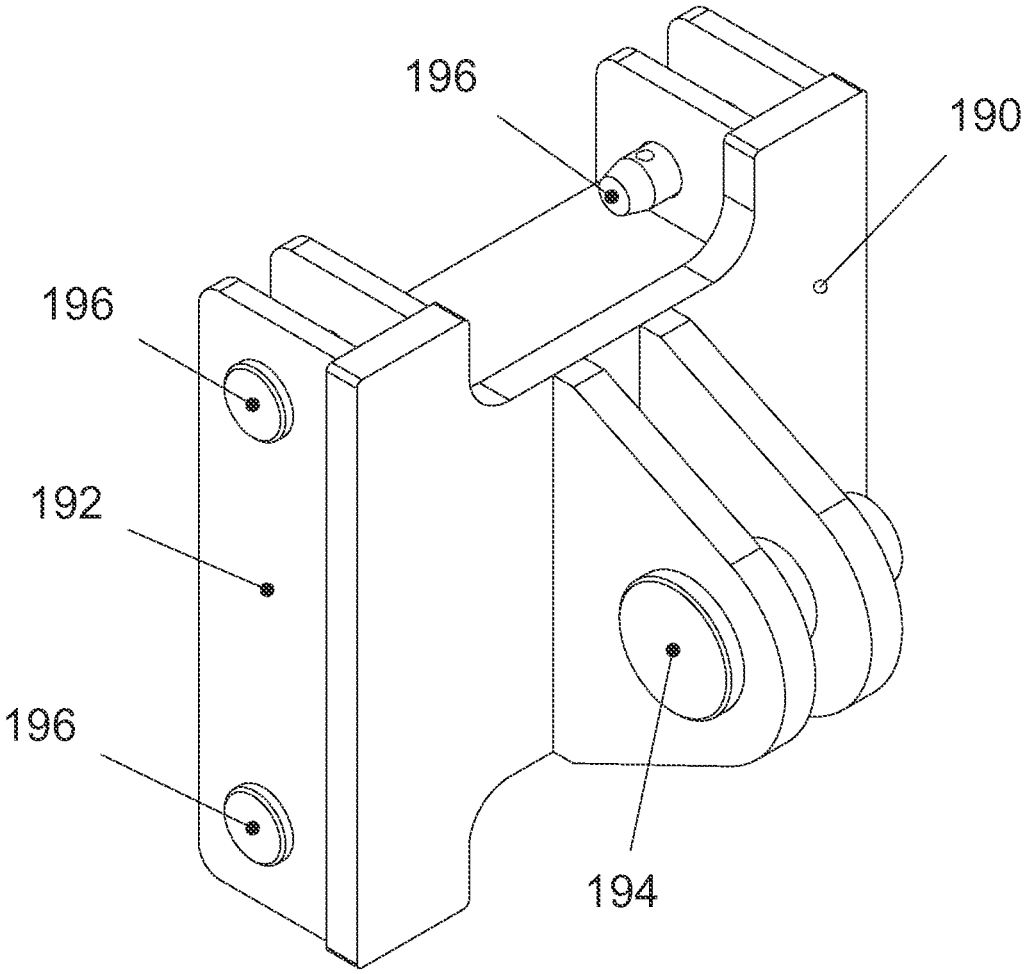
FIGS. 38 through 38-B are isometric and orthographic views of a column slot adaptor from the PMLS.

FIG. 38 shows an isometric view of the column slot adaptor 190. The column slot adaptor 190 consists of one (1) column slot adaptor bracket 192, slot adaptor pin 194, and four (4) column slot pins 196. All the plates that comprise the column slot adaptor bracket 192 are welded at adjacent joining surfaces. Individual components are shown in FIGS. 38-D through 38-F.

FIG. 38-A shows the top view of the column slot adaptor 190 for added clarity on the arrangement and orientation of column slot pins 196 and the slot adaptor pin 194.

Figure 39:
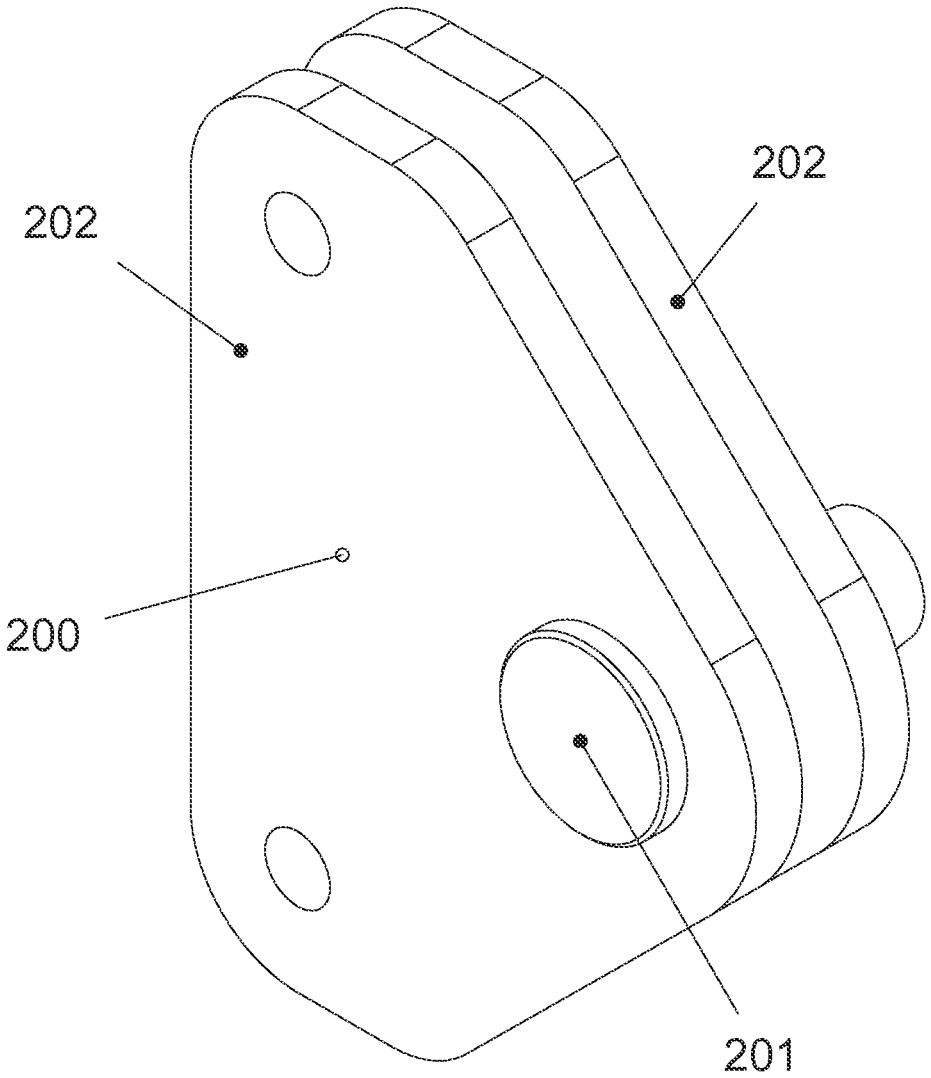
FIGS. 39 through 39-C are isometric and orthographic views of a column rib bracket from the PMLS.

FIG. 39 shows an isometric view of the column rib bracket 200. The bracket assembly consists of a rib bracket pin 201 and two (2) rib bracket plates 202. Individual components are shown in FIGS. 39-D and 39-E.

FIGS. 39-A, 39-B, and 39-C show the three orthographic views—top, front, and side, respectively—for greater clarity on arrangement and spacing of individual components. The rib bracket pin 201 has sufficient length to accommodate small variations in the spacing of rib bracket plates 202, which is controlled by the thickness of the column vertical rib 84 to which the bracket assembly 200 attaches.

The Pipe Modular Lift System (PMLS) is shown and described above with reference to FIG. 1 through FIG. 39-E. The embodiment is a steel platform supported by columns, which bear on the ground, at four corners which consist of steel pipe column assemblies 80 with machine screw actuators 50 centered on the pipe column assemblies 80. The machine screw actuator 50 is a motor-driven gear box, the gears of which mate with a long threaded screw rod 20. Two (2) brake motors 70 rotate the shafts, which power the machine screw jack gears 50, which in turn cause the threaded screw rod 20 to rotate. The rotation of the threaded screw rod 20 causes the travel nut 10 to translate vertically, engaging the travel nut bracket assembly 120 fastened to the travel nut 10. The vertical motion of the travel nut bracket 120 engages the lift beam assembly 130 via the bolted end plate connection (components 123 & 133) of each of the two (2) components. The vertical motion of the lift beam assembly 130 engages the deck panel supporting links 115, which suspend the deck panel assemblies 110 from the lift beam assemblies 130. Loads imposed on the suspended deck panel assemblies 110 transfer back to the travel nut 10 via connected components along the outlined load path. The axial load imparted by the travel nut 10 to the threaded screw rod 20 which hangs at the top from machine screw actuators 50 transfers via the worm gear boxes 60 to the corner jack frame sub-assembly 172. The corner jack frame sub-assembly 172 bears on the two (2) pipe column assemblies 80, which stacked upon one another deliver the loads to the column base pedestal assemblies 90, and ultimately to the ground.

The standard configuration footprint provided in the figures of this document measures 58'-9" by 44'-3" rounded up to the next closest inch. The overall height of the structure, measured from ground level to the top of the platform 210 measures 70'-4" rounded up to the next closest inch. Due to the nature of component connections (pins and fasteners as well as modular hole patterns on various component plates), the PMLS is capable of achieving different (rectangular) geometries according to a specific set of lifting project requirements. It is also capable of achieving different heights below or above the standard configuration, within the structural limitations of the critical components due to added loads.

Varying the length of the lifting deck platform (assemblies 110 & 130) is achieved by adding or removing the 4 ft-wide deck panel assemblies 110 from the array, and modifying the lift beam assembly's 130 span—and where needed for structural capacity, the overall lift beam rolled section 132 profile and lift beam end cover plate 134 dimensions. Long-span truss panels 140 would change in geometry accordingly, if reducing or increasing the lifting deck platform (assemblies 110 & 130) length required repositioning of the pipe column assemblies 80. The top actuator frame's longitudinal frame sub-assembly 176 would consist of longer or shorter main beams. The connections of longitudinal frame sub-assemblies 176 to the corner jack frame sub-assemblies 172 would be devised and assembled in the same manner as for the standard configuration.

Varying the width of the lifting deck platform (assemblies 110 & 130) is achieved by lengthening or shortening the deck panel beams 112 and the deck panel top and bottom plates (components 113 & 114). Due to the nature of suspension of the deck panel assemblies 110 from the lift beam assemblies 130, and the lift beam assembly 130 to nut bracket assembly 120 connection, changes in the direction perpendicular to the lift beam assembly's 130 span necessitate the repositioning of the pipe column assemblies 80, and thus modification in the length of the short-span truss panel 150 and the K-brace panel 160. The top actuator frame's motor frame sub-assemblies 174 would consist of longer or shorter main beams. The connections of motor frame sub-assemblies 174 to the corner jack frame sub-assemblies 172 would be devised and assembled in the same manner as for the standard configuration.

Varying the height of the PMLS to reach greater or lesser heights and range of elevations would be achieved by installing or removing the 20' long screw rod 20 components within the motor frame (assemblies 50, 60 & 70), and adding or removing the pipe column assembly 80 components fabricated to the desired length. Additional short-span truss panels 150 in the direction perpendicular to the lift beam assembly's 130 span may be required. Long-span truss panels 140 spanning the direction parallel to the lift beam assembly's 130 span may need a somewhat modified geometry.

The advantages of this system over conventional lifting methods are numerous, and only a few are listed herein.

Since the screw threads maintain firm contact with the travel nut, there is continuous steel-to-steel contact at all times the load is being transported. The factors of safety for failure of the threads through shearing are much higher than factors of safety typically found when conventional lifting methods are utilized.

The risks inherent to rigging and cranes are eliminated by utilization of the PMLS.

The risk and consequences of human error are far less than with a crane operator and rigging.

Time consuming pre-lift meetings, lift plan preparation, rigging procurement, rigging supervision, and various other requirements inherent with conventional lifting methods are eliminated.

From the foregoing statements, it is observed that numerous variations and modifications may be effected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A modular lift system comprising:

a lift deck system having a long directional axis, a short directional axis, and further having four corners, the lift deck system being configured to be moved vertically from a surface to a height above the surface;

a pipe column assembly positioned at each corner of the lift deck system, each pipe column assembly having a top section, a bottom section, and a pipe slot, the pipe slot extending substantially from the top section to the bottom section;

a base pedestal positioned under each bottom section in each pipe column assembly and being secured to the surface;

a top actuator frame assembly secured to the top section in each pipe column assembly;

a threaded screw rod positioned within each pipe column assembly;

a travel nut bracket assembly having a travel nut and being positioned about each treaded screw rod in each pipe column assembly, the travel nut bracket assemblies configured to vertically travel along the treaded screw rod when actuated, each travel nut bracket assembly having a bracket sleeve with a portion extending through the pipe slot;

a pair of lift beam assemblies extending along the long directional axis of the lift deck system and being secured along corresponding sides of the lift deck system, each lift beam assembly separately extending between a pair of opposed pipe column assemblies along the long directional axis, each lift beam assembly having a pair of ends separately secured to the portion of the bracket sleeve extending through the pipe slot, and an actuator system in communication with the four threaded screw rods configured to rotate the four threaded screw rods to cause the vertical movement of the travel nut bracket assemblies, that further cause the vertical movement of the pair of lift beam assemblies and therefore raise and lower the lift deck system therewith, wherein each pipe column assembly is defined to include a plurality of vertically stacked column sections, each column section is defined to include a column side wall around an internally hollow space, the column side wall is reinforced with a plurality of vertical ribs and a pair of column slot vertical stiffeners positioned on either side of a column slot, the column slot runs vertically along with column section, when the plurality of vertically stacked column sections are assembled together the column slots defined on the stacked column sections align to form a single slot running along the entire pipe column assembly.

2. The system of claim 1, wherein each base pedestal includes a base stabilizing beam secured at one end to the base pedestal and secured at a diametrically opposed end to a surface, the base stabilizing beam extending from the base pedestal at an orientation configured to resist overturning of the modular lift system along the long directional axis.

3. The system of claim 1 further comprising at least two long-span truss panels separately secured between pairs of pipe column assemblies diametrically opposed to each other and being positioned parallel to the long directional axis defined by the lift deck system.

4. The system of claim 3, wherein the at least two long-span truss panels are secured to the column slot vertical stiffeners.

5. The system of claim 1 further comprising at least two short-span truss panels separately secured between pairs of pipe column assemblies diametrically opposed to each other and being positioned parallel to the short directional axis defined by the lift deck system.

6. The system of claim 5, wherein the at least two short-span truss panel includes a plurality of short-span truss panels attached at staggered elevations along a pair of pipe column assemblies.

7. The system of claim 1, wherein the lift deck system is assembled with a plurality of deck panels.

8. The system of claim 1 further comprising a flexible rod assembly secured between the actuator system and the threaded screw rod, the flexible rod assembly being configured to release torque imparted on the actuator system during rotation of the screw rod.

9. The system of claim 8, wherein the flexible rod assembly includes a flexible rod coupling link, a flexible rod clevis link, and a flexible rod middle link, wherein the flexible rod coupling link and clevis link are arranged symmetrically around the flexible rod middle link.

10. The system of claim 1, wherein the actuator system includes a pair of motors, each motor being coupled to a worm gear reducer that is rotating a pair of coupling rods, an end of each coupling rod is separately secured to a machine screw actuator that is configured to rotate the threaded screw rod.

11. A modular lift system comprising:

a lift deck system having a first directional axis, a second directional axis perpendicular to the first directional axis, and further having four corners, the lift deck system being configured to be moved vertically from a surface to a height above the surface;

a pipe column assembly positioned at each corner of the lift deck system, each pipe column assembly having a top section, a bottom section, and a pipe slot, the pipe slot extending substantially from the top section to the bottom section;

a base pedestal positioned under each bottom section in each pipe column assembly and being secured to the surface;

a top actuator frame assembly secured to the top section in each pipe column assembly;

a threaded screw rod positioned within each pipe column assembly;

a travel nut bracket assembly having a travel nut and being positioned about each treaded screw rod in each pipe column assembly, the travel nut bracket assemblies configured to vertically travel along the treaded screw rod when actuated, each travel nut bracket assembly having a bracket sleeve with a portion extending through the pipe slot;

a pair of lift beam assemblies extending along the first directional axis of the lift deck system and being secured along corresponding sides of the lift deck system, each lift beam assembly separately extending between a pair of opposed pipe column assemblies along the first directional axis, each lift beam assembly having a pair of ends separately secured to the portion of the bracket sleeve extending through the pipe slot, and an actuator system in communication with the four threaded screw rods configured to rotate the four threaded screw rods to cause the vertical movement of the travel nut bracket assemblies, that further cause the vertical movement of the pair of lift beam assemblies and therefore raise and lower the lift deck system therewith, wherein each pipe column assembly is defined to include a plurality of vertically stacked column sections, each column section is defined to include a column side wall around an internally hollow space, the column side wall is reinforced with a plurality of vertical ribs and a pair of column slot vertical stiffeners positioned on either side of a column slot, the column slot runs vertically along with column section, when the plurality of vertically stacked column sections are assembled together the column slots defined on the stacked column sections align to form a single slot running along the entire pipe column assembly.

12. The system of claim 11, wherein each base pedestal includes a base stabilizing beam secured at one end to the base pedestal and secured at a diametrically opposed end to a surface, the base stabilizing beam extending from the base pedestal at an orientation configured to resist overturning of the modular lift system along the first directional axis.

13. The system of claim 12 further comprising:

at least a pair of first span truss panels separately secured between pairs of pipe column assemblies diametrically opposed to each other and being positioned parallel to the first directional axis defined by the lift deck system; and at least a pair of second span truss panels separately secured between pairs of pipe column assemblies diametrically opposed to each other and being positioned parallel to the second directional axis defined by the lift deck system.

14. The system of claim 13, wherein the pair of first span truss panels are secured to the column slot vertical stiffeners, and wherein the second span truss panels are secured to the column vertical ribs.

15. The system of claim 11, further comprising a flexible rod assembly secured between the actuator system and the threaded screw rod, the flexible rod assembly being configured to release torque imparted on the actuator system during rotation of the screw rod.

16. The system of claim 15, wherein the flexible rod assembly includes a flexible rod coupling link, a flexible rod clevis link, and a flexible rod middle link, wherein the flexible rod coupling link and clevis link are arranged symmetrically around the flexible rod middle link.

17. The system of claim 11, wherein the actuator system includes a pair of motors, each motor being coupled to a worm gear reducer that is rotating a pair of coupling rods, an end of each coupling rod is separately secured to a machine screw actuator that is configured to rotate the threaded screw rod.

* * * * *